US008567659B2

(12) United States Patent
Chung

(10) Patent No.: US 8,567,659 B2
(45) Date of Patent: Oct. 29, 2013

(54) FILE FOLDER

(75) Inventor: Chanseol Chung, Hollywood, FL (US)

(73) Assignee: Ideastream Consumer Products, LLC, Cleveland, OH (US)

( * ) Notice: Subject to any disclaimer, the term of this patent is extended or adjusted under 35 U.S.C. 154(b) by 0 days.

(21) Appl. No.: 13/151,751

(22) Filed: Jun. 2, 2011

(65) Prior Publication Data

US 2011/0226844 A1 Sep. 22, 2011

Related U.S. Application Data

(62) Division of application No. 12/035,079, filed on Feb. 21, 2008, now Pat. No. 7,954,694.

(60) Provisional application No. 60/949,046, filed on Jul. 11, 2007, provisional application No. 60/890,961, filed on Feb. 21, 2007.

(51) Int. Cl.
*B65D 27/00* (2006.01)

(52) U.S. Cl.
USPC ..... 229/67.1

(58) Field of Classification Search
USPC ..... 229/67.1–67.4, 928, 92.1, 92.3; 40/359
See application file for complete search history.

(56) References Cited

U.S. PATENT DOCUMENTS 1,016,789 A 2/1912 Smith
1,060,559 A 4/1913 Rockwell
1,336,584 A * 4/1920 Ringer ..... 40/380
1,405,818 A 2/1922 Dickerson
1,507,433 A 9/1924 Schaffert
1,524,348 A 1/1925 Field
1,529,264 A 3/1925 Lewis
1,575,673 A 3/1926 Cameron
1,584,837 A * 5/1926 Bracken ..... 40/360
1,697,985 A 1/1929 Lindsay
1,759,255 A 5/1930 Greenhaus
1,803,823 A 5/1931 Wittenmyer
2,037,579 A 4/1936 Jonas
2,126,471 A 8/1938 Karlen (Continued)

FOREIGN PATENT DOCUMENTS

CA 126570 2/2011
CA 134439 2/2011

(Continued)

OTHER PUBLICATIONS

Ideastream Findit File Folders, 1/3 Cut, 11 Point Stock, Letter Size, Manila, 80/pack (FD07046), www.amazon.com, 4 pages, first available at Amazon.com: Apr. 18, 2006, downloaded on Jan. 4, 2011.

(Continued)

*Primary Examiner* — Jes F Pascua
(74) *Attorney, Agent, or Firm* — Calfee, Halter & Griswold LLP

(57) ABSTRACT

File folders are provided having bent hangers from which a receptacle is suspended so that the top of the receptacle is beneath a rail-engaging portion of the hangers and/or beneath a top of the rail or other supporting structure of office storage equipment. The hangers of the file folder may also be collapsible for use outside the office storage equipment. The hangers may also have a grip, or handle, for removal of the file folder from the office storage equipment.

15 Claims, 49 Drawing Sheets

(56) References Cited

U.S. PATENT DOCUMENTS 2,197,235 A 4/1940 Basher
2,223,642 A 12/1940 Shaw
2,233,687 A 3/1941 Vale
2,248,027 A 7/1941 Maass
2,257,052 A 9/1941 Hanna
2,274,909 A 3/1942 Murray
2,289,577 A 7/1942 Jonas
2,291,675 A 8/1942 Arelt
2,318,077 A 5/1943 Jonas
2,323,123 A 6/1943 Donato et al.
2,468,897 A 5/1949 Rothe
2,484,453 A 10/1949 Halverson
2,599,768 A 6/1952 Losch, Jr.
2,664,089 A 12/1953 Meltzer
2,874,699 A 2/1959 Dunleavy
D201,935 S 8/1965 Kelley
3,216,581 A 11/1965 Church
3,249,111 A 5/1966 Rene
3,288,144 A 11/1966 Hyams
3,524,688 A 8/1970 Dean
3,572,867 A 3/1971 Cooper
3,605,287 A 9/1971 Jonesi
3,639,020 A 2/1972 Nesbitt
3,667,854 A 6/1972 Jonas
3,680,969 A * 8/1972 Gorman ..... 402/3
3,683,533 A 8/1972 Kelly
2,312,717 A 3/1973 Jonas
3,790,242 A 2/1974 Sullivan
3,790,500 A 2/1974 Sullilvan
3,801,175 A 4/1974 Giulie
3,826,582 A 7/1974 Podosek
3,850,488 A 11/1974 Elias et al.
3,857,492 A 12/1974 Michaelis et al.
3,865,445 A 2/1975 Dean et al.
3,936,201 A 2/1976 Kenney et al.
3,950,048 A 4/1976 Unti et al.
3,957,321 A 5/1976 Rose
D240,395 S 7/1976 Feldmahr
4,009,784 A 3/1977 Elias et al.
4,031,646 A 6/1977 de Nouel
4,053,057 A 10/1977 Snowden
4,114,963 A 9/1978 Menahem
D250,715 S 1/1979 Hedstrom et al.
4,186,504 A 2/1980 Avery
4,208,146 A 6/1980 Schudy
4,255,888 A 3/1981 Bastogne
4,288,170 A 9/1981 Barber
4,294,028 A 10/1981 Reymond
4,395,058 A 7/1983 Terrell
4,400,103 A 8/1983 Daughters
4,400,107 A 8/1983 Pitts
4,403,816 A 9/1983 Da Cruz Garcia
4,420,086 A 12/1983 Bardes
4,449,270 A 5/1984 Brabant
4,477,013 A 10/1984 Herrin
4,487,520 A 12/1984 Maier-Hunke et al.
4,489,836 A 12/1984 Terrell
4,523,775 A * 6/1985 Reist ..... 283/36
4,526,277 A 7/1985 Snowden et al.
D282,758 S 2/1986 Hirsch
4,575,273 A 3/1986 Gerriet
4,576,328 A 3/1986 Snider et al.
4,624,480 A 11/1986 Marthaler et al.
4,645,237 A 2/1987 Squire et al.
4,681,232 A 7/1987 Du Corday
4,721,211 A 1/1988 Lundberg
4,722,626 A 2/1988 Abildgaard
D298,265 S 10/1988 Snider et al.
4,784,508 A 11/1988 Shannon
4,806,397 A 2/1989 Horwitz
4,830,268 A 5/1989 Pitts
4,893,745 A 1/1990 Weber
4,901,867 A 2/1990 Petty, Jr.
4,923,111 A 5/1990 Down
4,923,217 A 5/1990 Pressler
4,932,683 A 6/1990 Perazza
4,950,096 A 8/1990 Gilder
D312,277 S 11/1990 Moor
4,979,626 A 12/1990 Pitts
5,025,979 A 6/1991 Dellacroce
5,048,697 A 9/1991 Payne
5,052,646 A 10/1991 Hawes
5,066,045 A 11/1991 Hawes
D322,284 S 12/1991 Whaley et al.
5,111,941 A 5/1992 Hillestad
5,119,950 A 6/1992 Takemura
5,141,485 A 8/1992 Welt
5,154,527 A 10/1992 Blessing
5,187,888 A 2/1993 O'Brien et al.
5,197,762 A 3/1993 Abramov
5,205,626 A 4/1993 Fotioo
D337,784 S 7/1993 Wyant
5,226,734 A 7/1993 Scott et al.
5,248,290 A 9/1993 Hawes et al.
5,256,130 A 10/1993 Kachel et al.
5,261,636 A 11/1993 Hawes et al.
5,275,439 A 1/1994 Hawes et al.
5,295,622 A 3/1994 Lorber
5,299,879 A 4/1994 Burrow
5,311,685 A 5/1994 Wyant
5,328,259 A 7/1994 Meriaux
5,358,125 A 10/1994 Blessing
5,358,126 A 10/1994 Jones et al.
5,393,154 A 2/1995 Hubbell
5,401,058 A 3/1995 Holmberg
5,405,020 A 4/1995 Fotioo
5,487,617 A 1/1996 Cole et al.
5,492,268 A 2/1996 Biddle
5,494,161 A 2/1996 Herbst
5,503,435 A 4/1996 Kline
5,503,487 A 4/1996 Ong
5,515,980 A 5/1996 Fotioo
5,570,792 A 11/1996 Huang
5,570,833 A 11/1996 Dusek
5,599,128 A 2/1997 Steiner
5,626,368 A 5/1997 St. Romain
D382,301 S 8/1997 Baumgarten
5,692,673 A 12/1997 De Safey
5,707,001 A 1/1998 Mark et al.
5,721,531 A 2/1998 Garver et al.
5,722,692 A 3/1998 Abramov
5,743,566 A 4/1998 Hunter
5,749,479 A 5/1998 Belokin et al.
5,758,780 A 6/1998 Baumgarten
5,779,331 A 7/1998 Fox et al.
5,813,734 A 9/1998 Ong
5,873,642 A 2/1999 Domenig
D407,441 S 3/1999 Greenberg et al.
5,899,626 A 5/1999 Hatano et al.
5,924,812 A 7/1999 Goldman
5,941,450 A 8/1999 De Safey
5,942,293 A 8/1999 Occhipinti et al.
5,947,525 A 9/1999 Pollman
5,971,166 A 10/1999 Ong
5,993,099 A 11/1999 Greenberg et al.
D417,697 S 12/1999 Long
6,004,062 A 12/1999 Hunter
D419,358 S 1/2000 Marcon
6,039,354 A 3/2000 Mangler
6,039,473 A 3/2000 Bond
6,068,423 A 5/2000 Owen
6,071,030 A 6/2000 Hunter et al.
6,099,189 A 8/2000 Owen et al.
6,108,953 A 8/2000 Hall
6,182,827 B1 * 2/2001 Su ..... 206/425
6,227,746 B1 5/2001 Long et al.
6,340,178 B1 * 1/2002 Nakanishi et al. ..... 281/45
6,409,409 B2 6/2002 Bauman
6,453,589 B1 9/2002 Schwartz
6,508,376 B1 1/2003 Chiang
6,619,773 B2 9/2003 Amsterdam
6,808,104 B2 10/2004 Cobble
6,830,156 B2 12/2004 MacKelvie
6,926,158 B1 8/2005 Brown

(56) References Cited

U.S. PATENT DOCUMENTS

| | | | | |
|---|---|---|---|---|
| 7,025,382 | B2 | 4/2006 | Wiggins | |
| D522,576 | S | 6/2006 | Smith | |
| 7,059,483 | B2 | 6/2006 | Scudder | |
| 7,100,775 | B2 | 9/2006 | Yeh | |
| 7,108,169 | B2 | 9/2006 | Balzer | |
| D530,743 | S | 10/2006 | Ong | |
| 7,140,644 | B2 | 11/2006 | Hanes | |
| D536,701 | S | 2/2007 | Gusmorino et al. | |
| 7,210,659 | B2 | 5/2007 | Lawson et al. | |
| 7,232,537 | B2 | 6/2007 | Bullock | |
| D559,309 | S | 1/2008 | Rydzewski | |
| D568,930 | S | 5/2008 | Declerck | |
| 7,383,652 | B2 | 6/2008 | Glasberg | |
| D577,766 | S | 9/2008 | Rydzewski | |
| D582,192 | S | 12/2008 | Pan | |
| D588,634 | S | 3/2009 | Wittmeyer et al. | |
| D597,555 | S | 8/2009 | Ozzie et al. | |
| D601,189 | S | 9/2009 | Riesterer et al. | |
| 7,757,870 | B2 | 7/2010 | Lin et al. | |
| D622,320 | S | 8/2010 | DeCarlo et al. | |
| 7,900,813 | B2 | 3/2011 | Dodson | |
| 7,954,694 | B2 * | 6/2011 | DeCarlo et al. | 229/67.2 |
| 8,104,669 | B2 | 1/2012 | Christensen et al. | |
| 8,152,050 | B2 * | 4/2012 | Busam et al. | 229/67.1 |
| 2002/0129522 | A1 | 9/2002 | Yamamoto et al. | |
| 2003/0010815 | A1 | 1/2003 | Balzer | |
| 2005/0000839 | A1 * | 1/2005 | Densley | 206/425 |
| 2005/0019094 | A1 | 1/2005 | Hayes et al. | |
| 2005/0146750 | A1 | 7/2005 | Moroney et al. | |
| 2005/0199685 | A1 | 9/2005 | Mark et al. | |
| 2005/0206954 | A1 | 9/2005 | Schwier | |
| 2006/0016112 | A1 | 1/2006 | McCarthy et al. | |
| 2006/0059755 | A1 | 3/2006 | Valade et al. | |
| 2006/0226205 | A1 | 10/2006 | O'Leary et al. | |
| 2008/0218044 | A1 | 9/2008 | Unda et al. | |
| 2009/0045246 | A1 | 2/2009 | Dodson et al. | |
| 2011/0155793 | A1 | 6/2011 | Dodson | |

FOREIGN PATENT DOCUMENTS

| | | |
|---|---|---|
| CA | 134440 | 2/2011 |
| CA | 137054 | 2/2011 |
| DE | 237284 | 9/1986 |
| DE | 29801949 | 6/1998 |
| FR | 98167 | 4/1946 |
| FR | 1412327 | 9/1965 |
| FR | 2621865 | 4/1989 |
| FR | 2826910 | 1/2003 |
| GB | 619391 | 3/1949 |

OTHER PUBLICATIONS

Smead Manila Folder, Letter Size, 11 point, 1/3-Cut Tab, 1100 per Box (10330), Amazon.com, 5 pages, first available at Amazon.com: Nov. 1, 2006, downloaded on Jan. 3, 2011.

International Search Report for International Patent Application No. PCT/US2008/054549 dated Sep. 23, 2008.

Written Opinion for International Patent Application No. PCT/US2008/054549 dated Sep. 23, 2008.

2-Tone File Folders, 1/3 Cut, Top Tab, Letter, Light Yellow, by Esselte Pendaflex Corp., Amazon.com, 3 pages, first available at Amazon.com: Sep. 29, 2008, downloaded Jan. 3, 2011.

Ideastream 1/3 Cut Tab File Folder-Letter-8.5" ×11 " —Manila IDEFT007046, 2 pages, www.compsource.com, added to catalog Dec. 2, 2008, downloaded Jan. 4, 2011.

Find It Hanging File Folder with Innovative Top Rail, #FT07044, 3 pages, www.amazon.com, first available on Amazon.com: Feb. 3, 2009, printed from internet on Aug. 14, 2009.

Find It Tab View Hanging File Folder, #FT07033, ASIN: B001CDZ4U0, 4 pages, www.amazon.com, first available on Amazon.com: Feb. 3, 2009, printed from internet on Aug. 14, 2009.

Ideastream Findit Hanging File Folder with Innovative Top Rail, #FT07033, 3 pages on www.thenerds.net, copyright 2000-2008, printed from internet on Apr. 4, 2009.

One Folder, item #IDEFT07046, www.seaflog.com, 2 pages, Mar. 15, 2009, downloaded on Jan. 4, 2011.

International Preliminary Report on Patentability for International Patent Application No. PCT/US2008/054549 dated Aug. 26, 2009.

Final Office Action dated Jun. 27, 2012, for related U.S. Appl. No. 29/415,798.

Appeal Brief filed Mar. 27, 2013, for related U.S. Appl. No. 29/415,798.

Notice of Allowance dated Apr. 26, 2013, for related U.S. Appl. No. 29/416,789.

* cited by examiner

FILE FOLDER

CROSS REFERENCE TO RELATED APPLICATIONS

This application is a divisional of, claims priority to, and any other benefit of, U.S. patent application Ser. No. 12/035,079, filed on Feb. 21, 2009, and entitled FILE FOLDER, now, U.S. Pat. No. 7,954,694, which claims priority to, and any other benefit of, U.S. Provisional Application No. 60/890,961 filed Feb. 21, 2007, and entitled TAB VIEW HANGING FILE FOLDER, and U.S. Provisional Application No. 60/949,046 filed Jul. 11, 2007, and entitled FILE FOLDER SYSTEM, the entire disclosures of all which are hereby incorporated by reference.

FIELD OF THE INVENTION

The present invention relates generally to file folders. Some exemplary file folders are hanging type file folders and some are of the type referred to as "manila" file folders. Some of the hanging file folders have hangers with bends so that the top of the receptacle is substantially beneath a rail or other structure suspending the file folder. Some of the manila file folders, and related methods, are configured such that a tab of the folder may be located in a selectable position of a plurality of positions across the top of the folder.

BACKGROUND

Hanging file folders, for use in storage units such as file cabinets, desk drawers, and the like ("office storage equipment"), are commonly found in modern offices and businesses. Such folders may be formed by a sheet of heavy material with a central horizontal fold which forms the folder's bottom and open sides. Folds are also typically provided in the file's top edges through which suspension bars or rods are movably or immovably fixed. The ends of these bars or rods are typically exposed and may be notched, enabling the file to hang on the top edges of office storage equipment, or hang on rails within office storage equipment, or hang on rails of a file frame inside office storage equipment. Such folders may have a series of spaced-apart slots adjacent the top to receive lugs of index tabs for labeling the contents of the folders. Exemplary index tabs may be constructed of flexible clear plastic and form a folded structure that includes a message holder portion in which a paper message-carrying insert can be placed, and a base portion which includes two lugs for mounting the tab into the slots of the slotted file folder.

It is not uncommon for users to be frustrated using manila file folders inside hanging files. One source of this frustration is the fact that a very common US manila file folder size has a tab that is about 9.5 inches from central fold to the top of the tab, which is about the same depth as a very common US hanging file folder. Consequently, the tabs are largely or entirely within the file folder, and text on the tab cannot be read without either opening the hanging file folder or sliding the manila folder out far enough to read the tab. Another source of frustration is the fact that often the rails inside office storage equipment, and thus hanging file folders suspended from those rails, are located very near to an upper edge defining a drawer opening in the office storage equipment. Consequently, even if manila folders are sized taller to extend over the top of hanging file folders, they are bent and folded each time the drawer is opened and closed. Before long, the tabs of such manila folders are folded over or even detached from the folder, rendering them useless.

SUMMARY

According to the present invention, file folders are provided having special hangers from which a receptacle is suspended so that the top of the receptacle is located substantially beneath a rail-engaging portion of the hangers (with the rail or other structure suspending the file folder via the hangers) and/or beneath a top of the rail or other supporting structure. The hangers may be have bends (e.g., physically bent or stamped with bends in the stamping) so that the top of the receptacle is far enough beneath the rail-engaging portion of the hangers and/or beneath a top of the rail or other supporting structure that the top of the tab of a manila folder is not moved or bent when closed in office storage equipment (e.g., top of the tab of a manila folder is beneath the rail-engaging portion of the hangers and/or beneath a top of the rail or other supporting structure and/or beneath an upper edge defining an opening in the office storage equipment). Further, the hangers may have bends so that the distance between the top of the receptacle and the tab of a manila folder inside the hanging file folder is sufficient such that a user may read text on the tab without pulling it from the hanging file folder. The hangers of the file folder may also be collapsible for use outside the office storage equipment. The hangers may also have a grip, or handle, for removal of the file folder from the office storage equipment.

Further, the present invention provides a file folder and a method of using the file folder such that the tab of the folder may be located in a selected position of a plurality of positions across the top of the folder. The file folder, which may be made from a single piece of material, may be folded in multiple directions and along multiple fold locations to produce folders having tabs at the various locations. As such, only one type of folder (and one type of folder die) is required to organize a file folder system such that the location of the tab is different from one folder to the next. This simplifies manufacturing and stocking and helps prevent a common situation of running out of file folders with a tab at one position, but still having a number of file folders in a different location. For example, the sheet may be cut and a folder may be folded such that the tab may be located in any of four different positions (i.e., Left, Left Center, Right Center, and Right), any of three different positions (i.e., Left, Center, and Right), or any of two different positions (i.e., Left and Right).

BRIEF DESCRIPTION OF THE DRAWINGS

FIGS. 1-4 are various views of a file folder according to an exemplary embodiment of the invention, wherein FIG. 1 is a partial cut away perspective view and FIG. 4 shows the suspension bars unattached from the file folder;

FIGS. 15 and 16 are various views of a file folder according to another exemplary embodiment of the invention, wherein FIG. 15 is a partial cut away perspective view;

FIGS. 17 and 18 are various views of a file folder according to another exemplary embodiment of the invention, wherein FIG. 17 is a partial cut away perspective view;

FIGS. 19-21 are various views of a file folder according to another exemplary embodiment of the invention, wherein FIG. 19 is a partial cut away perspective view and FIG. 21 shows a die cut of the material forming the receptacle of the file folder;

FIG. 22 is a partial cut away perspective view;

FIGS. 30 and 33 are partial cut away perspective views;

FIG. 36 is a partial cut away perspective view, and FIG. 39 shows the suspension bars unattached from the file folder;

FIG. 41 is a partial cut away perspective view;

FIG. 44 is a partial cut away perspective view;

DESCRIPTION

The figures show various views of exemplary hanging file folders with special hangers permitting a manila file folder to be held within the receptacle of the file folder in such a manner that the tab is viewable from above inside office storage equipment (such as an open drawer or cabinet) and a tab of the manila folder is not bent when closed in the office storage equipment. The figures also show a file folder and depict a method of using the file folder such that the tab of the folder may be located in numerous positions across the top of the folder.

An exemplary hanging file folder for use in a piece of office storage equipment may comprise a sheet of material having a central fold, a first edge, and a second edge, wherein the central fold forms a bottom, a first side, and a second side of the file folder, the first edge defining a top of the first side of the file folder, and the second edge defining a top of the second side of the file folder. The exemplary file folder may include a first suspension bar and a second suspension bar, each suspension bar having two ends, wherein the first suspension bar is affixed to the first edge and the second suspension bar is affixed to the second edge. Each end of each suspension bar may be exposed and has a rail supporting portion that enables the file folder to suspend from rails inside the piece of office storage equipment. The exposed ends of at least one suspension bar each have a bend such that at least one edge of the file folder is a substantial distance beneath the rail supporting portions of the exposed ends of the at least one suspension bar. This exemplary embodiment may be used with a manila folder having a height between a fold and the top of the tab of about 9.5 inches (e.g., 9.5 inches+/−1/16 inch). With such a manila folder inside the exemplary hanging file folder, with the fold of the manila folder resting on the bottom of the file folder when the file folder is suspended from rails inside the piece of office equipment, the tab of the manila folder extends above at least one edge a distance sufficient to permit a user to read text on the tab without having to pull the manila folder from the file folder. Additionally, in this example, the top of the tab of the manila folder is no more than 0.1 inches above a top portion of the exposed ends of the at least one suspension bar. In this example, the first edge may be defined by a first edge fold and the second edge may be defined by a second edge fold, with the first edge fold forming a first pocket along the top of the first side and the second edge fold forming a second pocket along the top of the second side. The first suspension bar may be at least partially disposed within the first pocket and the second suspension bar may be at least partially disposed within the second pocket.

Figure 55:
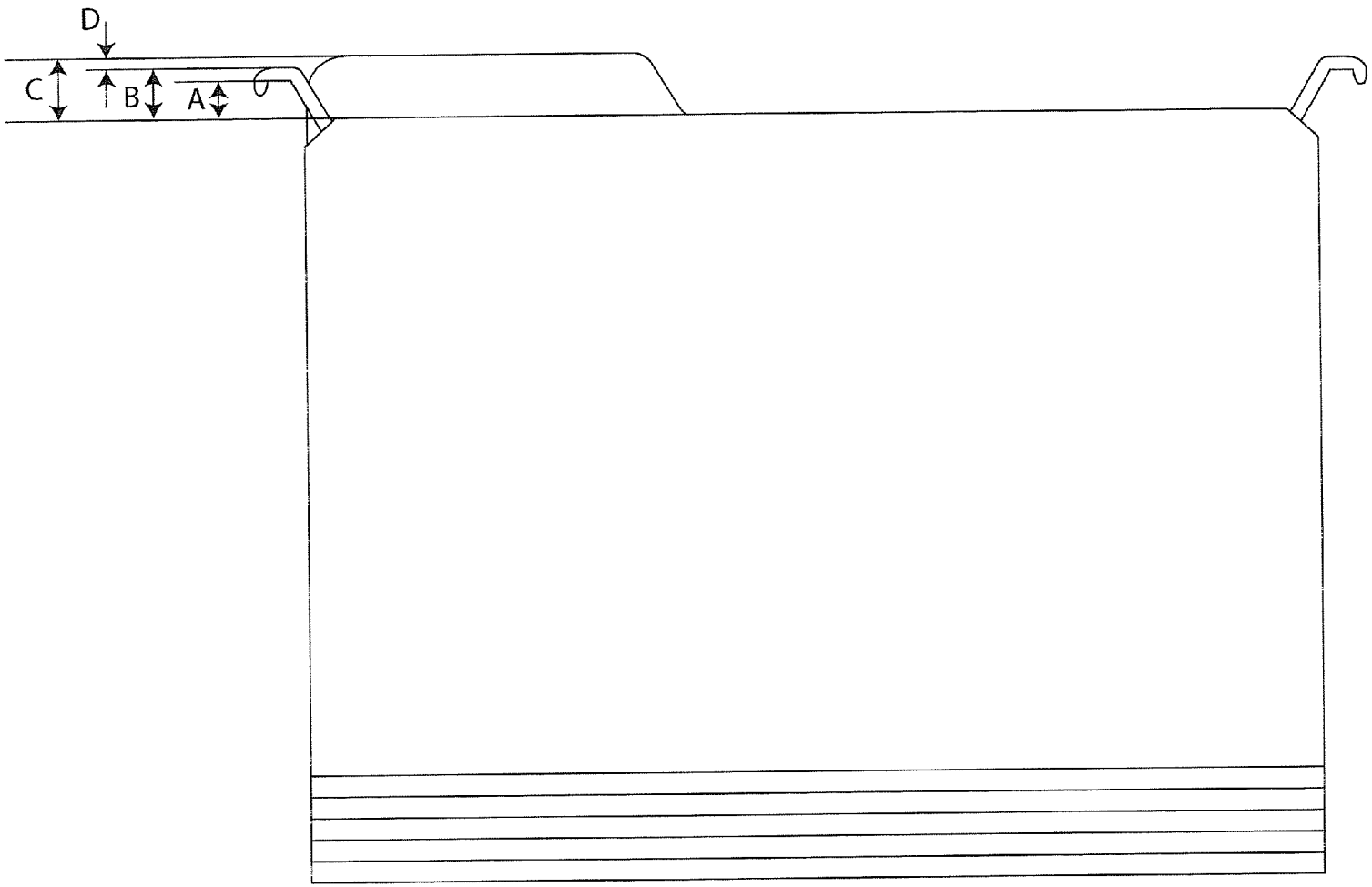
FIG. 55 is view of a file folder showing various dimensions.
Figure 56:
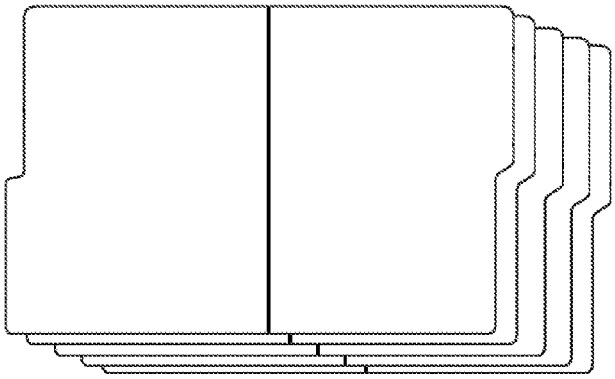
FIG. 56 is a schematic drawing showing an exemplary kit embodiment of the invention.
Figure 56:
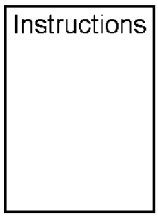

The top edges (e.g., top of the edge folds) may be substantially beneath a rail-supporting portion of the suspension bar by various different suitable amounts in different embodiments (e.g., dimension A in FIG. 55), e.g., by: at least 0.25"; at least 0.4"; at least 0.47" or 0.48"; about 0.3" to 0.7"; about 0.4" to 0.6"; about 0.47" to 0.52"; or about 0.48". Similarly, the top edges may be substantially beneath a top portion of the suspension bar by various different suitable amounts in different embodiments (e.g., dimension B in FIG. 55), e.g., by: at least 0.25"; at least 0.5"; at least 0.6"; about 0.4" to 0.8"; about 0.5" to 0.7"; about 0.61" to 0.63"; or about 0.62". Further, the distance between the top edges and the top of the tab of the 9.5" manila folder inserted into the file folder may be various different suitable amounts in different embodiments (e.g., dimension C in FIG. 55), e.g., at least 0.4"; at least 0.5"; at least 0.7", about 0.6" to 0.8"; or about 0.7". This distance may be along the entire length of the top edge beneath the tab or at least a portion of the entire length. Further, the distance the tab of the 9.5" manila folder inserted into the file folder extends above the top of the suspension bars may be various different suitable amounts in different embodiments (e.g., dimension D in FIG. 55), e.g., no more than 0.1"; no more than 0.09"; about 0.05" to 0.1"; or about 0.085". In certain embodiments, the tab of a manila folder inserted into the file folder may be slightly below the top of the suspension bar by about 0.05" to 0.1" or be substantially aligned with the top. Thus, the top of the file folder is low enough to read the tab of the manila folder.

An exemplary file folder may include a removable tab attached to at least one side of the file folder such that a user may read a label within the removable tab when the file folder is suspended from rails inside the piece of office equipment. In this embodiment, the tab of a manila folder inserted in the file folder extends above the at least one edge fold a distance sufficient to permit a user to read text on the tab without having to pull the manila folder from the file folder. The user may also read text on the label above the tab of the manila folder. Further, an exemplary file folder may have at least one pocket that runs along at least one entire top edge of at least one side of the file folder. For example, a first pocket may run along the entire top edge of the first side of the file folder and a second pocket may run along the entire top edge of the second side of the file folder.

An exemplary file folder may also have at least one handle operatively connected to the file folder and configured such that a user may carry the file folder upright. In some embodiments, the at least one handle is operatively connected to at least one suspension bar. The at least one handle may protrude through an opening in the file folder, for example such as an edge fold, a side, or a pocket. The at least one handle may be integrally formed as part of the at least one suspension bar, for example formed from a set of bends or rounded. An exemplary file folder may have more than one handle. For example, some exemplary file folders have two handles, each handle being operatively connected to one of the suspension bars, located at about the center of one of the suspension bars, and configured such that a user may carry the file folder upright. Further, in some embodiments, each suspension bar is stamped from a single piece of metal with the bends cut into the stamping.

Another exemplary file folder for use in a piece of office storage equipment may comprise a sheet of material having a central fold, a first edge fold, and a second edge fold. The central fold generally forms a bottom, a first side, and a second side of the file folder. The first edge fold forms a first pocket along a top edge of the first side of the file folder and the second edge fold forms a second pocket along a top edge of the second side of the file folder. The exemplary file folder also comprises four hangers, wherein two hangers are operatively connected to the first side and at least partially disposed within the first pocket and two hangers are operatively connected to the second side and at least partially disposed within the second pocket. In this embodiment, a hanging end of each hanger is movable from a collapsed position to a hanging position. The hanging end of each hanger is exposed when in the hanging position and has a rail supporting portion that enables the file folder to suspend from rails inside the piece of office storage equipment. Further, the hanging end of each hanger has a bend such that at least one edge fold of the file folder is a substantial distance beneath the rail supporting portion of the hanging end of each hanger. The exemplary file folder may optionally have an actuating end of at least one hanger that is exposed when the at least one hanger is in the collapsed position such that the user may use the actuating end to pivot the at least one hanger towards the hanging position. The optional actuating end may protrude through an opening in at least one edge fold. Further, at least one hanger may be pinched within at least one pocket such that a user must apply a force on the at least one hanger to pivot the at least one hanger relative to the sheet of material.

Figure 1:
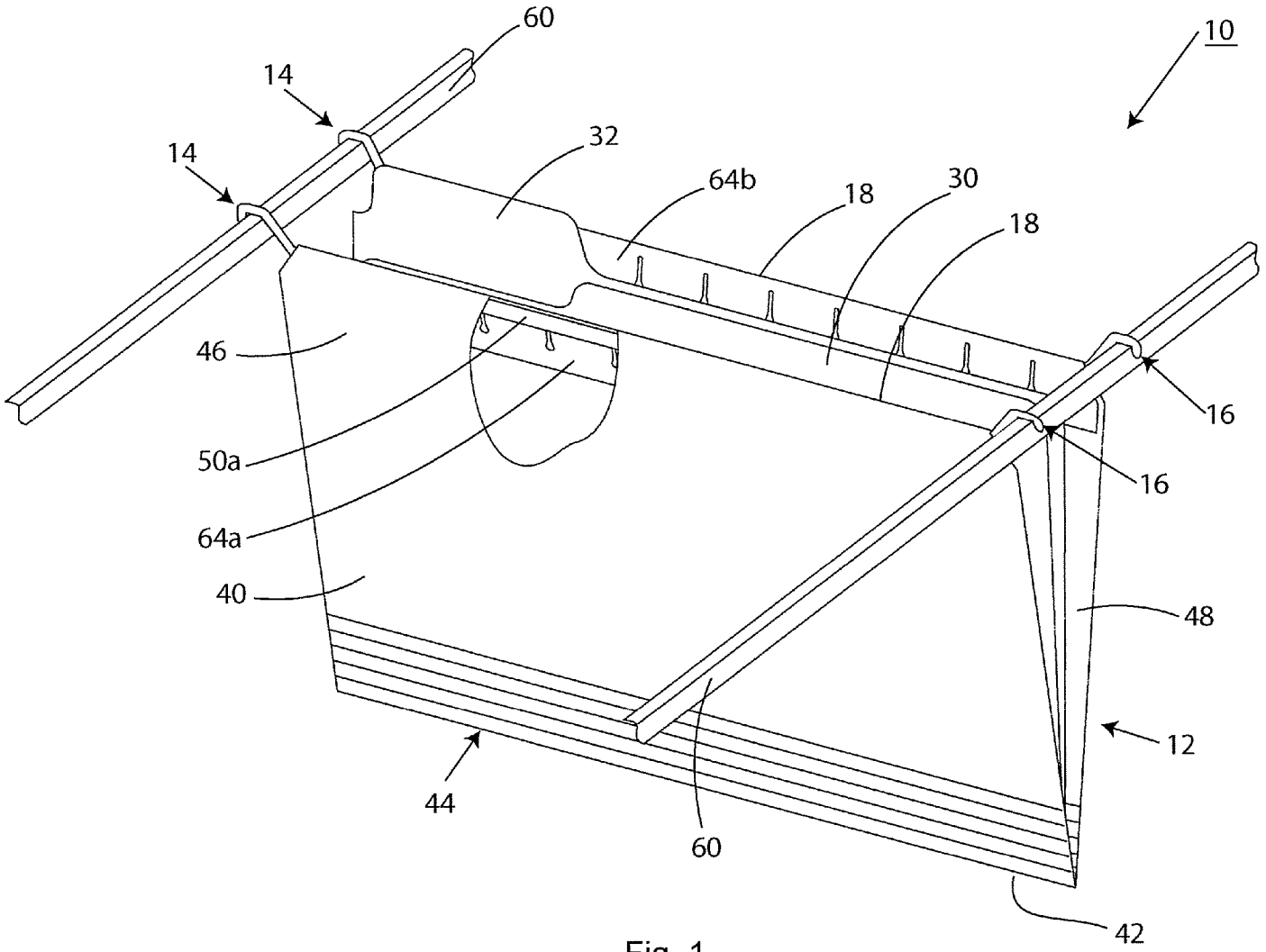
Figure 2:
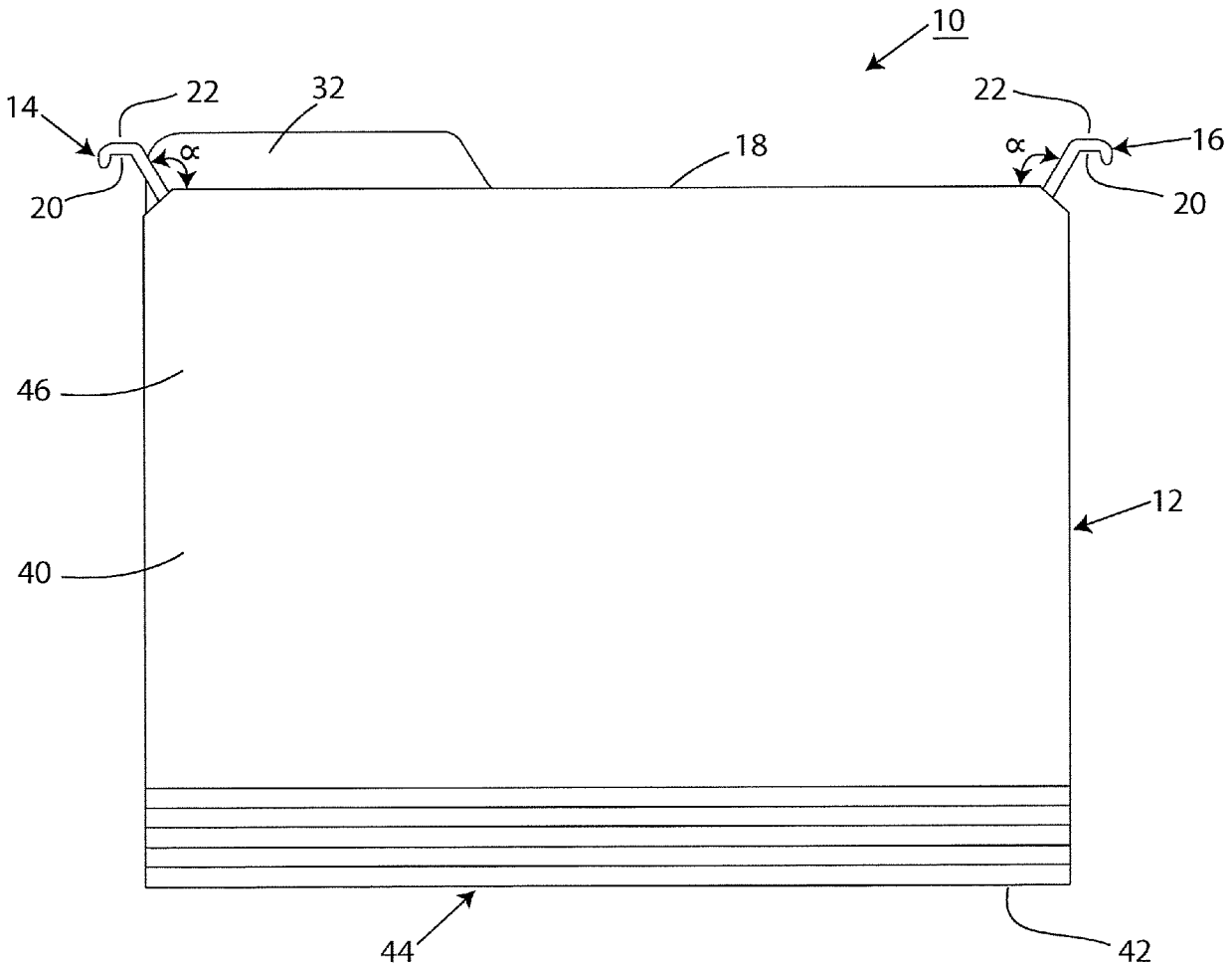
Figure 5:
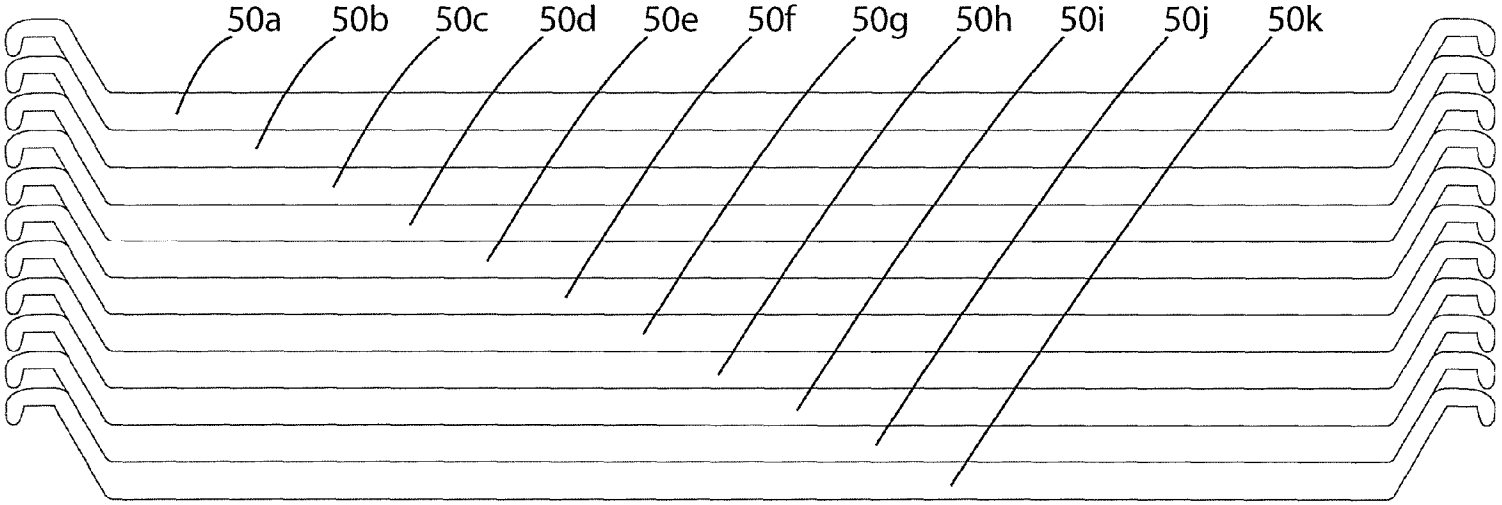
FIGS. 5 and 6 are top plan views of suspension bars according to another exemplary embodiment of the invention.
Figure 6:
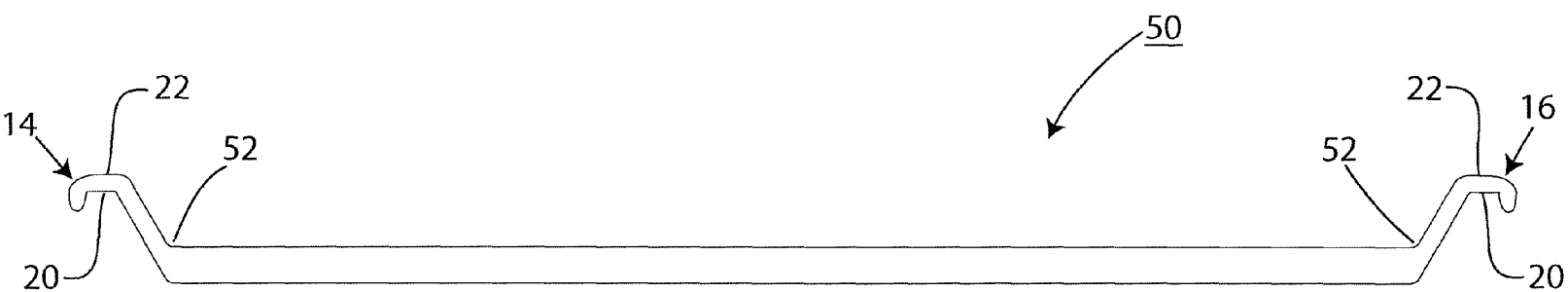
Figure 7:
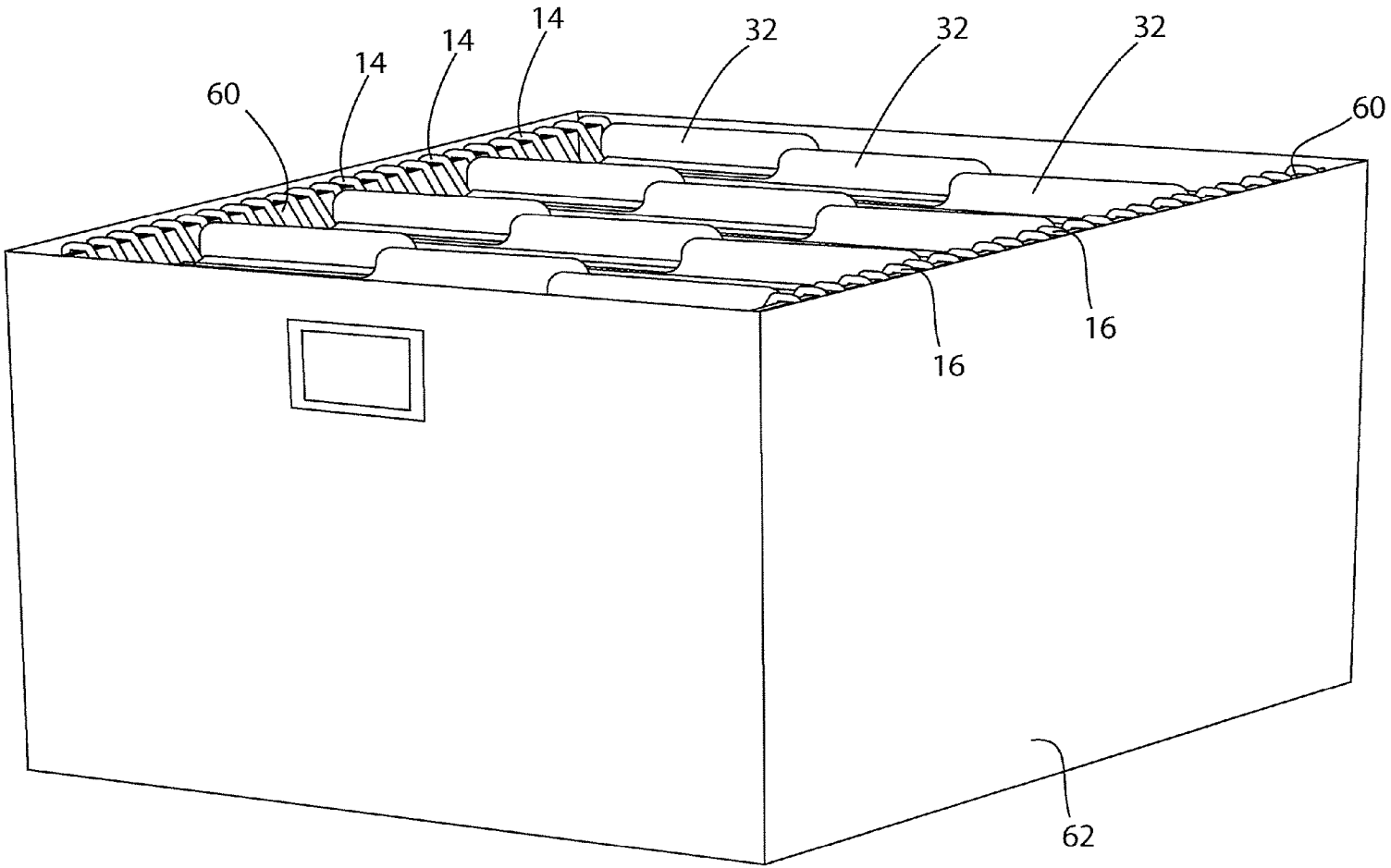
FIG. 7 is a perspective view of the exemplary file folder shown in FIGS. 1-4, wherein multiple file folders are shown hanging from rails inside exemplary office storage equipment.
Figure 8:
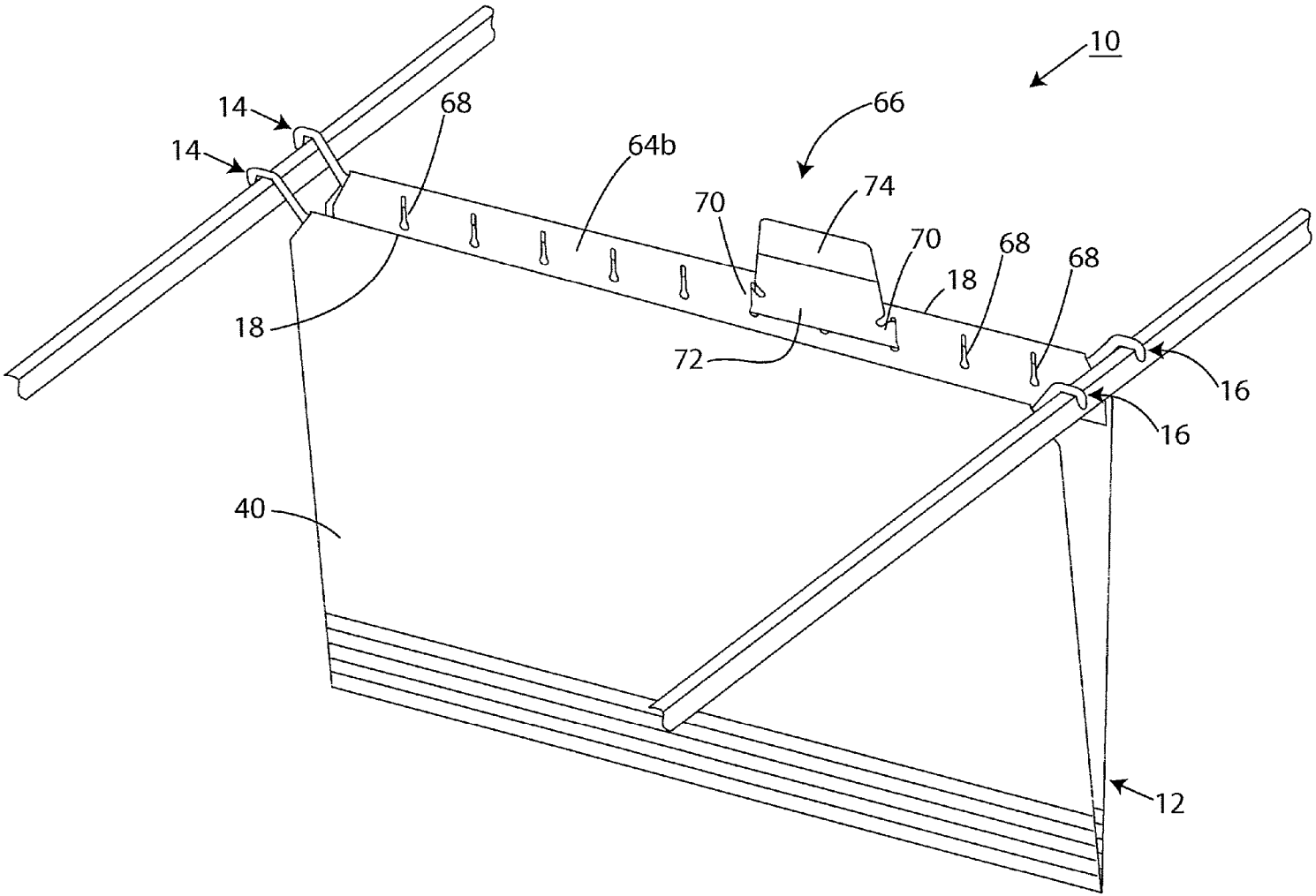
FIGS. 8 and 9 are various views of the exemplary file folder shown in FIGS. 1-4, wherein the file folder has an exemplary removable index tab.

Referring now to the drawings, FIGS. 1-7 show an exemplary hanging file folder 10 having a receptacle 12 suspended by a pair of bent hangers 14, 16, according to an embodiment of the invention. A top edge 18 of the receptacle 12 is substantially beneath (e.g., about a half-inch beneath) a rail-supporting portion 20 of the hangers 14, 16 and/or substantially beneath (e.g., about a ⅝-inch beneath) a top portion 22 of hangers 14, 16. As shown in FIGS. 1 and 7, the bent hangers 14, 16 permit a manila file folder 30 to be held within the receptacle 12 of the file folder 10 in such a manner that a tab 32 of the manila folder 30 is viewable from above inside office storage equipment 62 and the tab 32 of the manila folder 30 is not bent when closed in the office storage equipment. The hangers 14, 16 may be considered as being "bent" with respect to the top edge 18 of the receptacle because there is an angle $\alpha$ between the hangers and the top edge 18. The bends may be formed by any number of acceptable ways, e.g., physically bending a piece of material forming the hanger, or molding a bend into a molded piece, or by stamping a piece of material with the bends already in place. The bends may be sharp bends, or gently curving bends, or other bends, or combinations thereof. FIG. 7 shows a plurality of the exemplary file folders 10 together in an exemplary piece of office equipment with manila folders therein. The tabs of the manila folders are clearly visible above the top edges of the receptacles, yet the tabs of the manila folders do not extend very far above the top of the hangers.

Figure 3:
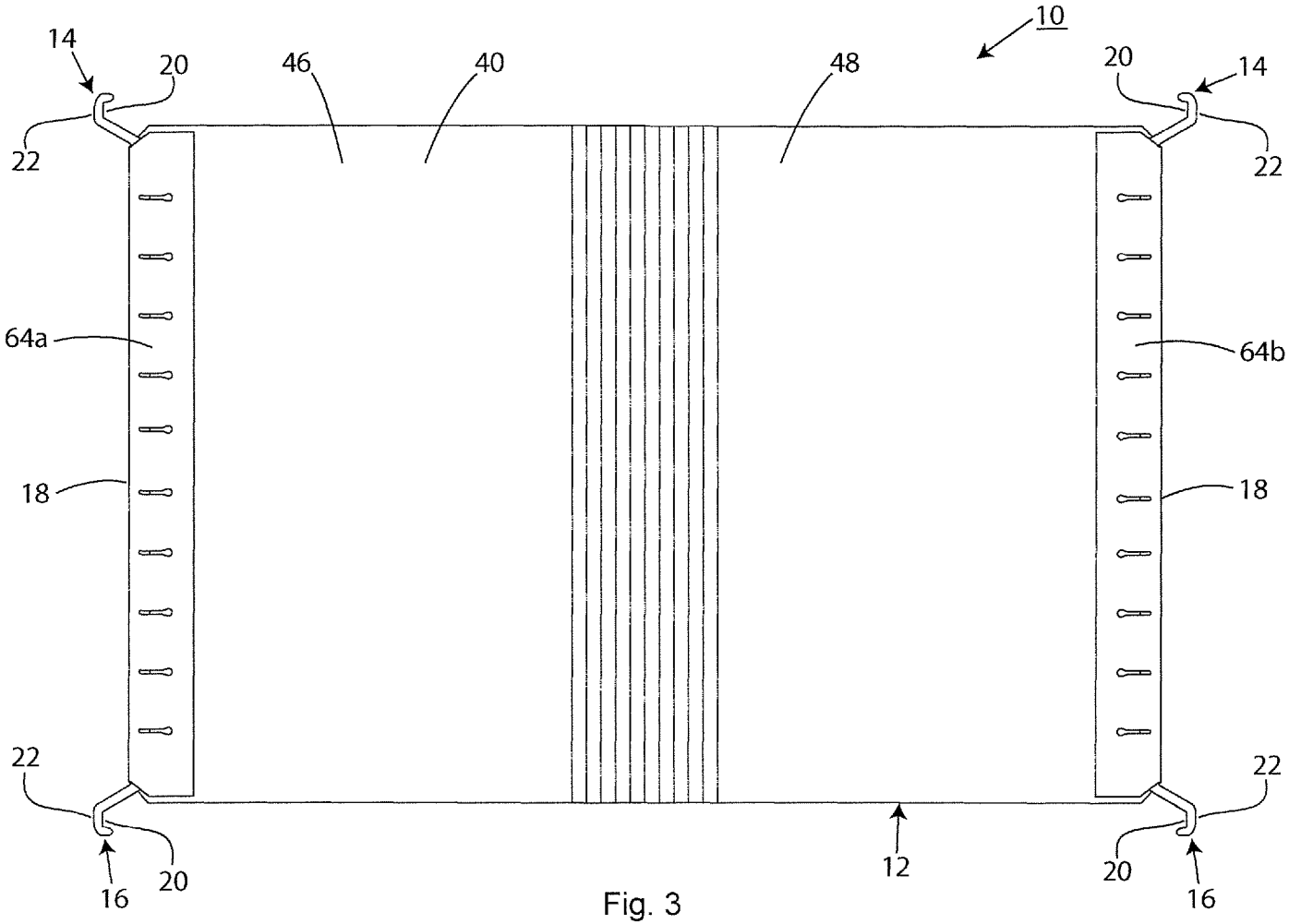
Figure 4:
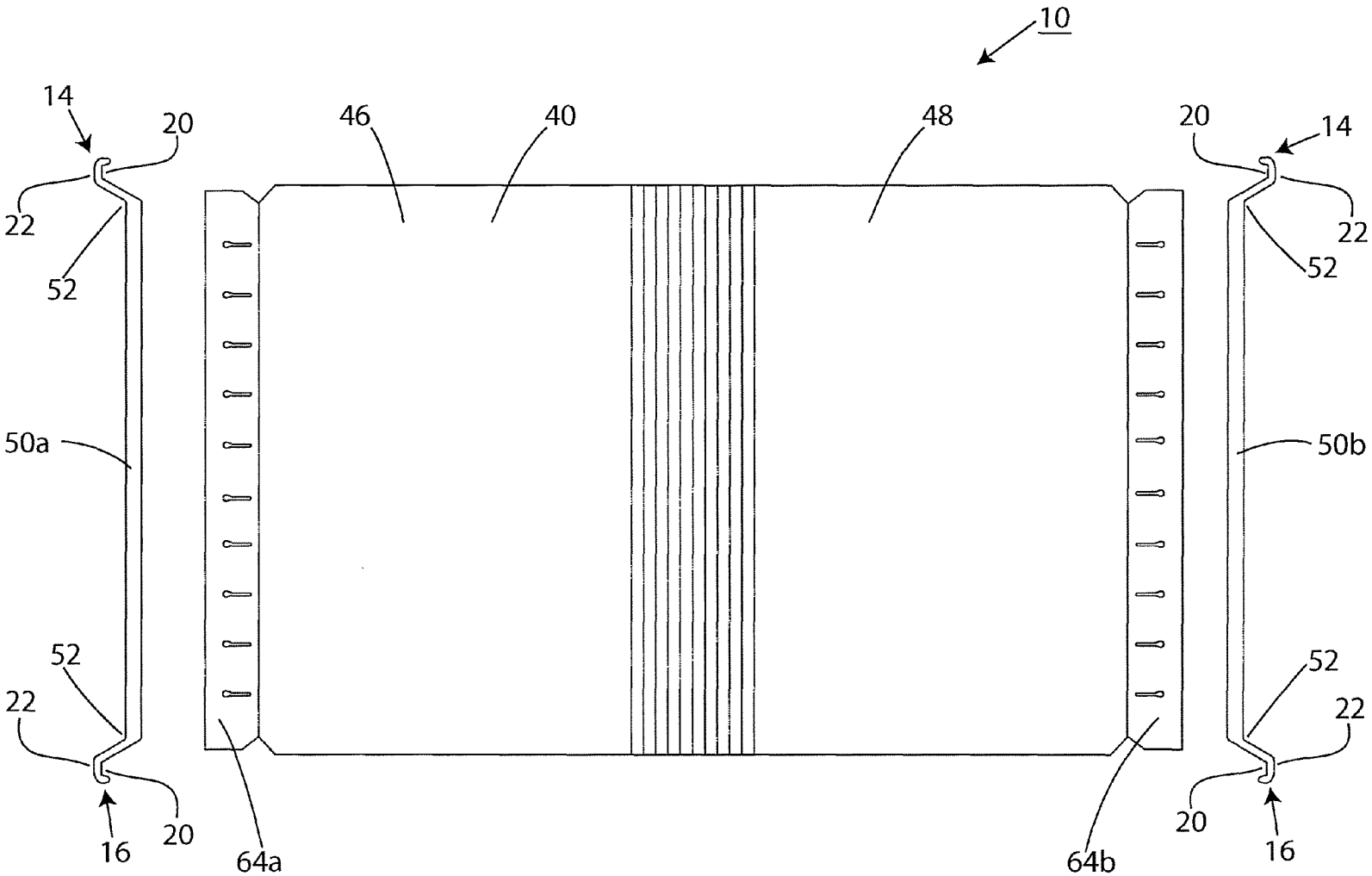

The receptacle 12 shown in FIGS. 1-7 is formed by a sheet of heavy material 40 with a central horizontal fold 42, which forms the bottom 44 and open sides 46, 48 of the receptacle 12. The material 40 may have a plurality of crease lines. The material 40 may be heavy paper or card stock, plastic, fabric or other suitable flexible material, and may be coated with any suitable file folder coating. The material 40 may also be formed from a plurality of layers of different materials. As shown in FIGS. 3 and 4, the top parts 64*a*, 64*b* of the material 40 are folded inwardly and over suspension bars 50*a*, 50*b* to form inward flaps thereby forming pockets for the suspension bars. As shown, the flaps form one pocket for each suspension bar. However, in certain embodiments, the top parts may form multiple flaps and multiple pockets for each suspension bar. The top parts 64*a*, 64*b* may also have predetermined creased fold lines that enable folding the ends over the suspension bars 50*a*, 50*b* during manufacture of the hanging file folders. The inside of the flaps of material 40 may be glued by an adhesive swath to opposing inside surfaces of the folder 10 thereby bonding the flaps to the material 40 and forming the pockets. The inside of the flaps may, however, attach to opposing inside surfaces of the folder 10 by any suitable means known in the art, such as for example with one or more fasteners. Further, in certain embodiments (e.g., with and without pockets), the suspension bar may be attached to the sheet of material forming the receptacle by any suitable means known in the art, such as with one or more fasteners, and/or adhesive.

The hangers 14, 16 shown in FIGS. 1-7 are integrally formed as parts of a suspension bar 50 having bends 52. However, in other embodiments disclosed herein, the hangers are separated (i.e., not connected to each other) or individually attached to a suspension bar. More specifically, as shown in FIG. 5, the exemplary suspension bar 50 is planar and stamped from a piece of stock forming a plurality of suspension bars 50*a*-50*k*. As shown in FIG. 6, the cut-out forming the suspension bar 50 has a pair of bends 52, with the bends forming hangers 14, 16. The hangers 14, 16 are thus at the exposed ends of suspension bar 50. The hangers in this exemplary implementation have a notch or recess, or rail supporting portion 20, formed to receive a rail 60 or other suspending structure of office storage equipment 62. In other embodiments, the suspension bar may be formed from a single piece of metal and the bends are formed from physically bending the metal piece.

The top edge 18 of the receptacle 12 shown in FIGS. 1-7 may be substantially beneath the rail-supporting portion 20 of the hangers 14, 16 by various different suitable amounts in different embodiments, e.g., by: at least 0.25"; at least 0.4"; at least 0.47" or 0.48"; about 0.3" to 0.7"; about 0.47" to 0.52"; or about 0.48". The top edge 18 of the receptacle 12 may be substantially beneath a top portion 22 of the hangers 14, 16 by various different suitable amounts in different embodiments, e.g., by: at least 0.25"; at least 0.5"; at least 0.6"; about 0.4" to 0.8"; about 0.61" to 0.63"; or about 0.62". Further, the angle $\alpha$ between the hangers 14, 16 and the top edge 18 may be any of several suitable angles, e.g.: 90 to 135 degrees; 115 to 125 degrees; or 120 degrees.

The distance between the top edge 18 of the receptacle 12 and the top of the tab 32 of the manila folder 30 inserted into the file folder 10 may be any of various different suitable lengths in different embodiments, e.g.: at least 0.4"; at least 0.5"; or about 0.7". This distance may be along the entire length of the top edge 18 beneath the tab 32 or at least a portion of the entire length. Further, the tab 32 of the manila folder 30 inserted into the file folder 10 may extends slightly above the top of the hangers 14, 16 by various different suitable amounts in different embodiments, e.g., by: no more than 0.1"; no more than 0.09"; about 0.05" to 0.1"; or about 0.085". In other exemplary embodiments, the tab of a manila folder inserted into the file folder may be slightly below the top of the hangers by about 0.05" to 0.1" or be substantially aligned with the top. Thus, the top 18 of the receptacle 12 is low enough to read the tab 32 of the manila folder 30.

Figure 9:
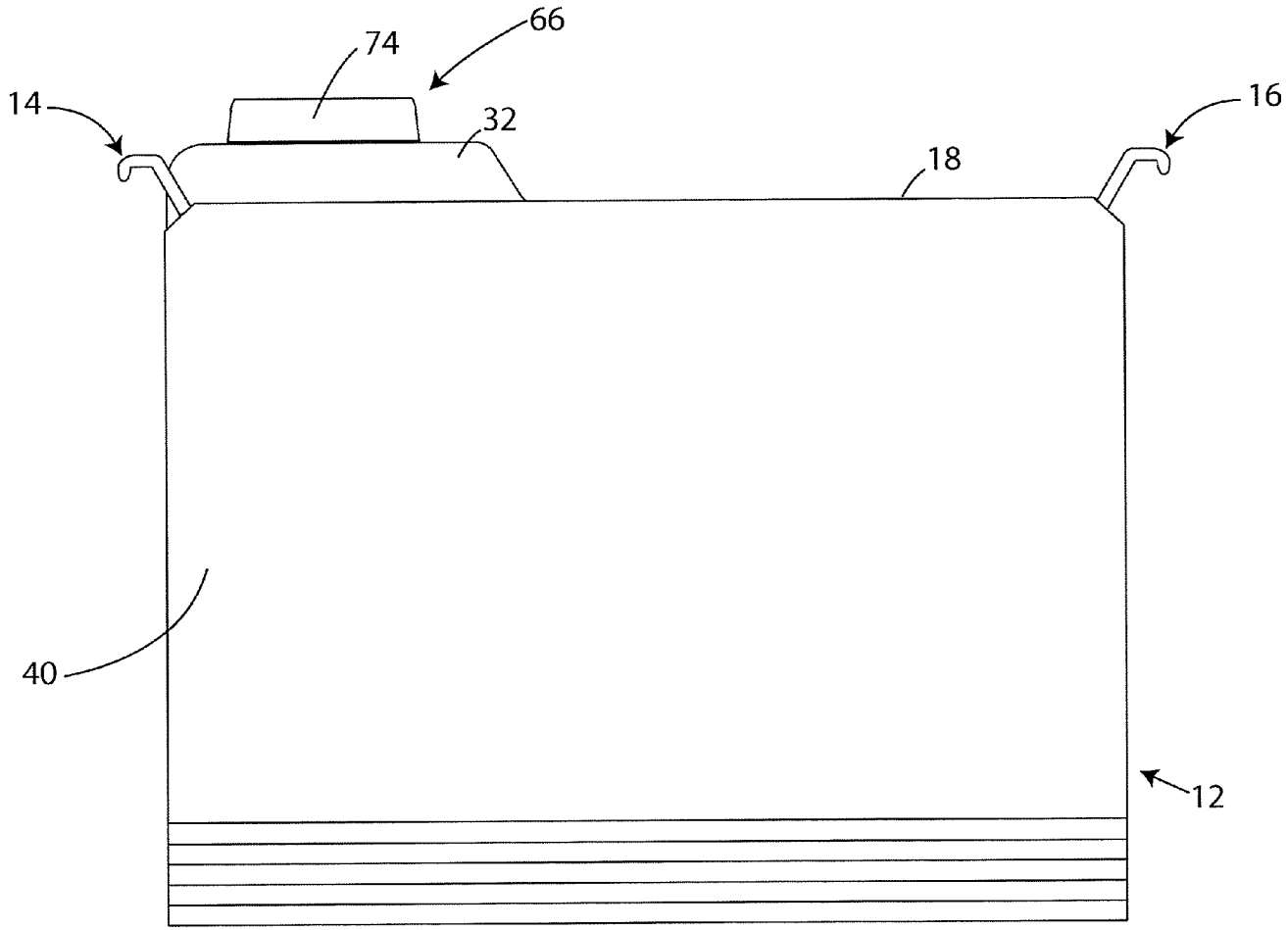
Figure 12:
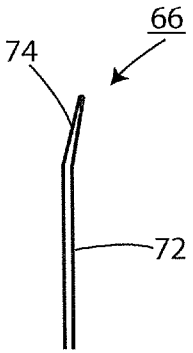
FIGS. 10-14 are various views of the exemplary removable index tab shown in FIGS. 8 and 9.
Figure 11:
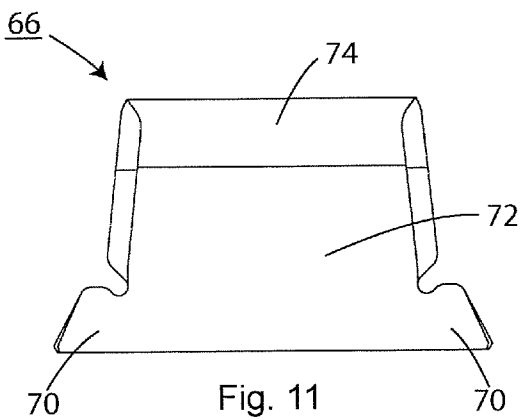
Figure 10:
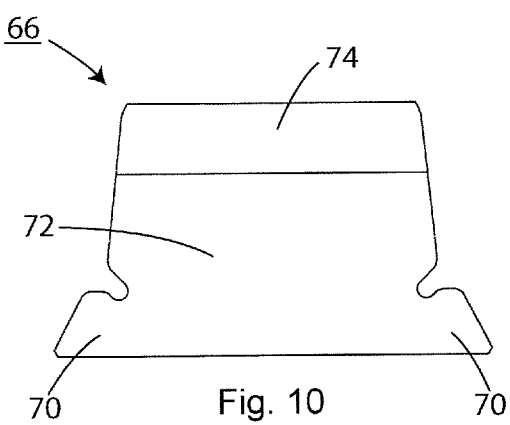
Figure 14:
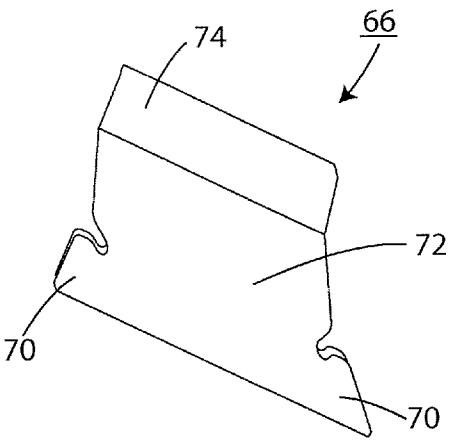
Figure 13:
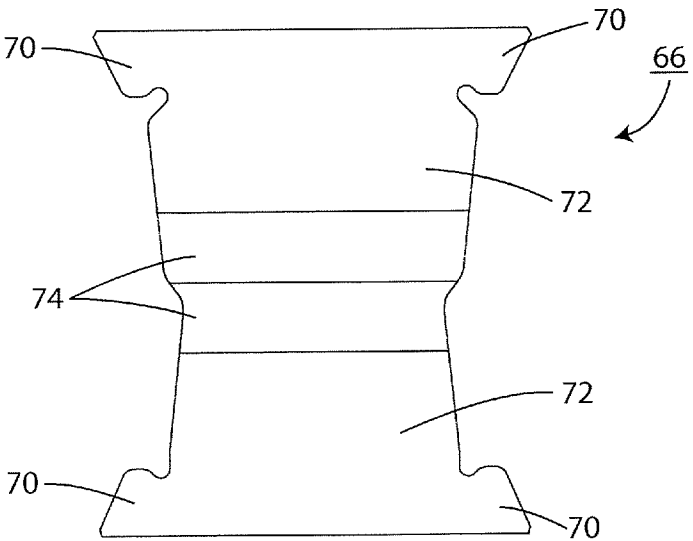

FIGS. 8-14 show an exemplary tab 66 for use with the exemplary hanging file folder 10 depicted in FIGS. 1-7 for labeling the contents of the folder. The exemplary index tab 66 shown is removable and may be located in various positions along the top edge 18 of the receptacle 12. Because the top edge of the exemplary hanging folder 10 is significantly lower than conventional hanging file folders, the exemplary tab 66 is taller than typical tabs, which permits the tab 66 to be read above the tabs of manila folders and read above ordinary hanging file folders. As stated, the top parts 64*a*, 64*b* of the material 40 are folded inwardly and over suspension bars 50*a*, 50*b* to form inward flaps thereby forming pockets for the suspension bars. These flaps may comprise a plurality of equally spaced apart vertical slots 68 for receiving insertable resilient locating arms 70 of the index tab 66. Exemplary index tabs 66 may be constructed of flexible clear plastic and form a folded structure that includes a message holder portion 74 in which a paper message-carrying insert can be placed, and a base portion 72 which includes two locating arms 70, or lugs, for mounting the tab into the slots 68 of the slotted file folder 10. As shown in FIG. 9, the base portion 72 of the index tab 66 is configured such that the message holder portion 72 of the tab may be read by a user when a manila folder is inserted into the file folder 10 and the user may read text on the tab 32 of the manila folder without having to pull the manila folder from the file folder.

Figure 15:
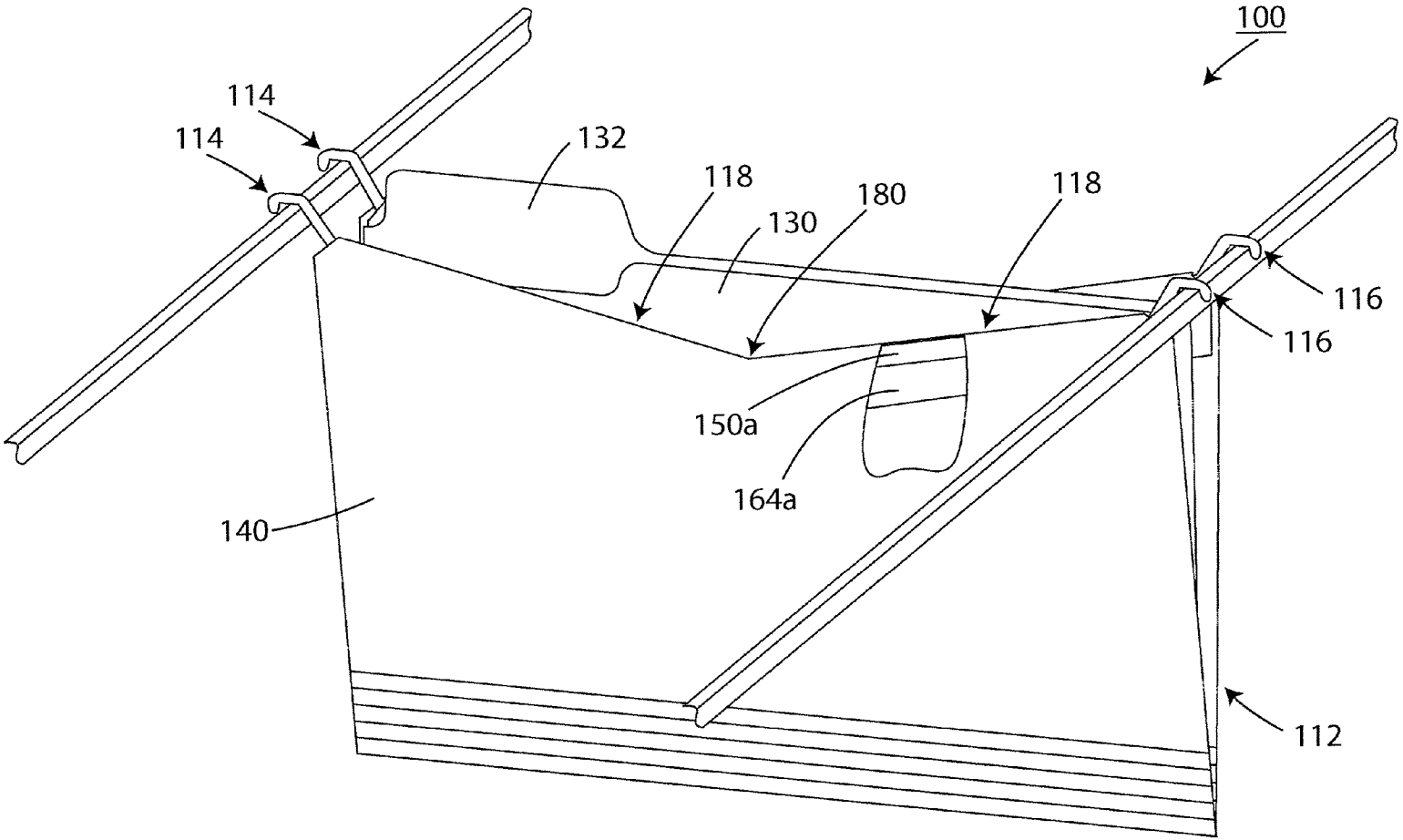
Figure 16:
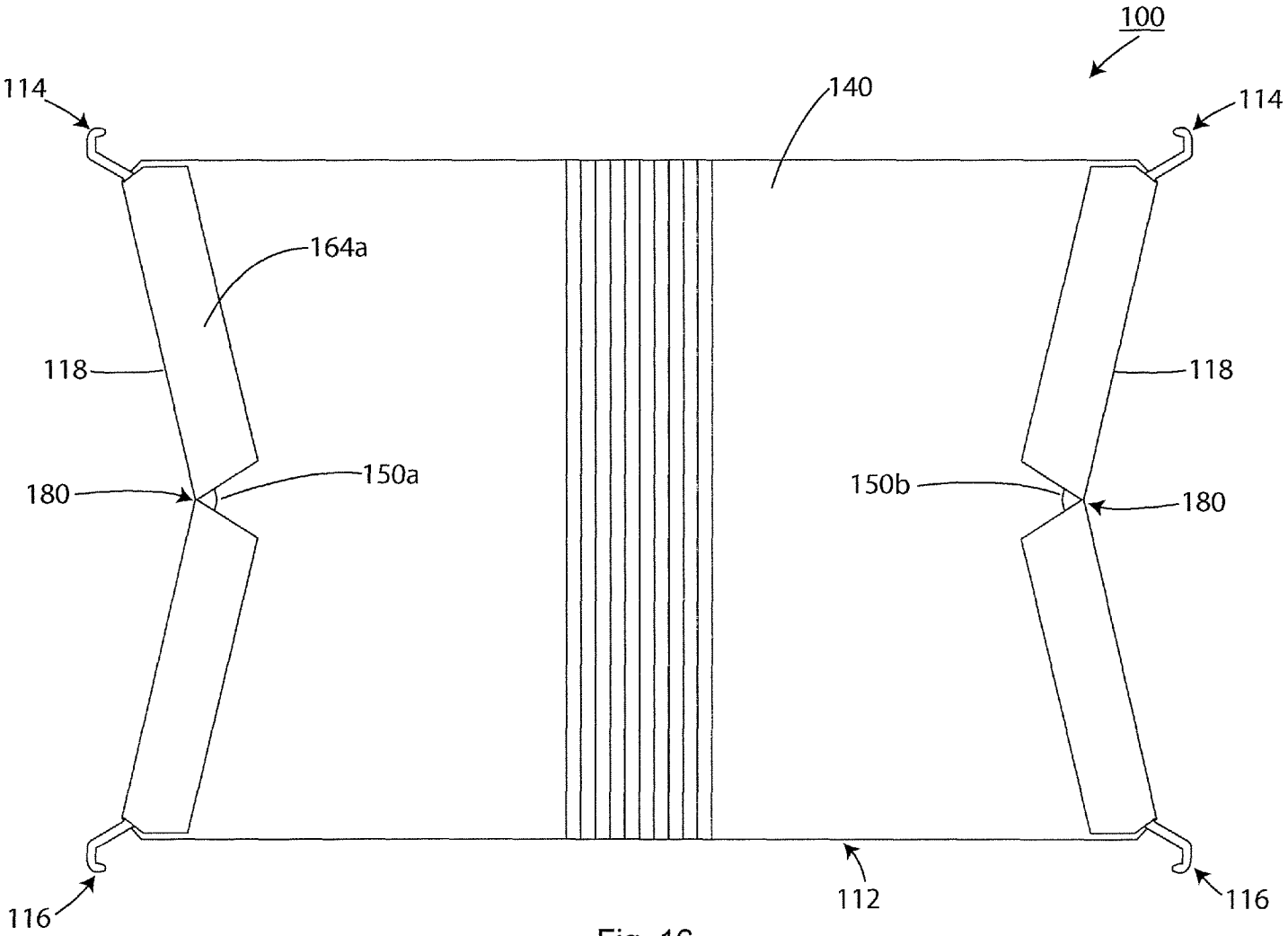

FIGS. 15 and 16 show an exemplary hanging file folder 100 having a receptacle 112 suspended by a pair of bent hangers 114, 116, according to another exemplary embodiment of the invention. The file folder 100 is very similar to the file folder 10 depicted in FIGS. 1-7. However, the top edges 118 of the receptacle 112 and the suspension bars 150*a*, 150*b* have a central bend 180 (as compared to the horizontal suspension bar in the embodiment of FIGS. 1-7). The bend 180 reduces the amount of material 140 required for the receptacle 112 and allows the user more room to access a manila folder 130 inserted in the file folder 100. The top parts 164*a*, 164*b* of the material 140 are folded inwardly and over suspension bars 150*a*, 150*b* to form inward flaps thereby forming pockets for the suspension bars. As shown, the flaps form two pockets for each suspension bar. Further, the angle between the hangers 114, 116 and the top edge 118 is greater than 90 degrees; but less than 180 degrees. The bends in the hangers 114, 116 may be shaped, sized, and configured as any of the various combinations and permutations of sizes discussed in the earlier embodiments, e.g., the embodiment of FIGS. 1-7.

Figure 17:
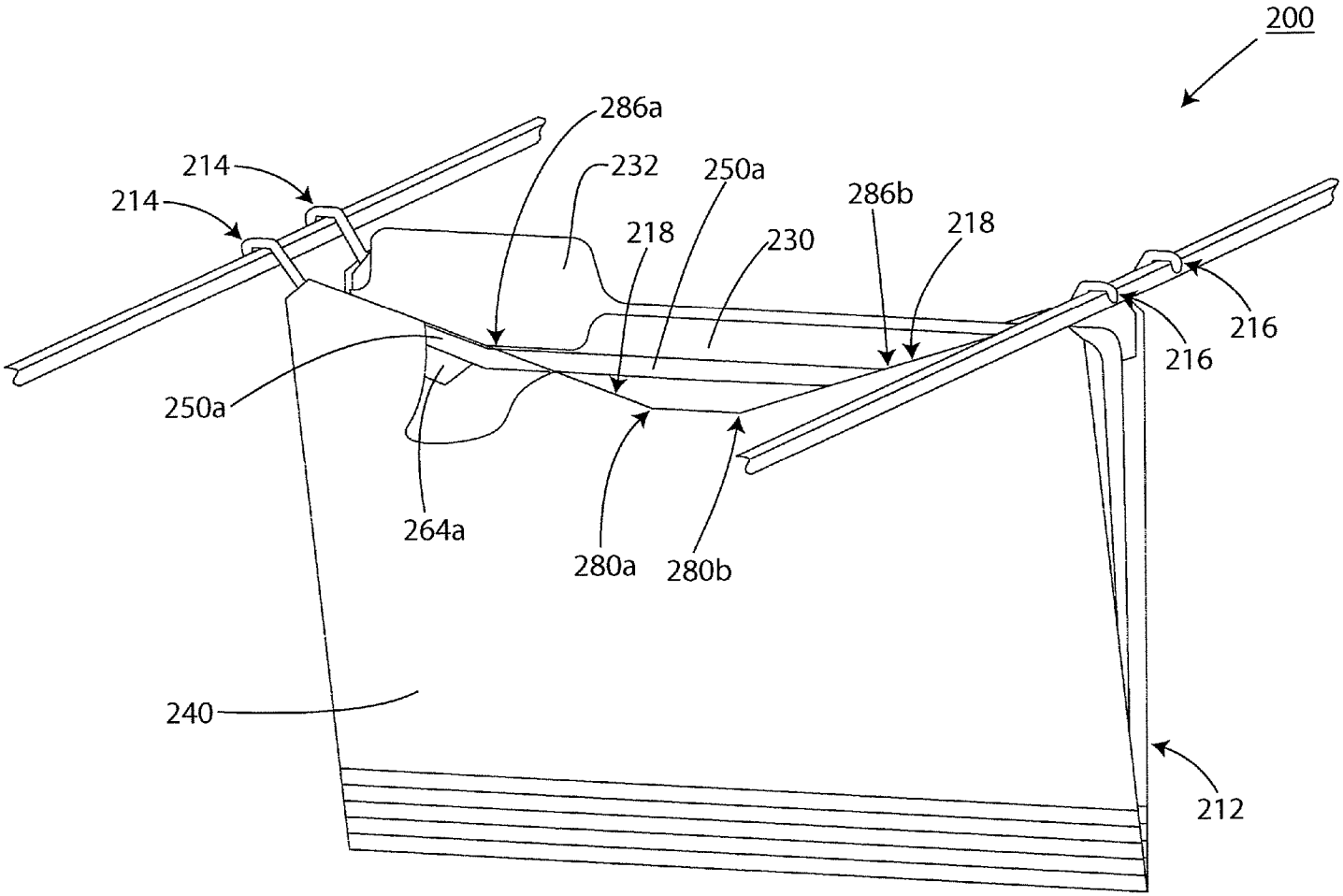
Figure 18:
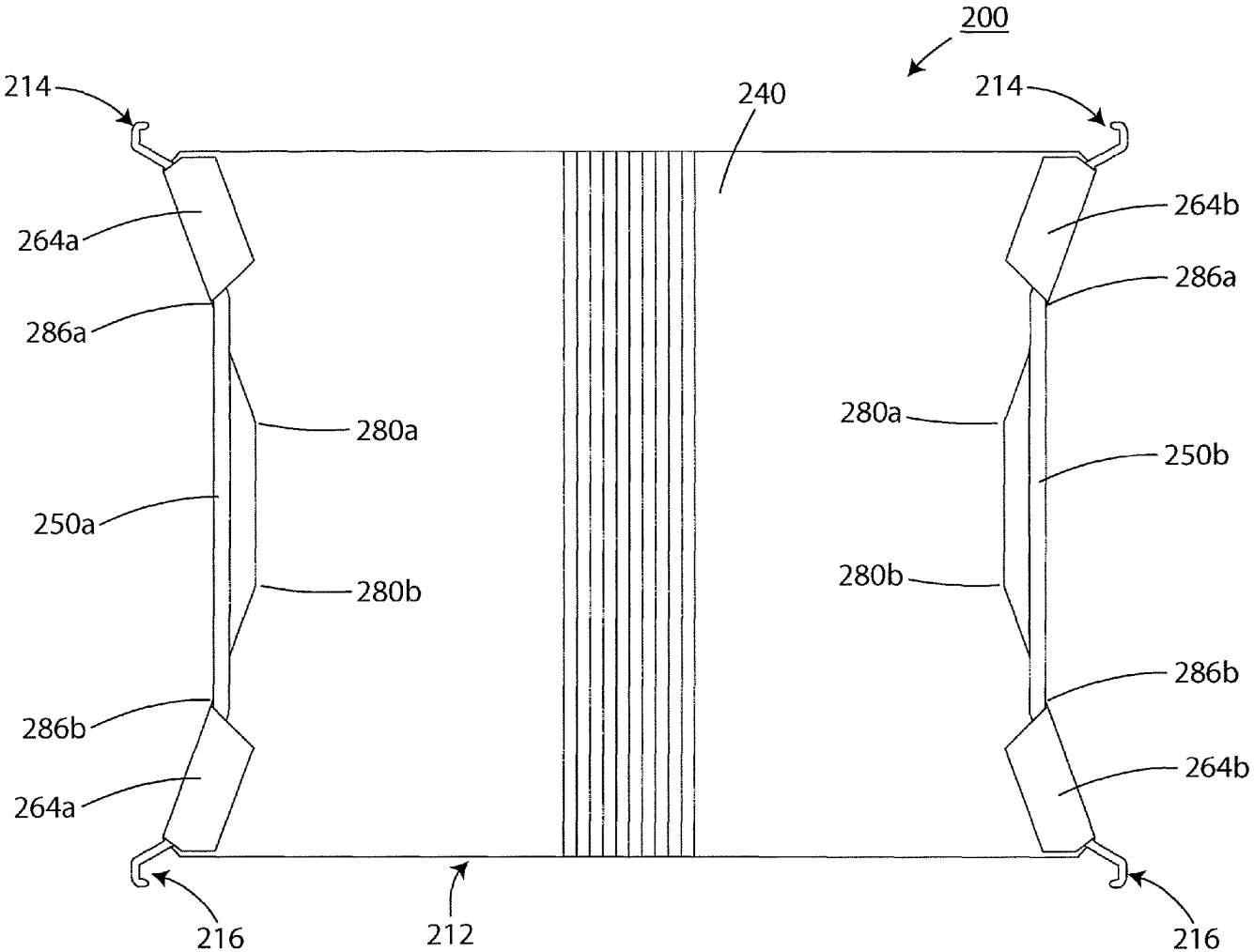

FIGS. 17 and 18 show an exemplary hanging file folder 200 having a receptacle 212 suspended by a pair of bent hangers 214, 216, according to another exemplary embodiment of the invention. The file folder 200 is very similar to the file folder 100 depicted in FIGS. 15-16. However, the top edges 218 of the receptacle 212 and the suspension bars 250*a*, 250*b* have multiple bends rather than a single, central bend. The bends 280*a*, 280*b* in the top edges 118 of the receptacle 212 reduce the amount of material 240 required for the receptacle 212 and allow the user more room to access a manila folder 230 inserted in the file folder 200. The bends 286*a*, 286*b* in the suspension bars 250*a*, 250*b* also allow more room for the user to remove a manila folder 230. Further, the bends 286*a*, 286*b* in the suspension bars 250*a*, 250*b* of file folder 200 are riot aligned with the bends 280*a*, 280*b* in the top edges 218 of the receptacle 212 leaving a portion of each suspension bar visible or uncovered by the material 240 of the receptacle. However, in certain embodiments, the material of the receptacle may fully cover each suspension bar. The top parts 264*a*, 264*b* of the material 240 are folded inwardly and over suspension bars 250*a*, 250*b* to form inward flaps thereby forming pockets for the suspension bars. As shown, the flaps form two pockets for each suspension bar. Further, similar to file folder 100, the angle between the hangers 214, 216 and the top edge 218 is greater than 90 degrees, but less than 180 degrees. The bends in the hangers 214, 216 may be shaped, sized, and configured as any of the various combinations and permutations of sizes discussed in the earlier embodiments, e.g., the embodiment of FIGS. 1-7.

Figure 19:
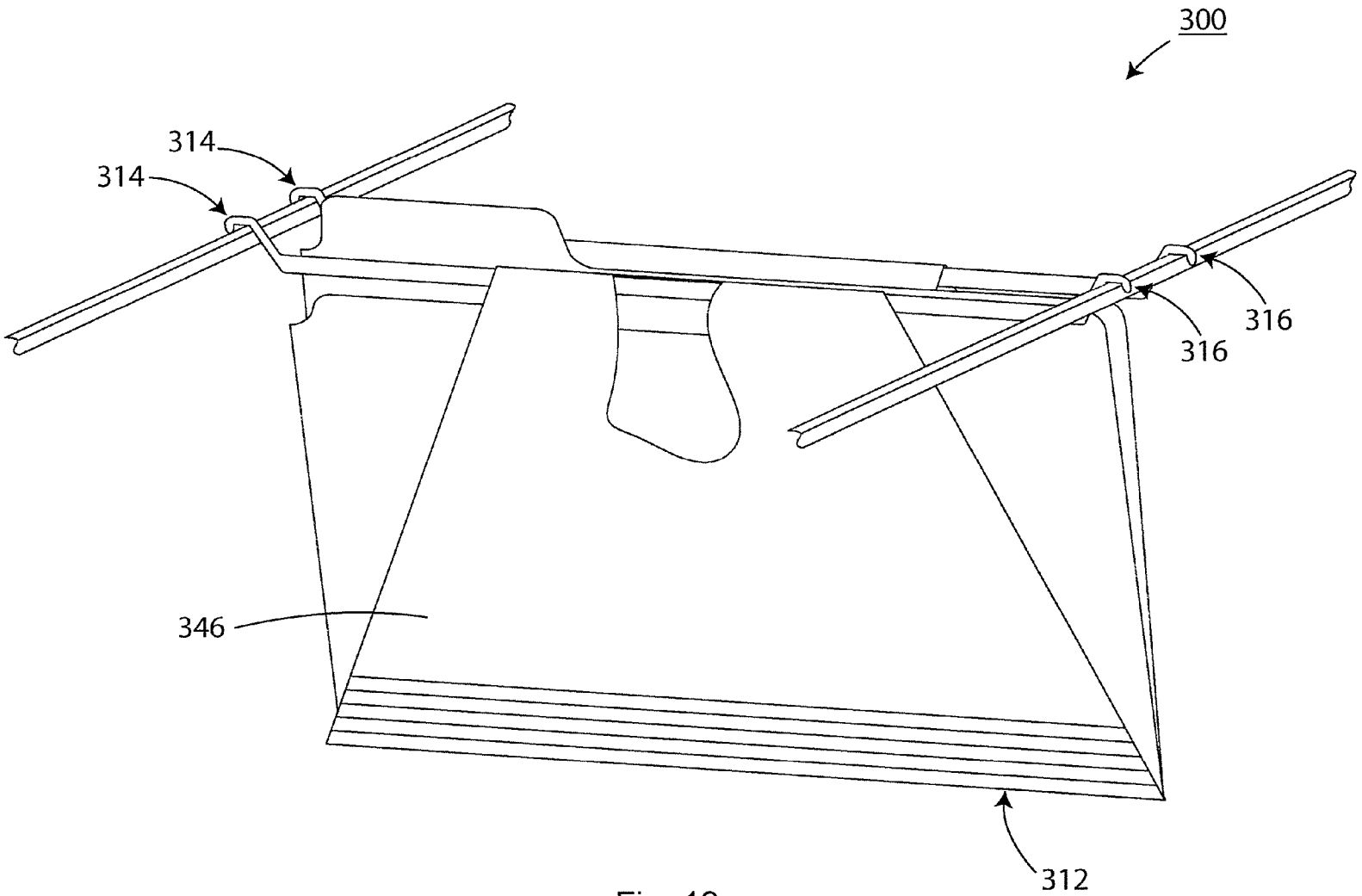
Figure 20:
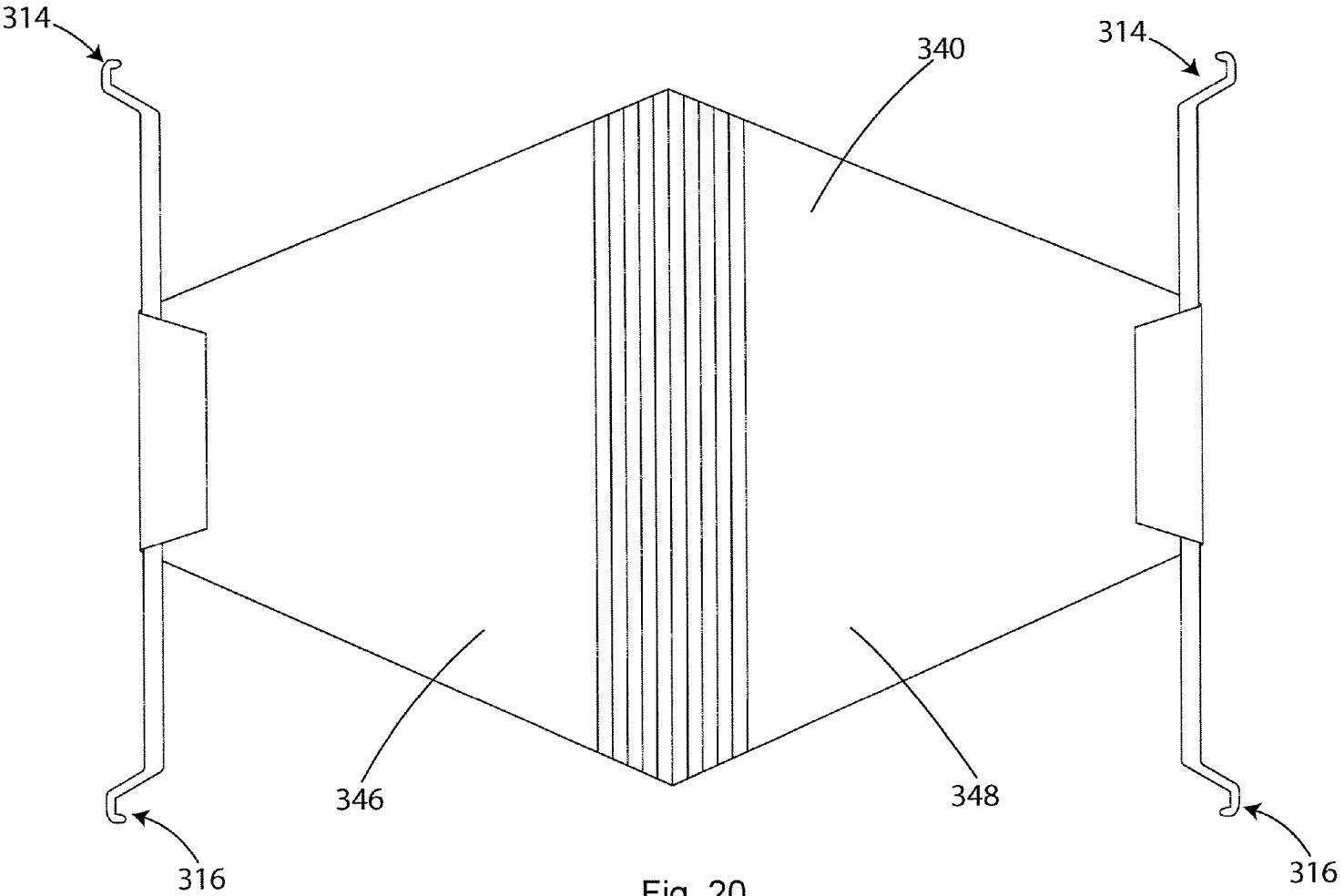
Figure 21:
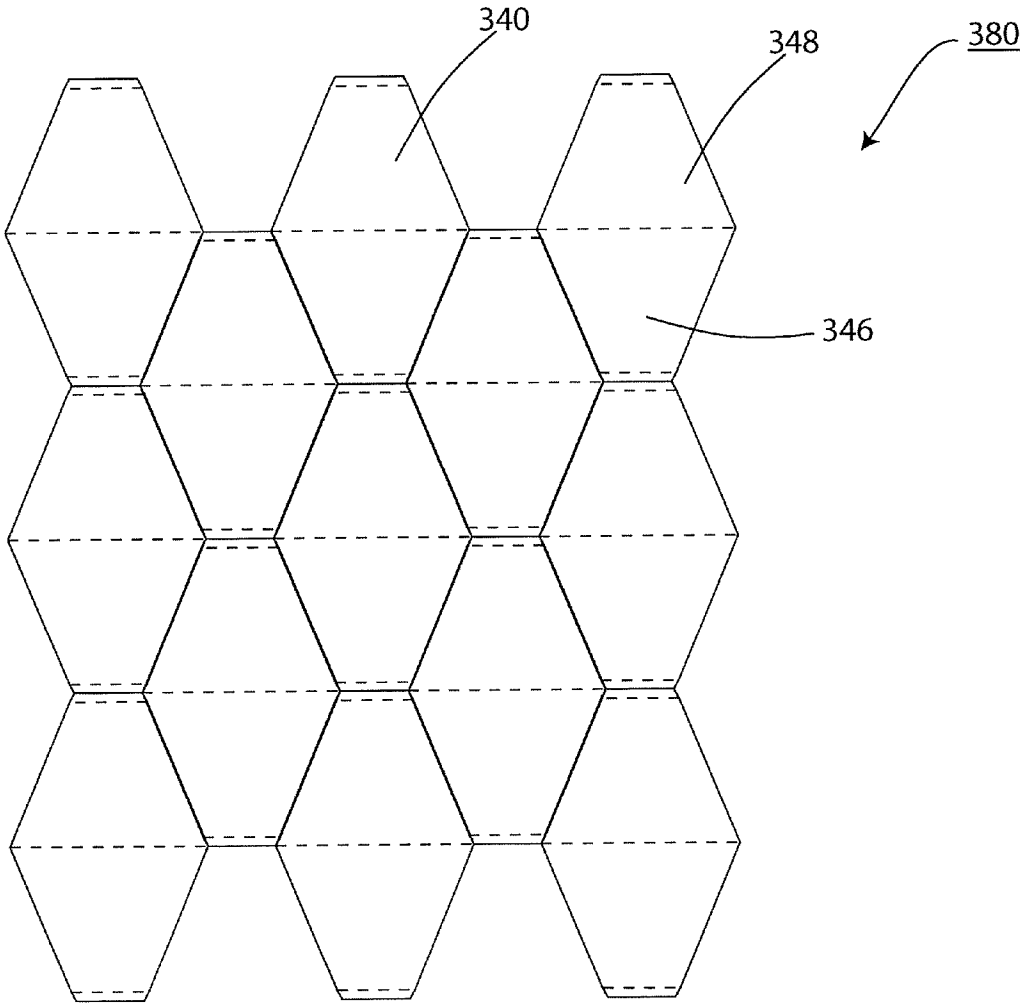
Figure 22:
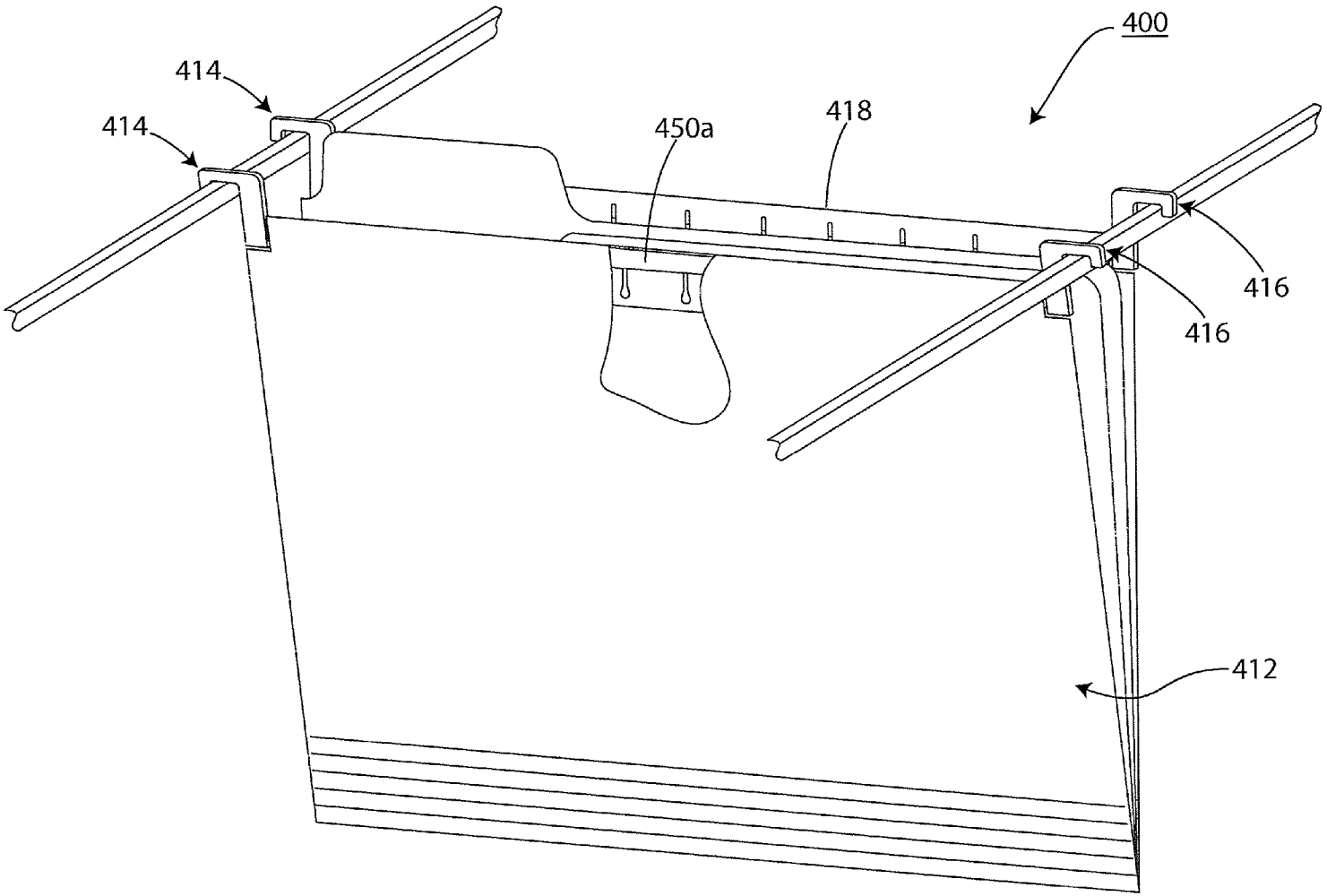
FIGS. 22 and 25 are various views of a file folder according to another exemplary embodiment of the invention, wherein the hangers of the file folder are attached to the suspension bars
Figure 23:
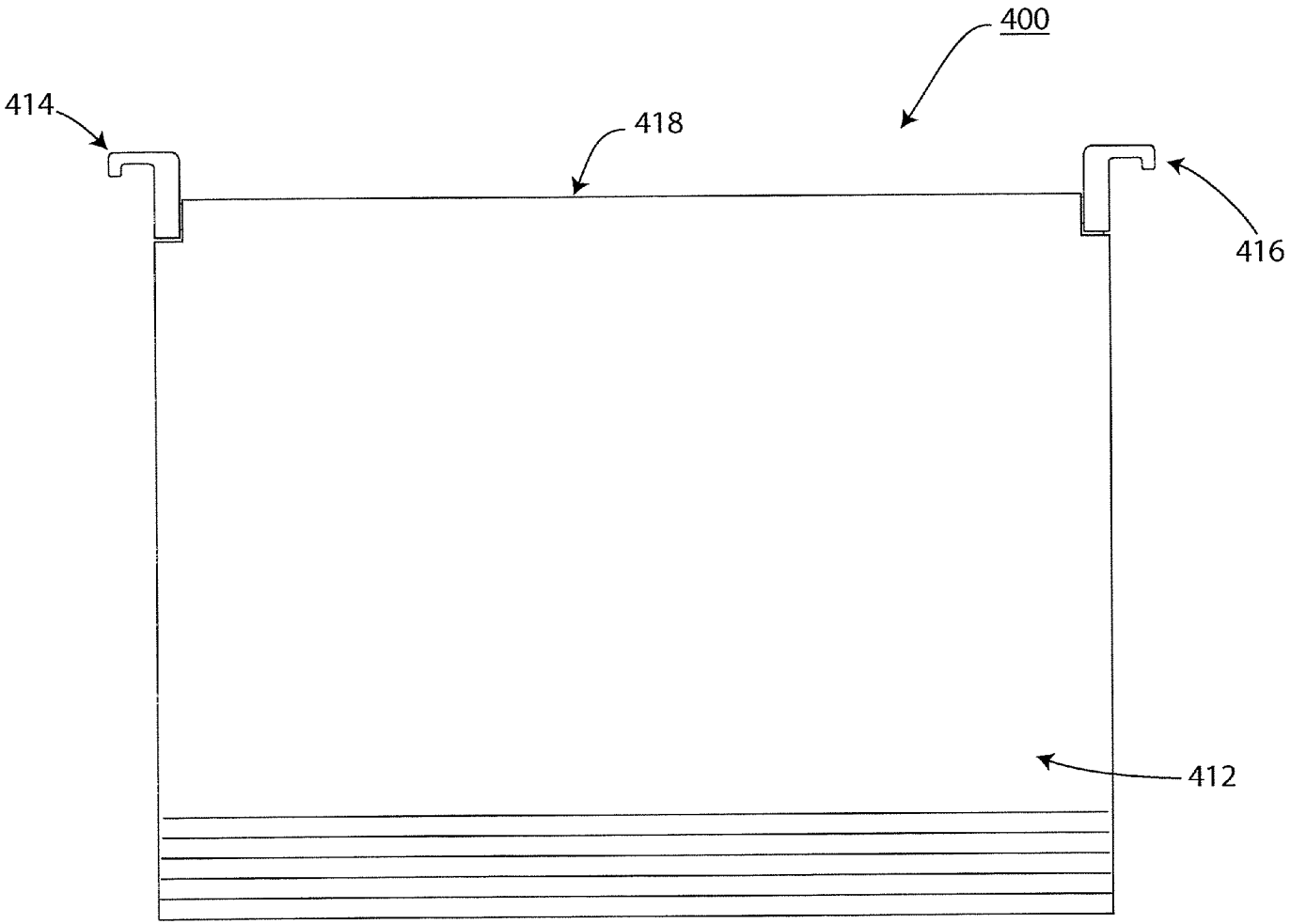
Figure 24:
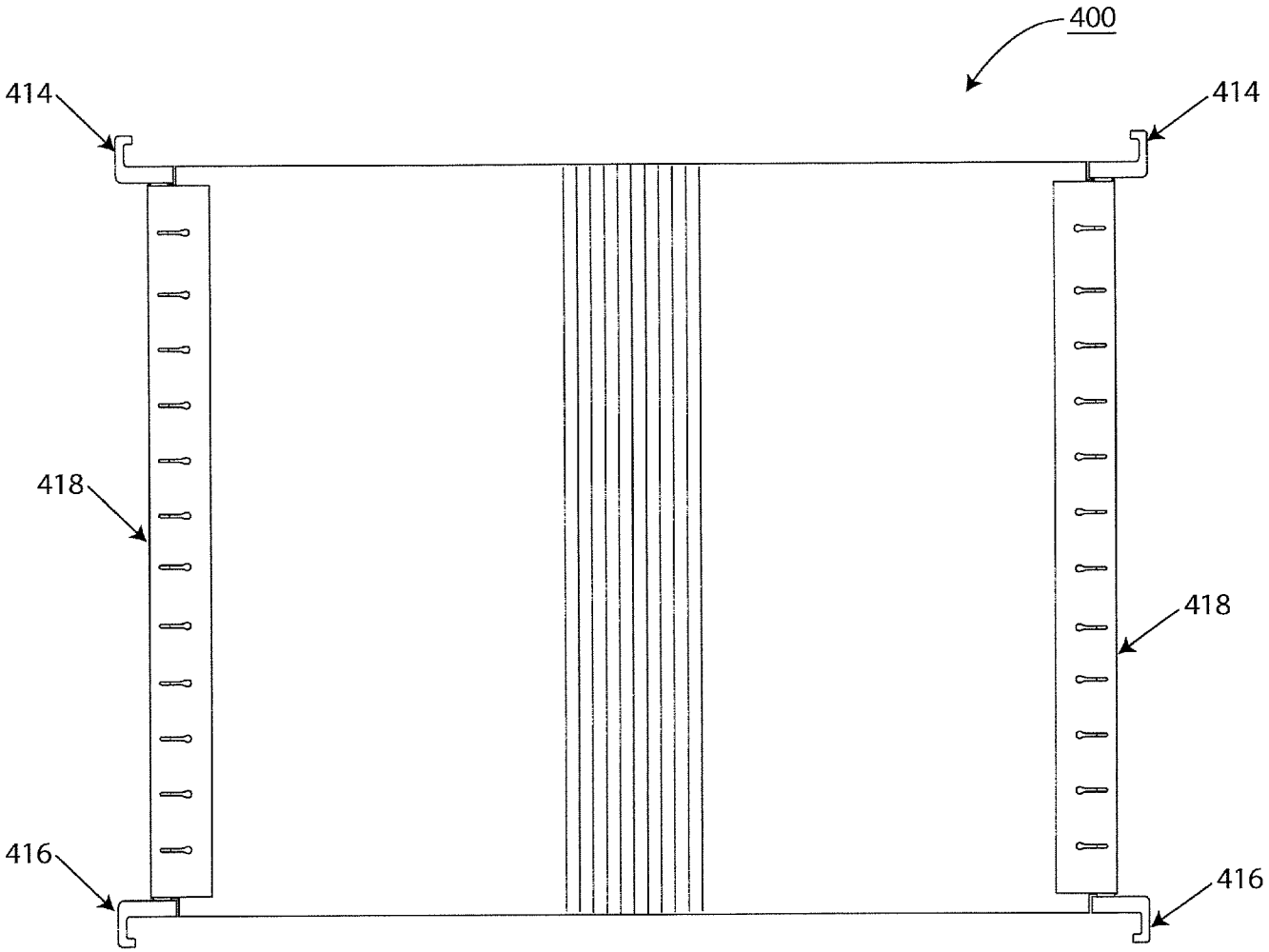
Figure 25:
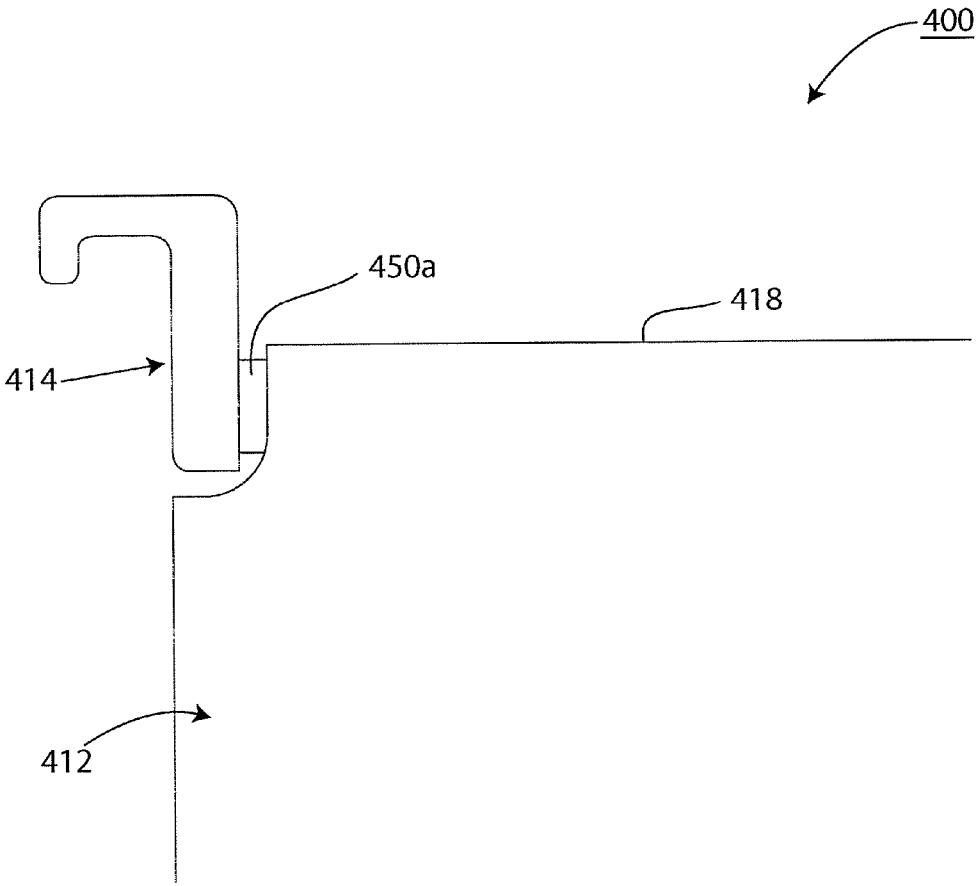
Figure 26:
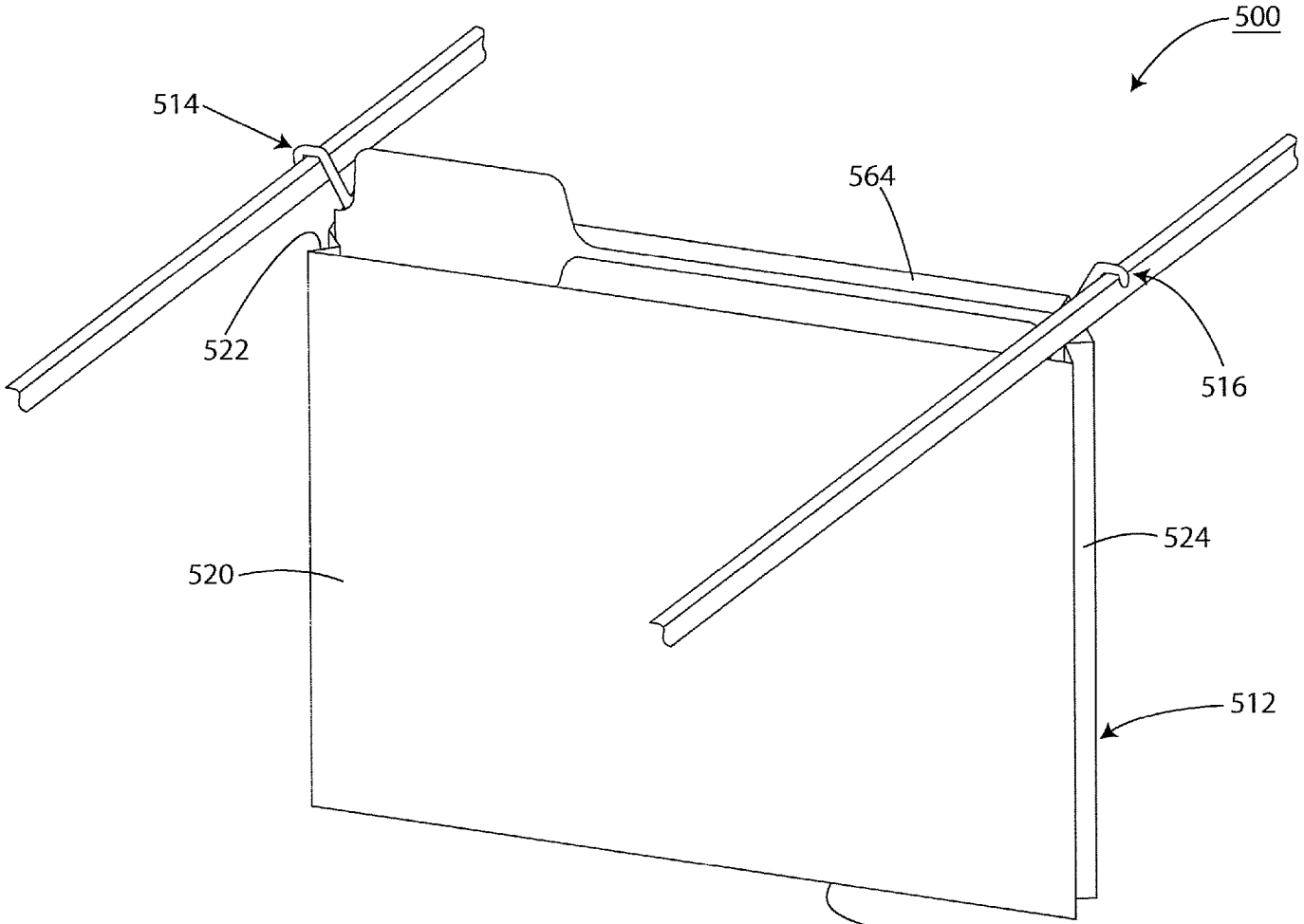
FIGS. 26-29 are various views of a file folder according to another exemplary embodiment of the invention, wherein the file folder has one suspension bar.
Figures 27, 28, 29:
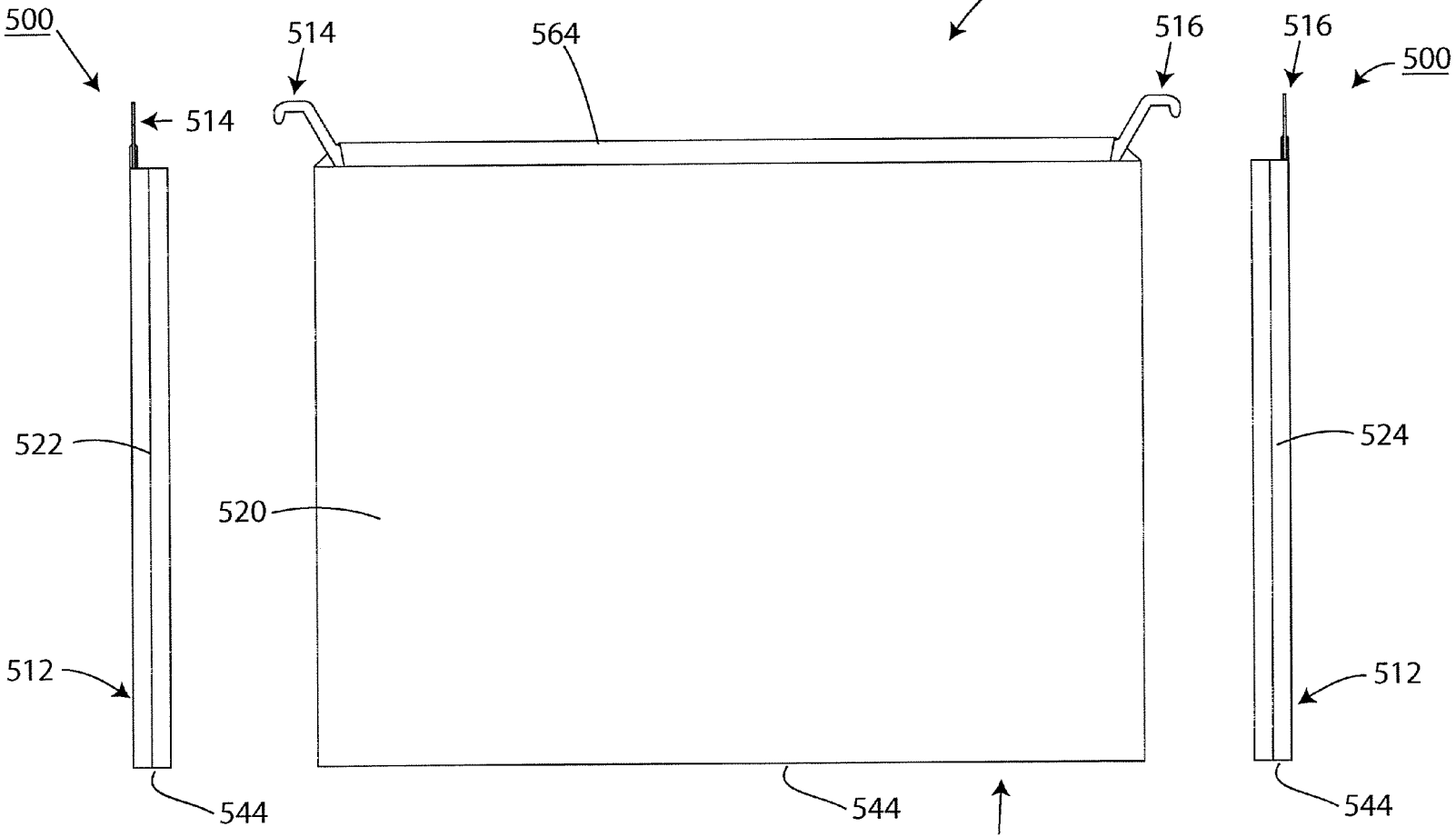

FIGS. 19-21 show an exemplary hanging file folder 300 having a receptacle 312 suspended by a pair of bent hangers 314, 316, according to another exemplary embodiment of the invention. The file folder 300 is very similar to the file folder 10 depicted in FIGS. 1-7. However, the open sides 346, 348 of the receptacle 312 have a trapezoidal shape, unlike the rectangular shape of the open sides 46, 48 of file folder 10. The trapezoidal shape reduces the amount of material 340 required for the receptacle 312. Further, as shown in FIG. 21, folders having trapezoidal shaped sides may be arranged during cutting such that little or no material is wasted when the folders are cut from a single die cut 380. Further, due to their shape, more trapezoidal shaped file folders may be produced from a single die cut than the traditional rectangular shaped folders. The bends in the hangers 314, 316 may be shaped, sized, and configured as any of the various combinations and permutations of sizes discussed in the earlier embodiments, e.g., the embodiment of FIGS. 1-7.

FIGS. 22-25 show an exemplary hanging file folder 400 having a receptacle 412 suspended by a pair of bent hangers 414, 416, according to another exemplary embodiment of the invention. In this embodiment, the bent hangers 414, 416 are separate from and attached to the end of the suspension bars 450*a*, 450*b*. As shown, the bent hangers 414, 416 are made of plastic and pressed on or overmolded onto the end of the suspension bars 450*a*, 450*b*. The bent hangers 414, 416 may be attached to the suspension bar 450*a*, 450*b* by any suitable means known in the art, such as with a fastener or adhesive. The bent hangers 414, 416 may also be made from any suitable material known in the art, such as metal. Further, the bent hangers may be removable and/or interchangeable with hangers of various sizes and shapes. As shown, the angle between the top edge 418 of the receptacle 412 and the bent hangers 414, 416 is about 90 degrees. However, this angle may be about 90 to 135 degrees or more. The bends in the hangers 414, 416 may be shaped, sized, and configured as any of the various combinations and permutations of sizes discussed in the earlier embodiments, e.g., the embodiment of FIGS. 1-7.

FIGS. 26-29 show an exemplary hanging file folder 500 having a receptacle 512 suspended by bent hangers 514, 516, according to another exemplary embodiment of the invention. In this embodiment, the receptacle 512 has a front wall 520, a rear wall, two sides 522, 524, and a bottom 544. As shown, the receptacle 512 is suspended by only one suspension bar, although more than one suspension bar may be used. The top part 564 of the rear wall is folded inwardly and over the suspension bar to form an inward flap thereby forming a pocket for the suspension bar. The sides 522, 524 and the bottom 544 of the receptacle 512 have at least one fold such that the receptacle may collapse and expand. The bends in the hangers 514, 516 may be shaped, sized, and configured as any of the various combinations and permutations of sizes discussed in the earlier embodiments, e.g., the embodiment of FIGS. 1-7.

Conventional hanging folders without bent hangers, and the inventive hanging file folders discussed above, and other hanging file folders may each be modified to include collapsible hanger ends. Collapsible hanger ends allow a user to convert the hanging file folder for use as a non-hanging folder, such as a standard manila folder. Thus, the user may more easily store the hanging file folder, for example in a briefcase, without the hanging ends catching or preventing the file folder from fitting. The hanger ends may collapse into pockets of the receptacle. Further, any number of the hanger ends on a hanging file folder may be collapsible. The mechanism that allows the hanger ends to collapse may be any suitable mechanism known in the art, such as for example a slide, hinge, rivet, screw, or some other similar fastener. The hanger ends may also have a biasing device, such as a spring, that biases the ends into the upright or hanging position or the collapsed position.

Figure 30:
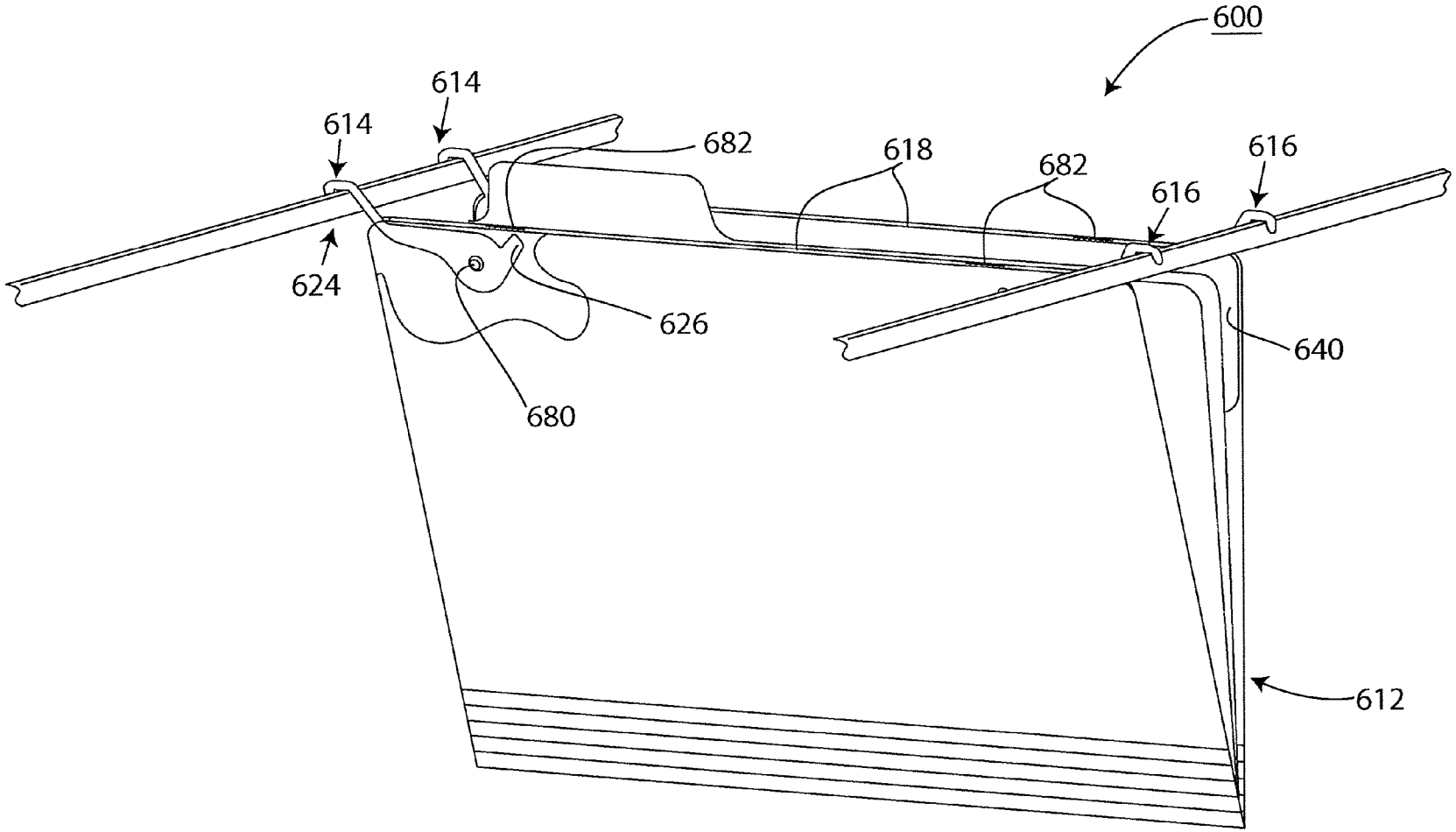
FIGS. 30-33 are various views of a file folder according to another exemplary embodiment of the invention, wherein the hangers of the file folder are collapsible
Figure 31:
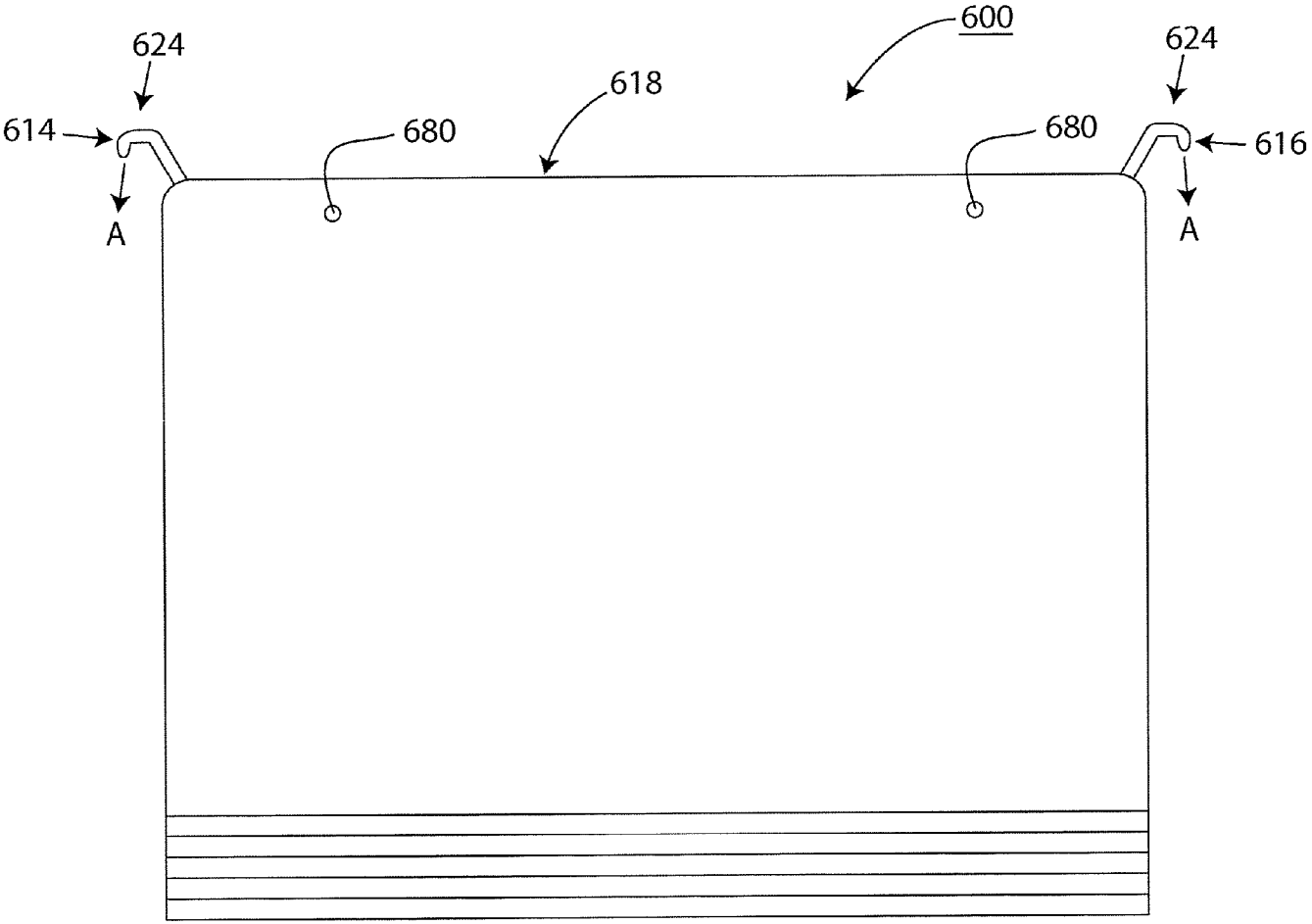
Figure 32:
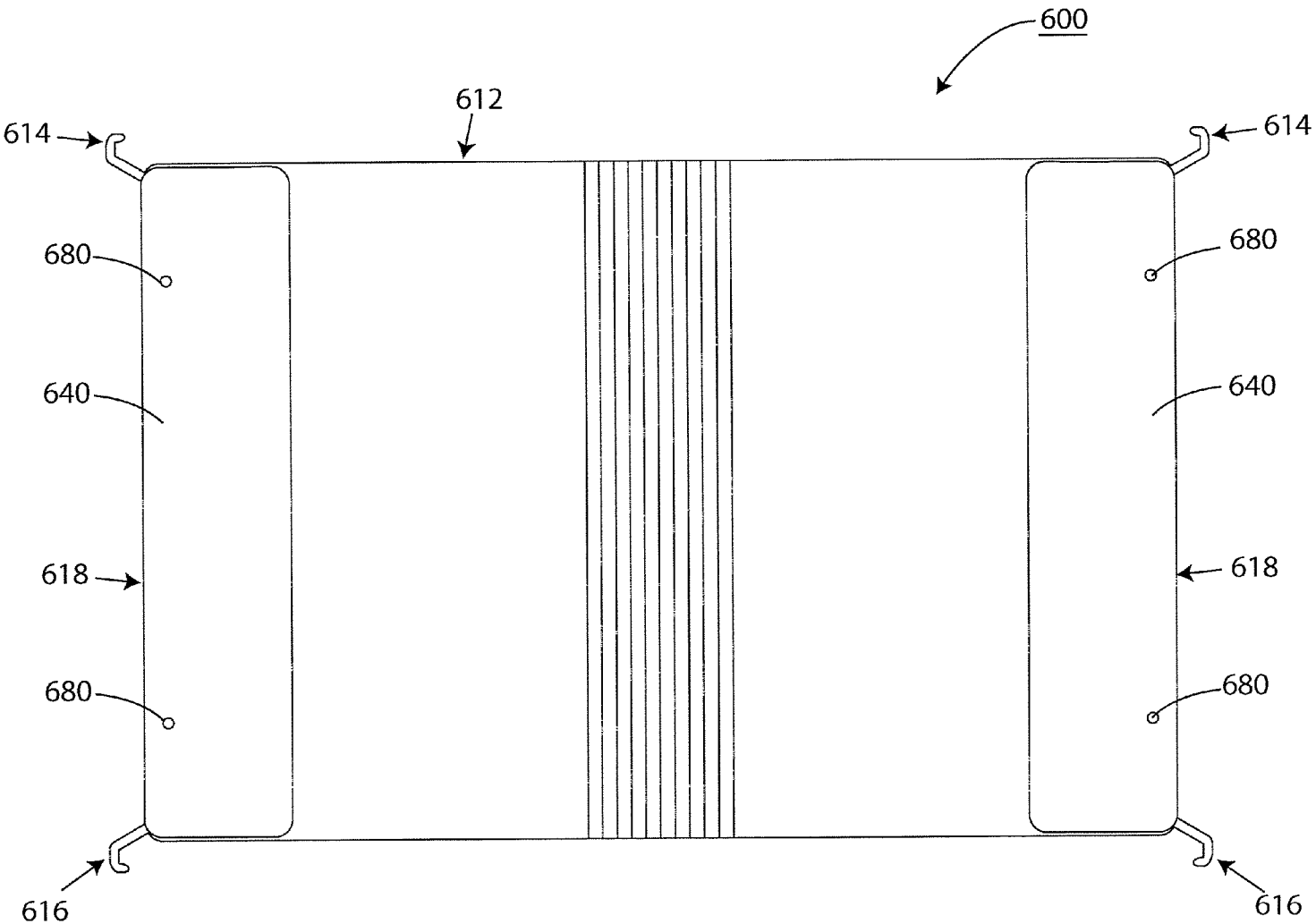
Figure 33:
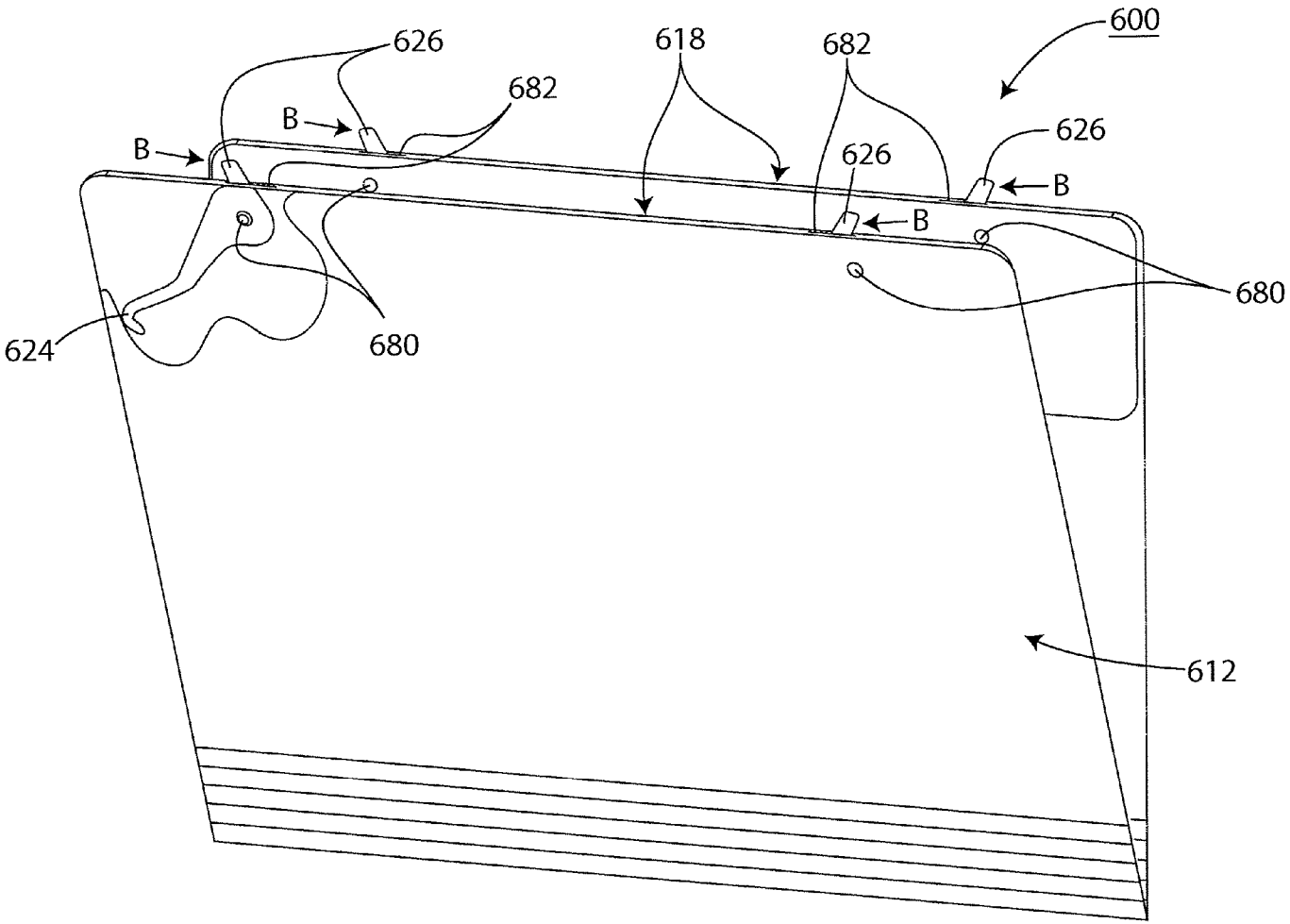

FIGS. 30-33 show an exemplary hanging file folder 600 having a receptacle 612 suspended by a pair of collapsible bent hangers 614, 616. As shown in FIGS. 30-32, the collapsible hangers 614, 616 are in the upright or hanging position such that the file folder 600 may be stored in office storage equipment. The ends 640 of the receptacle 612 are folded inwardly and over the hangers 614, 616 to form inward flaps thereby forming pockets for the hangers. The hangers 614, 616 are attached to the receptacle 612 by a fastener, such as a rivet 680. The rivet 680 extends through the pocket and allows the hangers 614, 616 to pivot relative to the receptacle 612. However, the hangers 614, 616 may be attached to the receptacle 612 by any suitable means that allows the hangers to pivot relative to the receptacle, such as with a pin or some other fastener. The bends in the hangers 614, 616 may be shaped, sized, and configured as any of the various combinations and permutations of sizes discussed in the earlier embodiments, e.g., the embodiment of FIGS. 1-7. Accordingly, the top edges (e.g., top of the edge folds) may be substantially beneath a rail-supporting portion of the hangers by various different suitable amounts in different embodiments, e.g., by: at least 0.25"; at least 0.4"; at least 0.47" or 0.48"; about 0.3" to 0.7"; about 0.4" to 0.6"; about 0.47" to 0.52"; or about 0.48". Similarly, the top edges may be substantially beneath a top portion of the hangers by various different suitable amounts in different embodiments, e.g., by: at least 0.25"; at least 0.5"; at least 0.6"; about 0.4" to 0.8"; about 0.5" to 0.7"; about 0.61" to 0.63"; or about 0.62". Further, the distance between the top edges and the top of the tab of the 9.5" manila folder inserted into the file folder may be various different suitable amounts in different embodiments, e.g., at least 0.4"; at least 0.5"; at least 0.7", about 0.6" to 0.8"; or about 0.7". This distance may be along the entire length of the top edge beneath the tab or at least a portion of the entire length. Further, the distance the tab of the 9.5" manila folder inserted into the file folder extends above the top of the hangers may be various different suitable amounts in different embodiments, e.g., no more than 0.1"; no more than 0.09"; about 0.05" to 0.1"; or about 0.085". In certain embodiments, the tab of a manila folder inserted into the file folder may be slightly below the top of the hangers by about 0.05" to 0.1" or be substantially aligned with the top. Thus, the top of the file folder is low enough to read the tab of the manila folder.

As shown by arrow A in FIG. 31, pressing down on a first end 624 of the hangers 614, 616 allows the hangers to pivot and collapse into the pocket of the receptacle 612. In the collapsed position, optionally a second end 626 of the hanger 614, 616 protrudes through an opening, such as a slit 682 located along the pocket fold, or top edge 618 of the file folder 600. As shown by arrow B in FIG. 33, the second end 626 of the hanger 614, 616 may be pushed inward, pivoting the hanger and allowing the first end 624 to protrude out of the pocket. The user may then move the first end 624 of the hanger 614, 616 into the upright or hanging position. It should be noted that, in certain embodiments, the pocket may be configured so that the hanger is pinched within the pocket and a force may be required to move the hanger from the upright and/or collapsed position.

In other embodiments (not shown), there is no portion (like second end 626 of the collapsible hanger) protruding through an opening in the receptacle. In these embodiments, the user may use his or her finger to pivot the first or hanging end of the hanger into the hanging or upright position.

Figure 34:
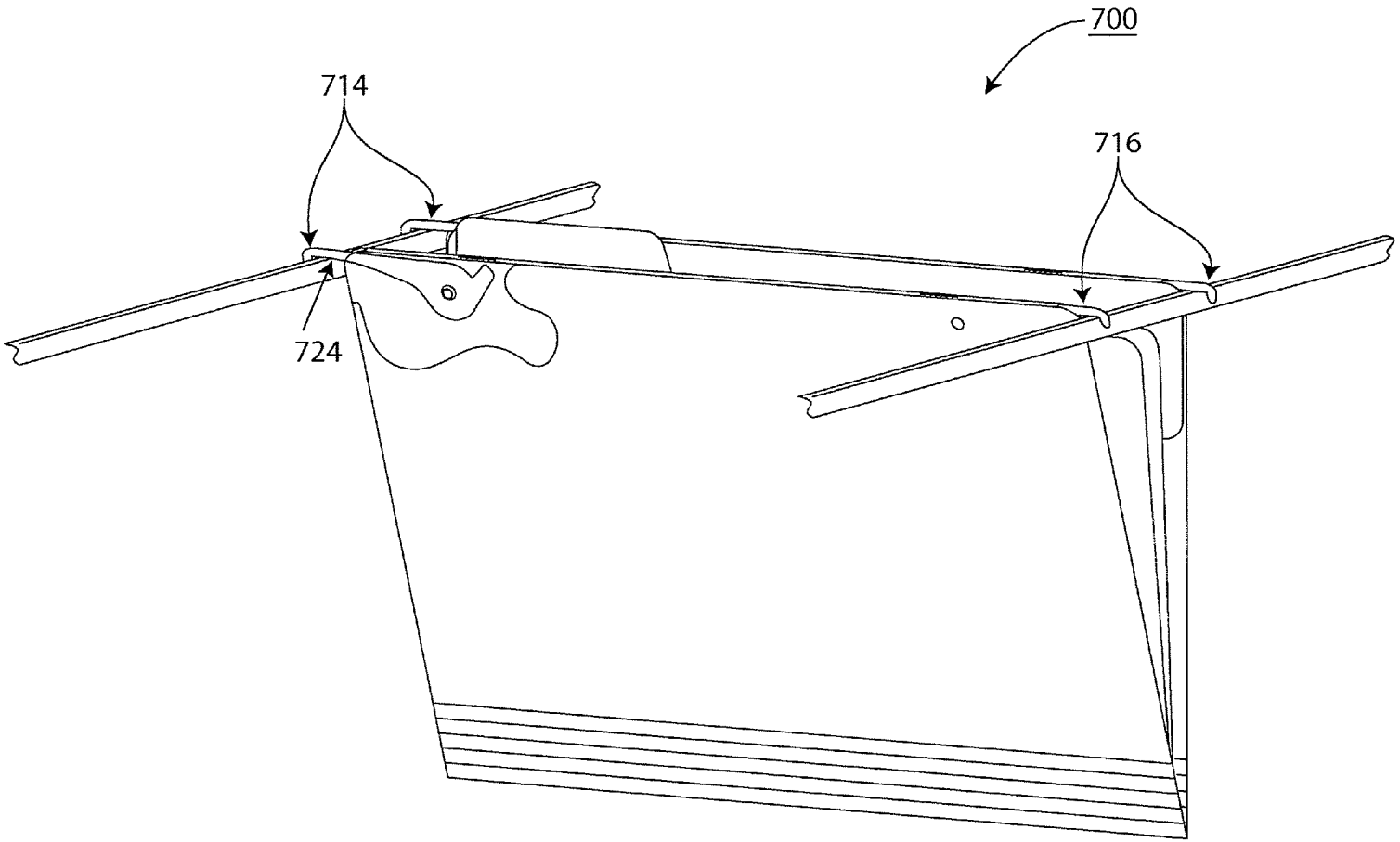
FIGS. 34-35 are partial cut away perspective views of a file folder according to another exemplary embodiment of the invention, wherein the hangers of the file folder are collapsible.
Figure 35:
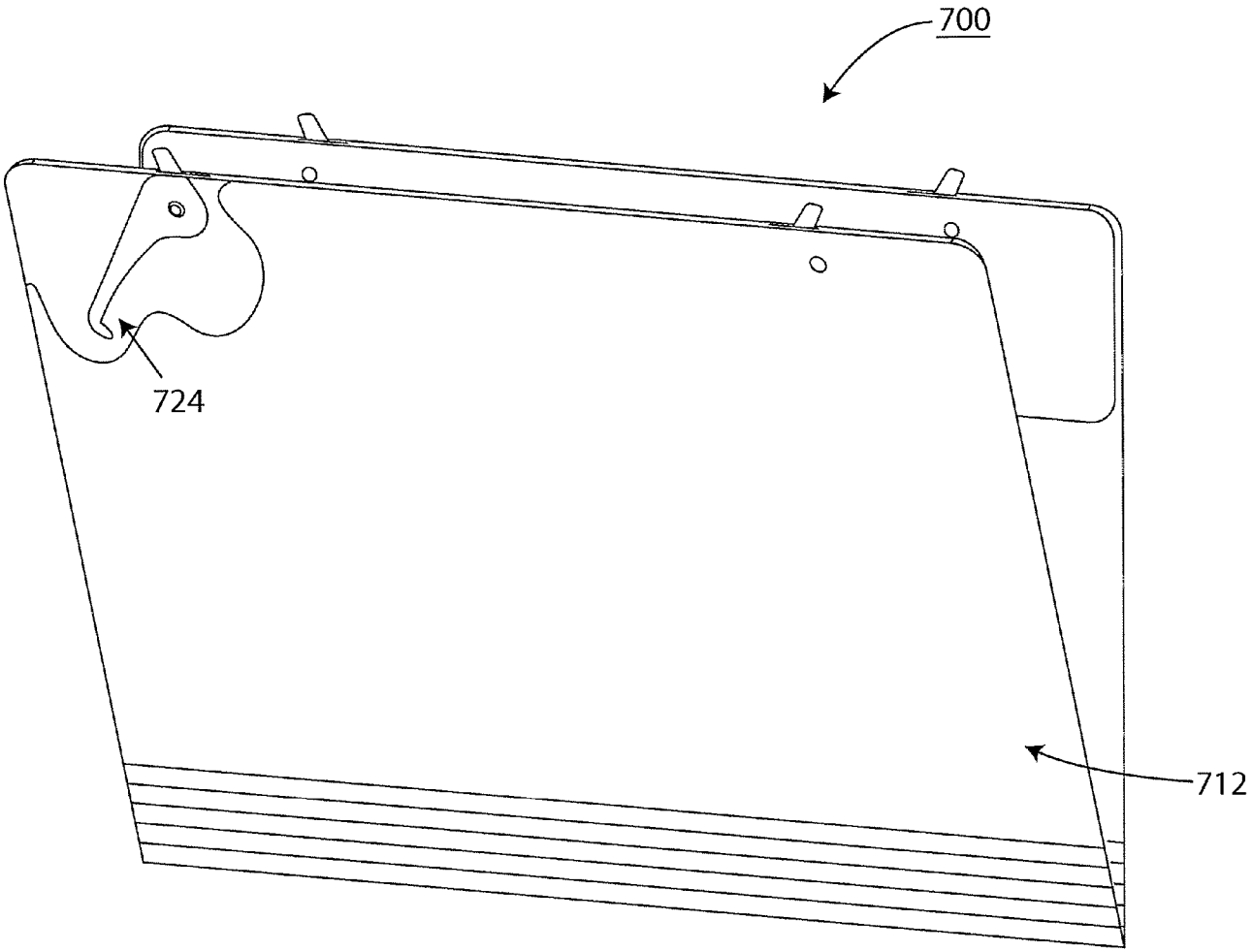
Figure 36:
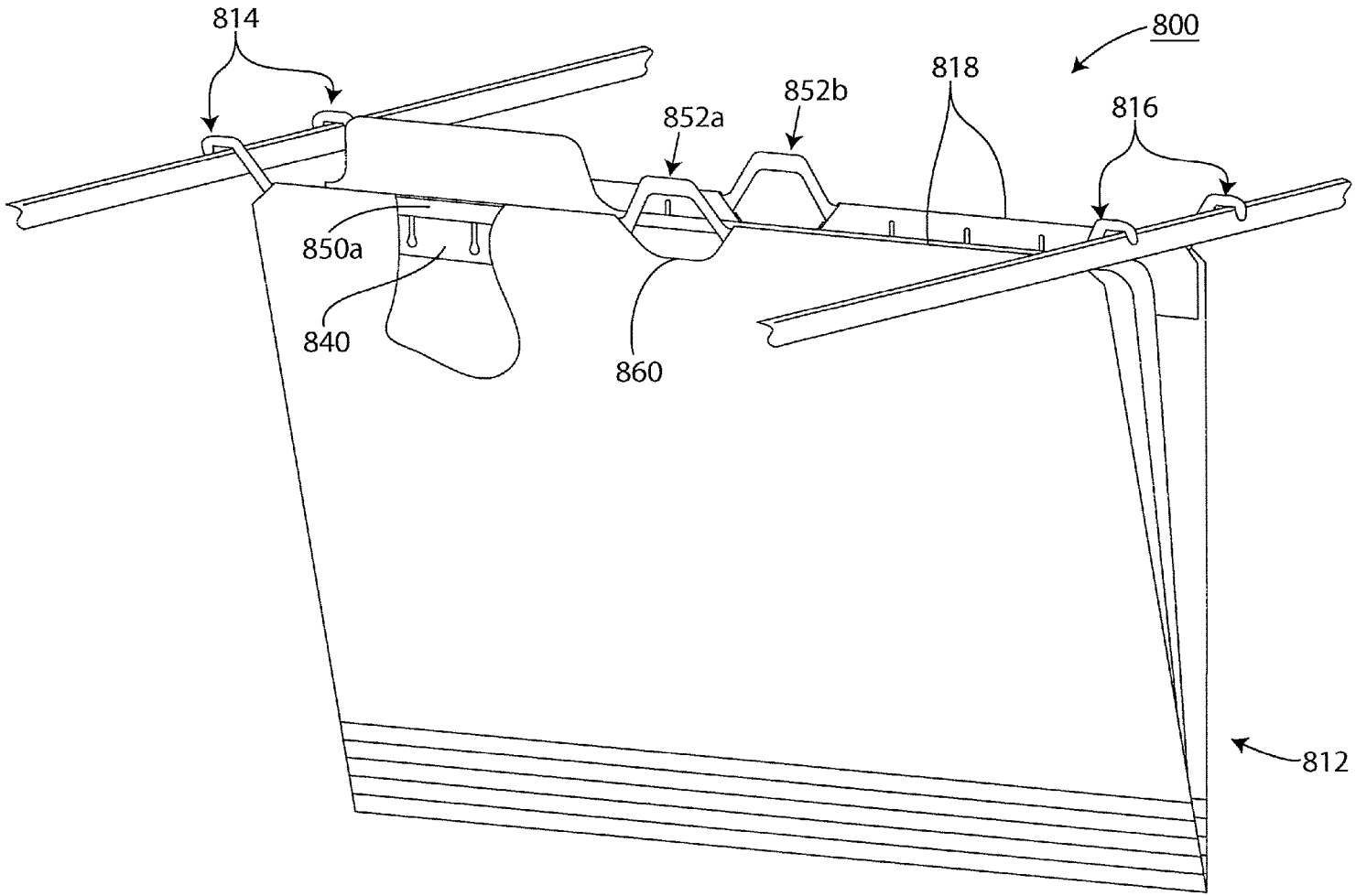
FIGS. 36-39 are various views of a hanging file folder according to another exemplary embodiment of the invention, wherein the file folder has a handle.
Figure 37:
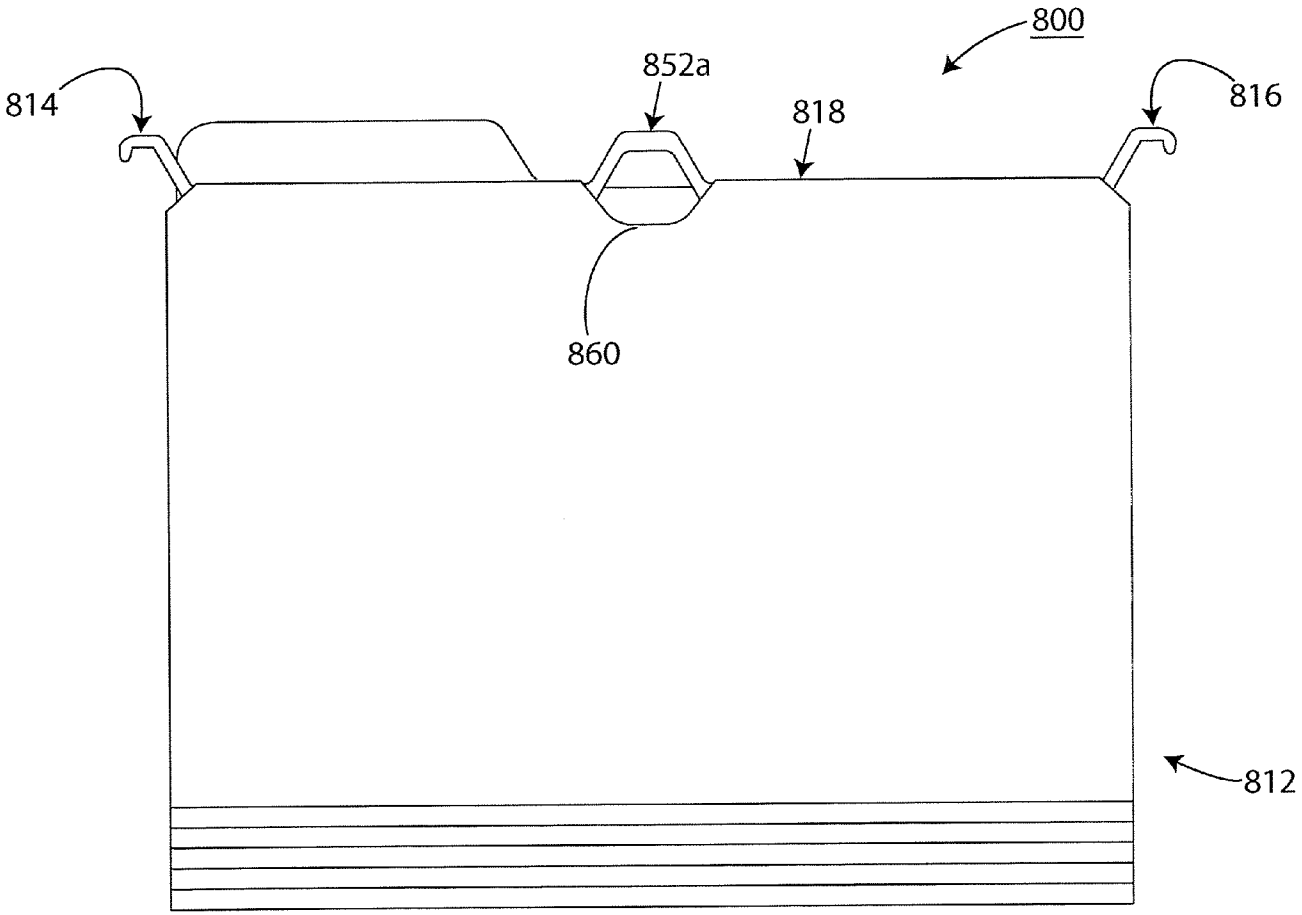

FIGS. 34 and 35 show an exemplary hanging file folder 700 having a receptacle 712 suspended by a pair of collapsible hangers 714, 716. File folder 700 is very similar to file folder 600 depicted in FIGS. 30-33. However, the first, or hanging, end 724 of the hanger 714, 716 of file folder 700 is straight. By contrast, the first end 624 of the hanger 614, 616 of file folder 600 is bent.

Conventional hanging folders without bent hangers, and the inventive hanging file folders discussed above, and other hanging file folders may each be modified to include a handle or grip, e.g., integral with or affixed to the suspension bar, or integral with or affixed to a top portion of the material forming the receptacle. Such a handle or grip may be on one side (front side or back side) or both sides (both front and back sides) of the file folder, perhaps near the middle of the folder, and may be used, for example, to easily remove the file folder from office storage equipment, and/or to permit one to use one's fingers to "walk" from file to file while searching for a file. The top of the handle may be positioned, for example, at about the height of the top of the hangers, or at about the height of a manila folder therein, or higher than either, or at some other predetermined height above the top of the folder.

FIGS. 36-40 show an exemplary hanging file folder 800 having a receptacle 812 suspended by a pair of bent hangers 814, 816. The file folder 800 also has two grips 852*a*, 852*b*, or handles, formed as part of the suspension bars 850*a*, 850*b*. The grip portion 852*a*, 852*b* of the suspension bars 850*a*, 850*b* extend above the top edge 818 of the file folder 800 so the user may more easily access the grips 852*a*, 852*b*. The grips 852*a*, 852*b* allows the user to easily sort through hanging file folders in office storage equipment 862 and pull out the desired folder (see FIG. 40). The bends in the hangers 814, 816 may be shaped, sized, and configured as any of the various combinations and permutations of sizes discussed in the earlier embodiments, e.g., the embodiment of FIGS. 1-7.

Figure 39:
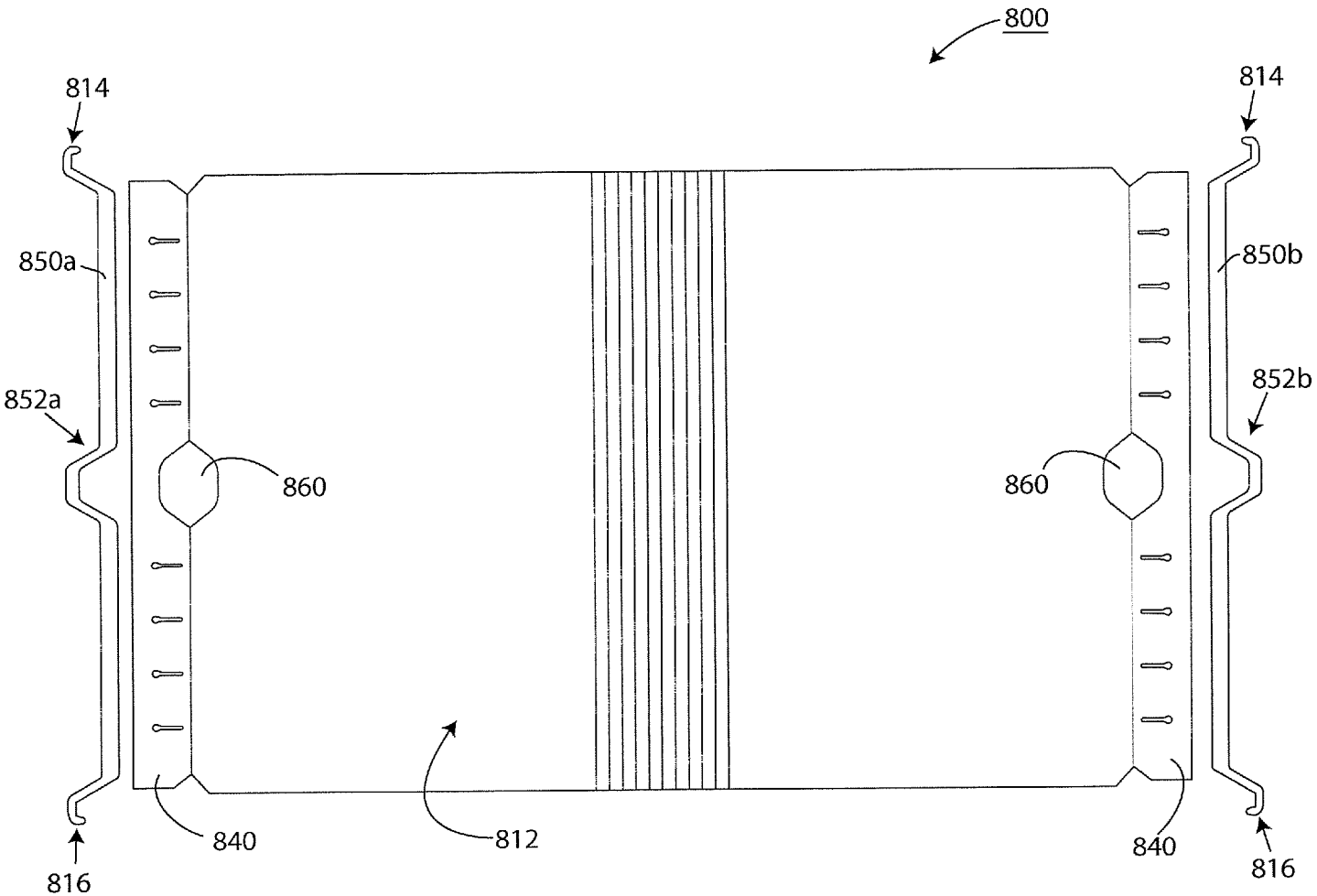
Figure 40:
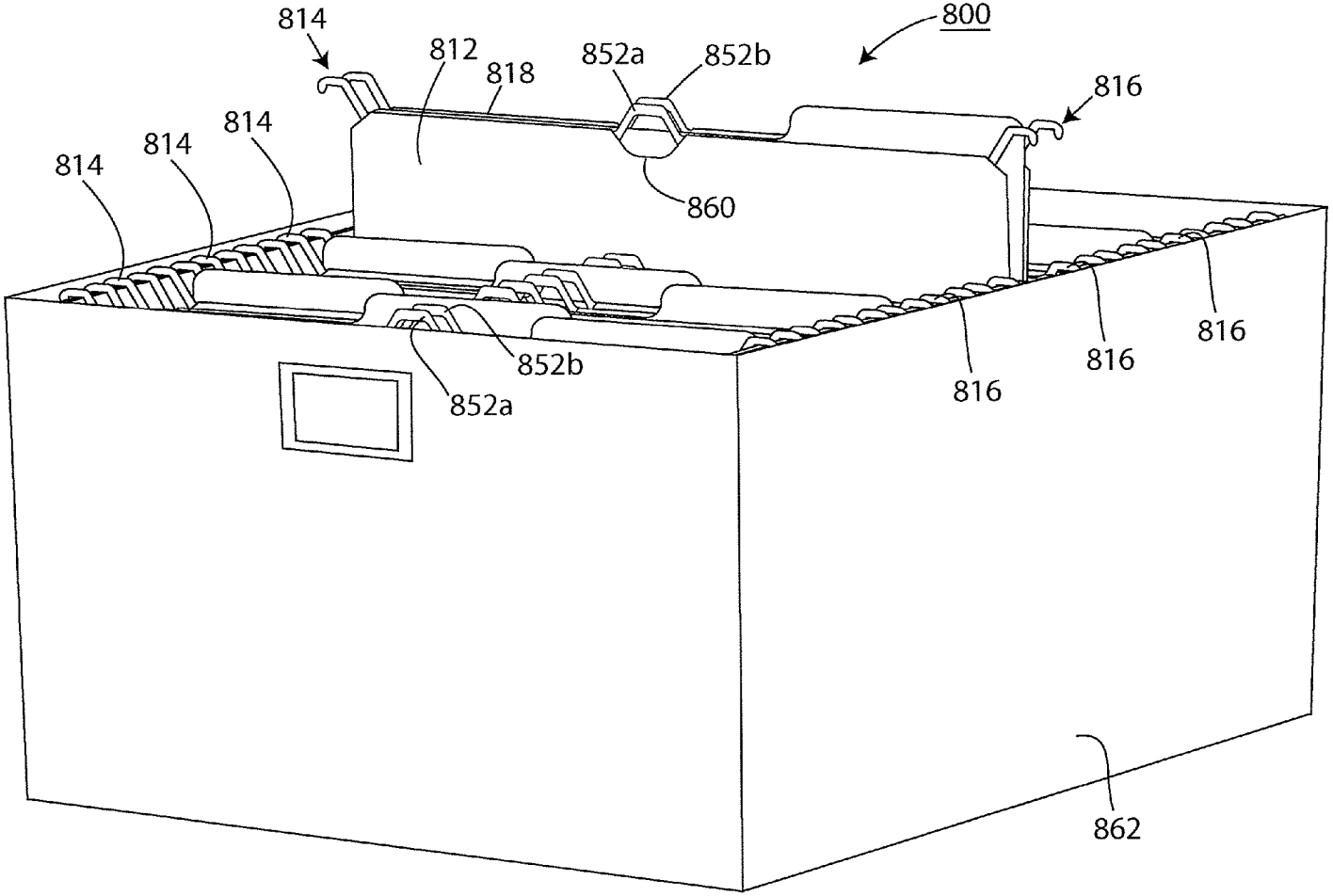
FIG. 40 is a perspective view of the exemplary file folder shown in FIGS. 36-39, wherein multiple file folders are shown hanging from rails inside office storage equipment.

As show in FIG. 39, in this exemplary embodiment, the grips 852*a*, 852*b* are formed towards the middle of the suspension bars 850*a*, 850*b* of the hanging file folder 800. As shown, the grips 852*a*, 852*b* are integrally formed as part of the suspension bars 850*a*, 850*b* by a set of bends. More specifically, in this exemplary implementation, the suspension bars 850*a*, 850*b* are planar and stamped from a piece of stock and have multiple bends in the cut-out forming the suspension bars, with the bends forming hangers 814, 816 and the grips 852*a*, 852*b*. As shown, the top of the hangers 814, 816 and the grips 852*a*, 852*h* of the exemplary file folder 800 extend about 0.6 inch from the top 818 of the receptacle 812.

Figure 38:
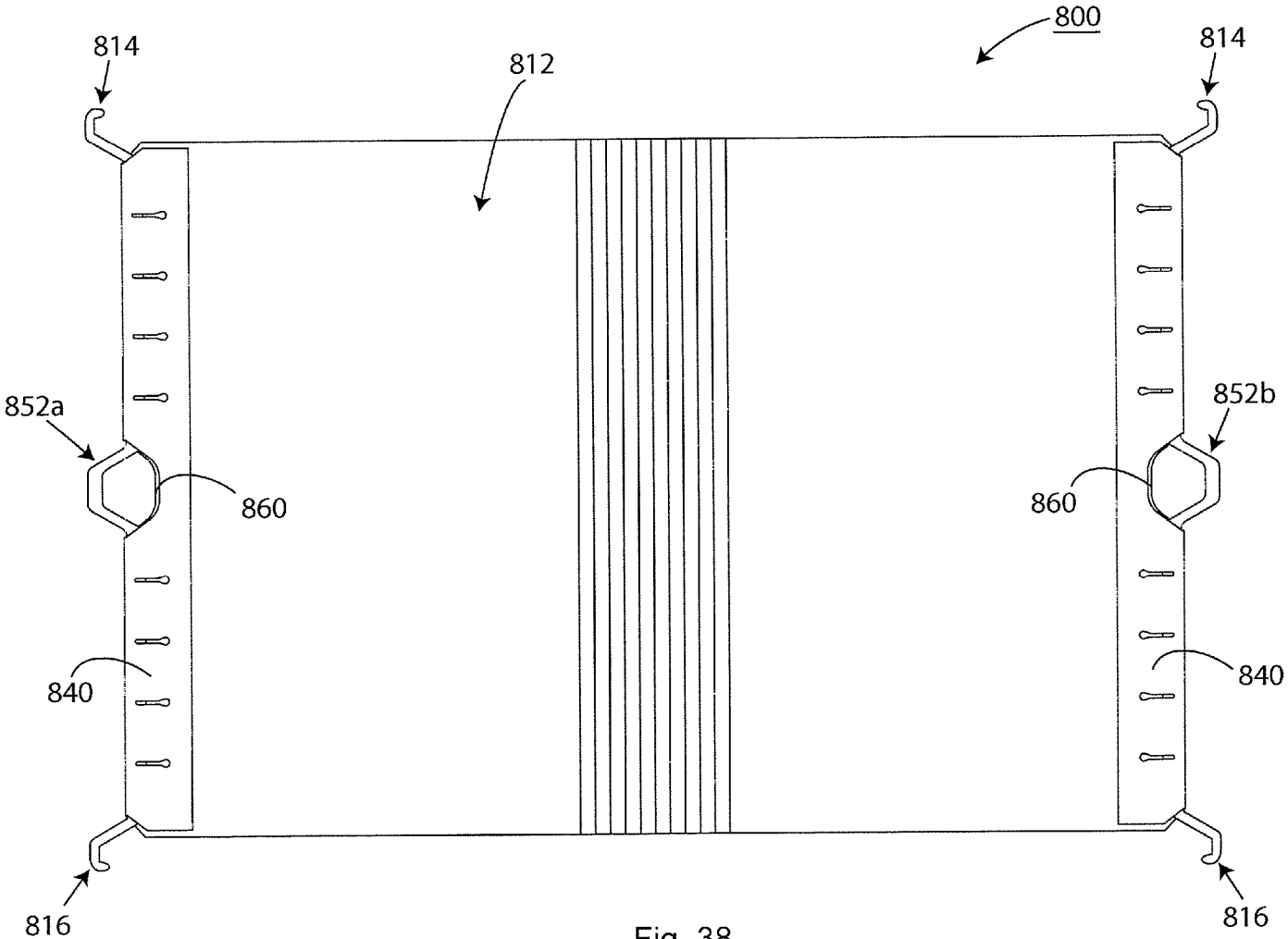

The receptacle 812 may be heavy paper or card stock, plastic, fabric or other suitable flexible material. As best shown in FIGS. 38 and 39, the ends 840 of the receptacle 812 are folded inwardly and over suspension bars 850*a*, 850*b* to form inward flaps thereby forming pockets for the suspension bars. The receptacle 812 also has a hole 860, or cut out, to allow access to the grips 852*a*, 852*b* when the ends 840 of the receptacle 812 are folded over the suspension bars 850*a*, 850*b* during manufacture of hanging file folders.

Figure 41:
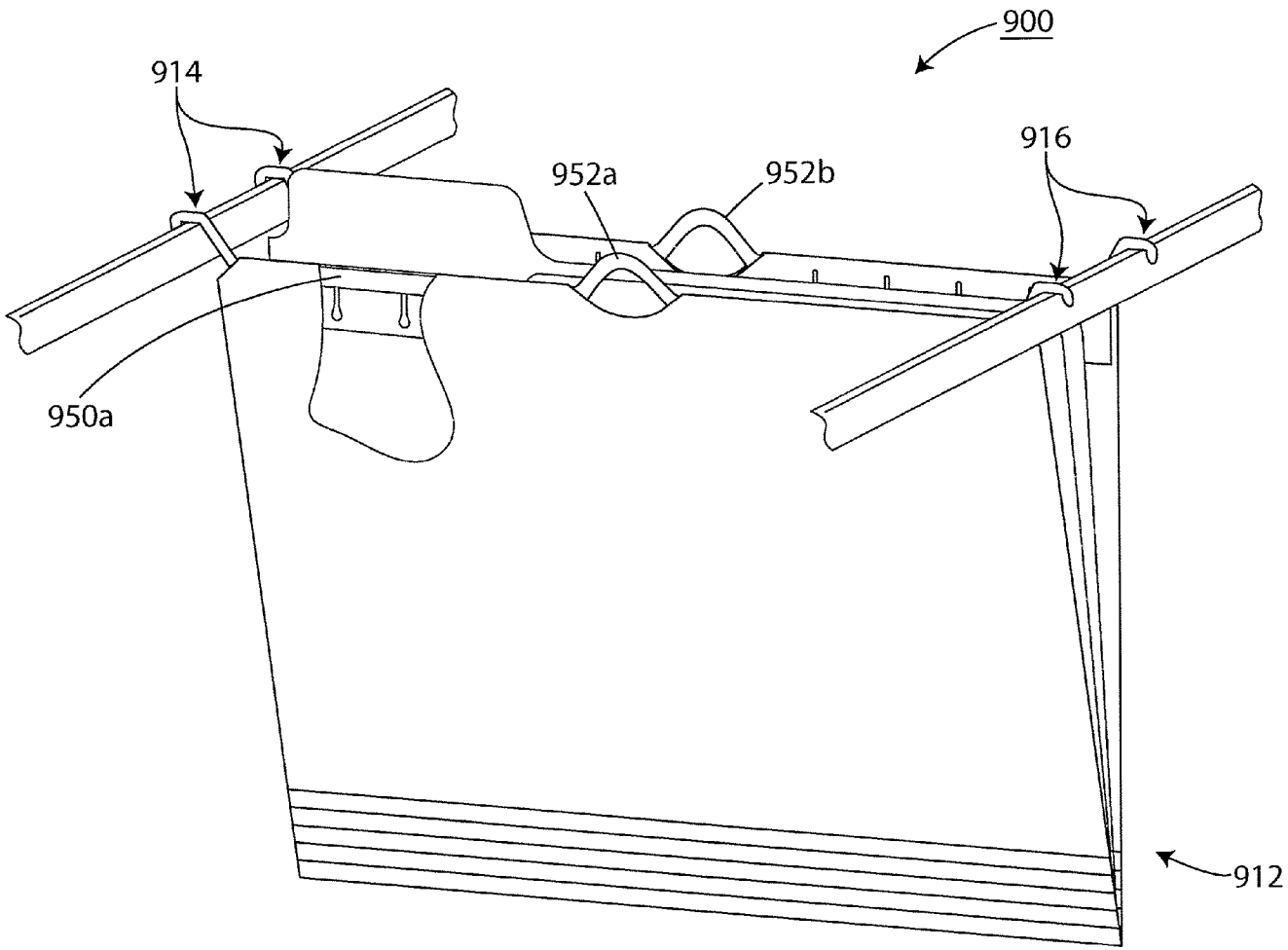
FIGS. 41-43 are various views of a hanging file folder according to another exemplary embodiment of the invention, wherein the file folder has a handle
Figure 42:
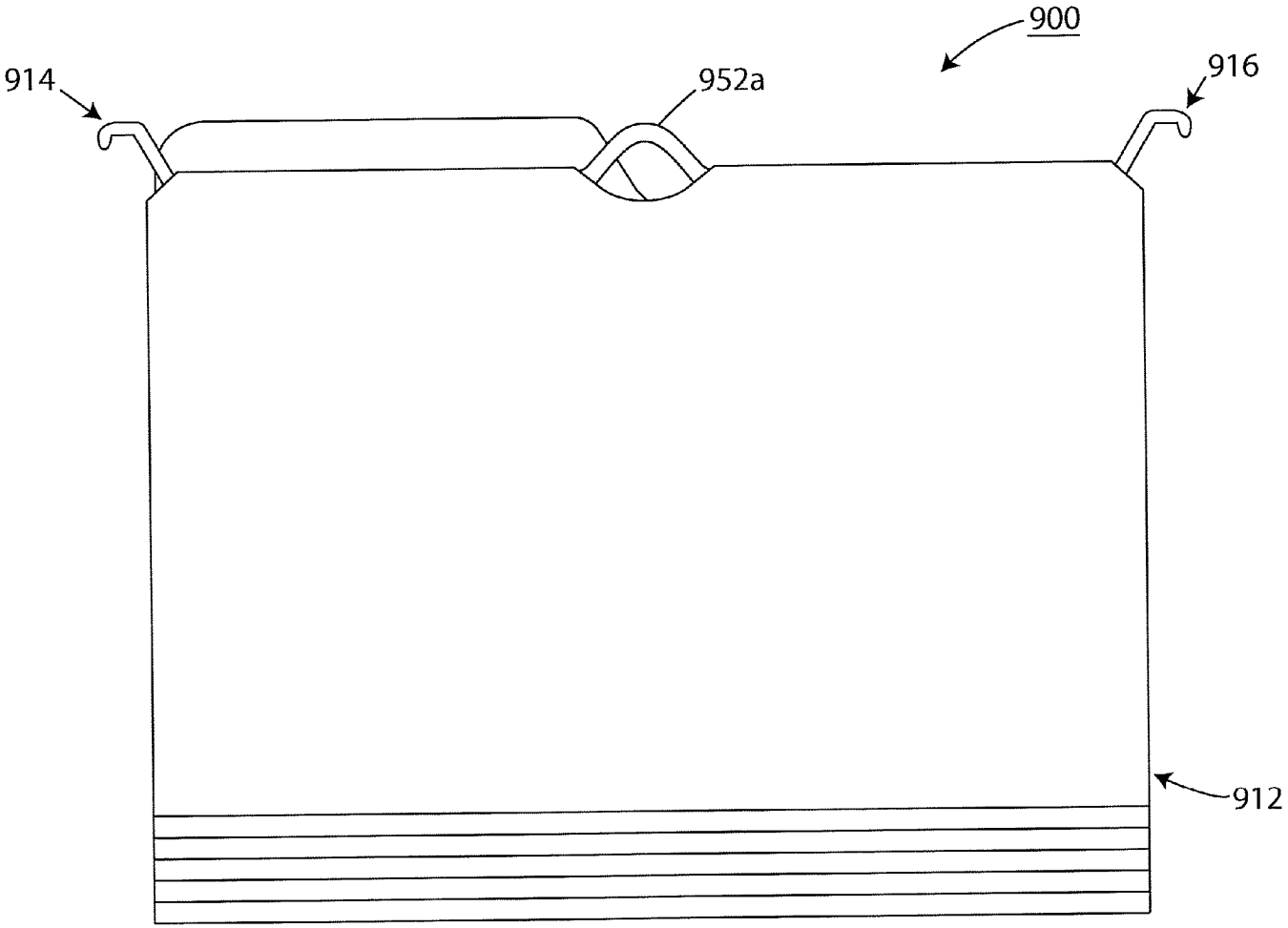
Figure 43:
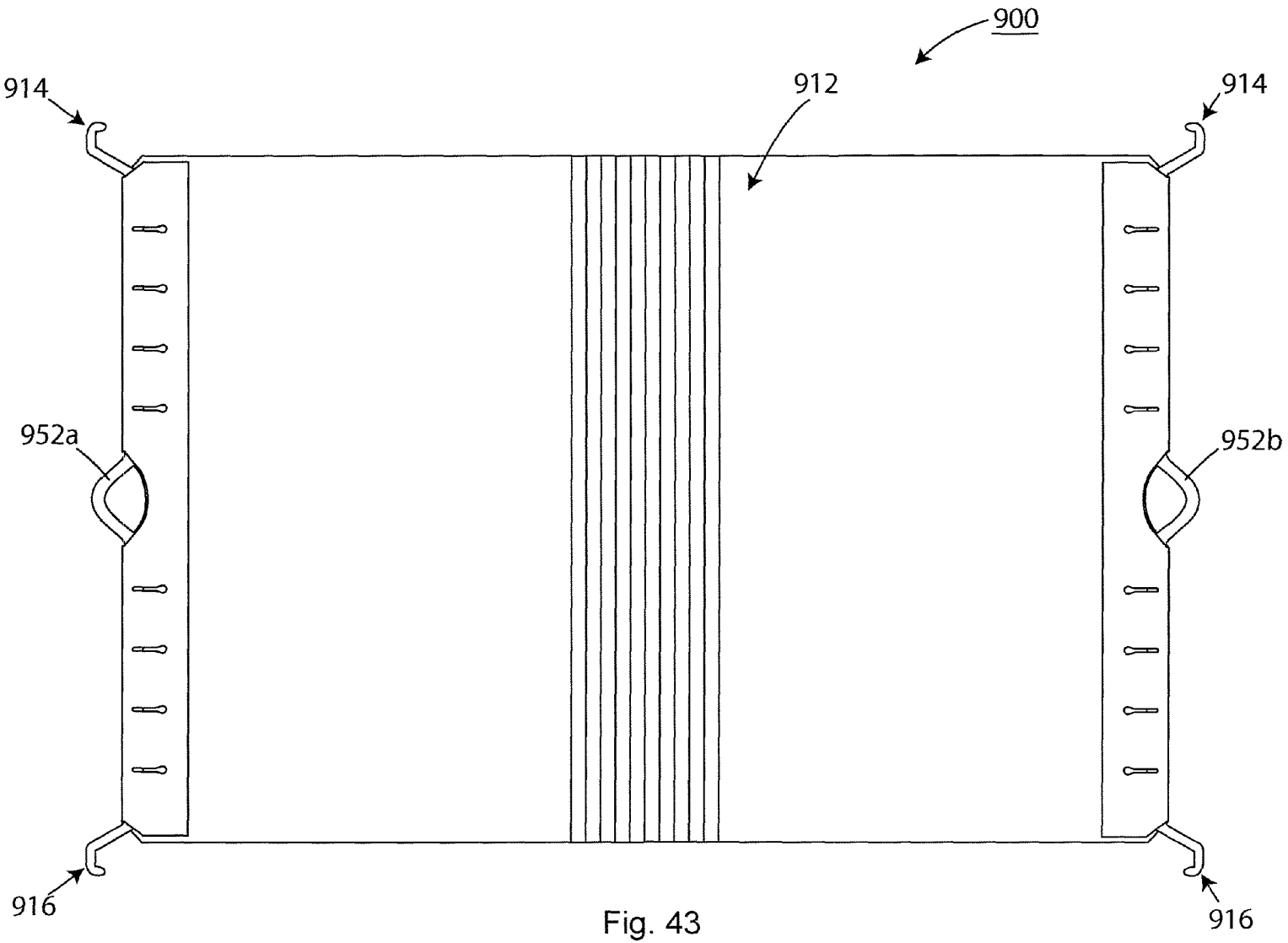
Figure 44:
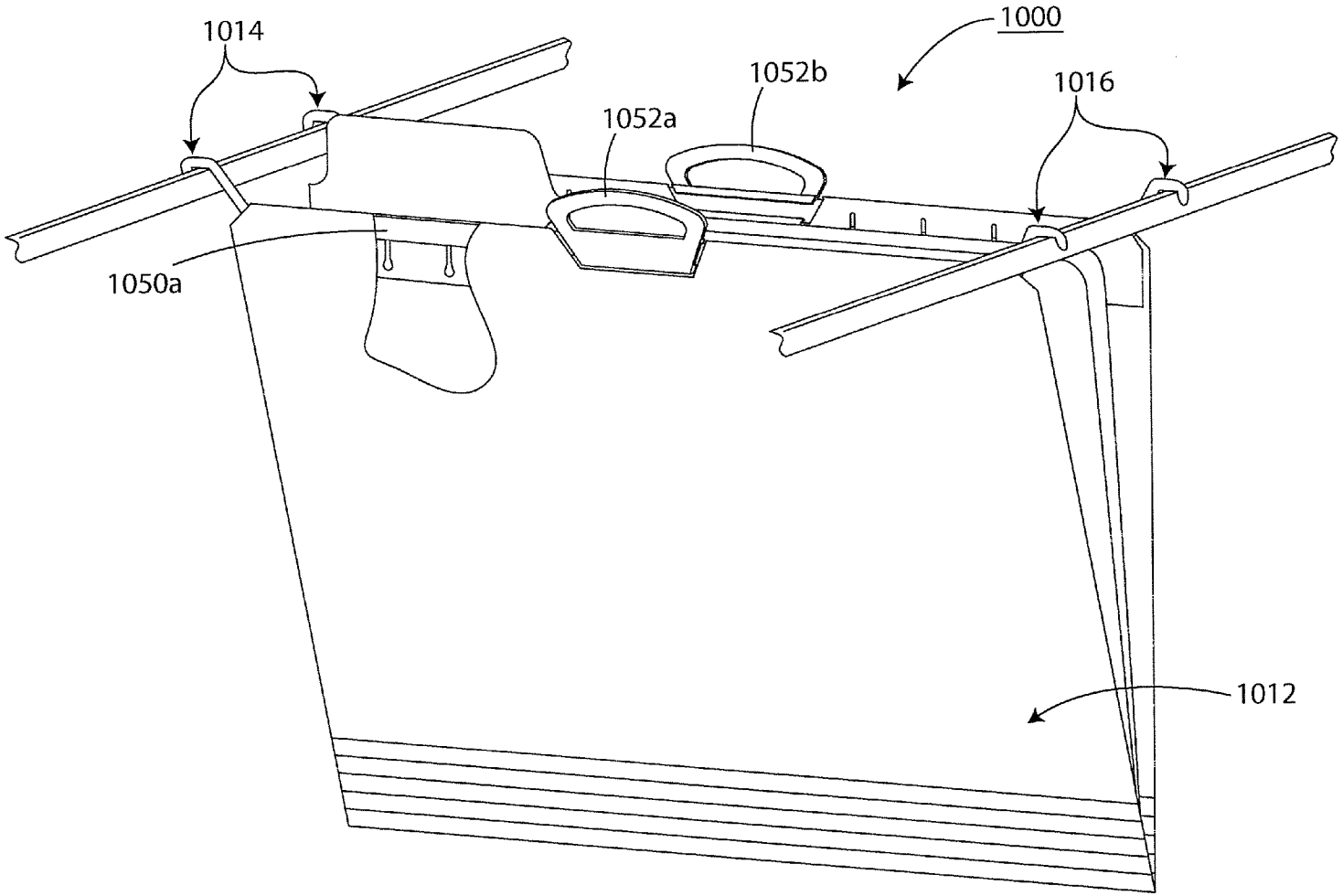
FIGS. 44-46 are various views of a hanging file folder according to another exemplary embodiment of the invention, wherein the file folder has a handle
Figure 45:
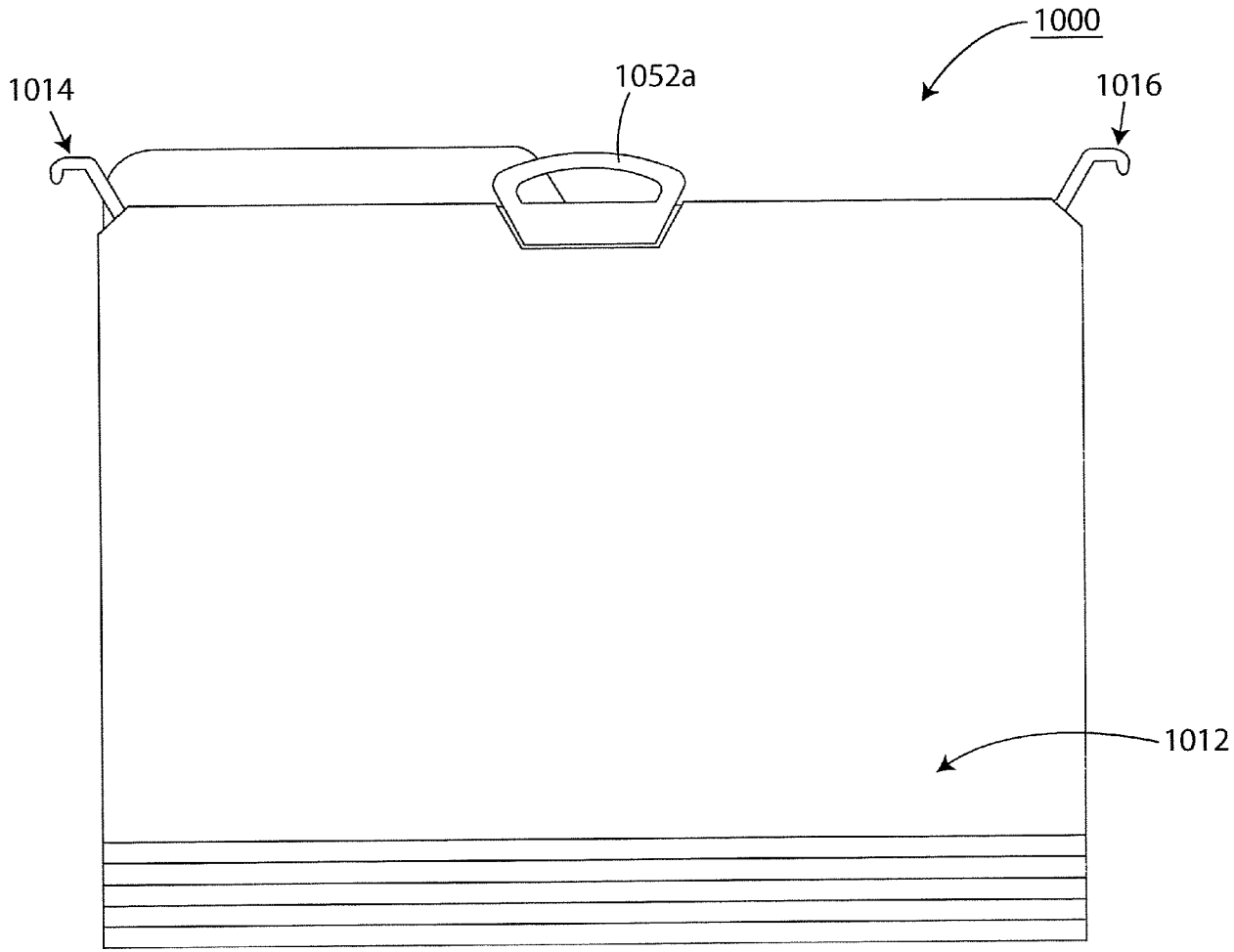
Figure 46:
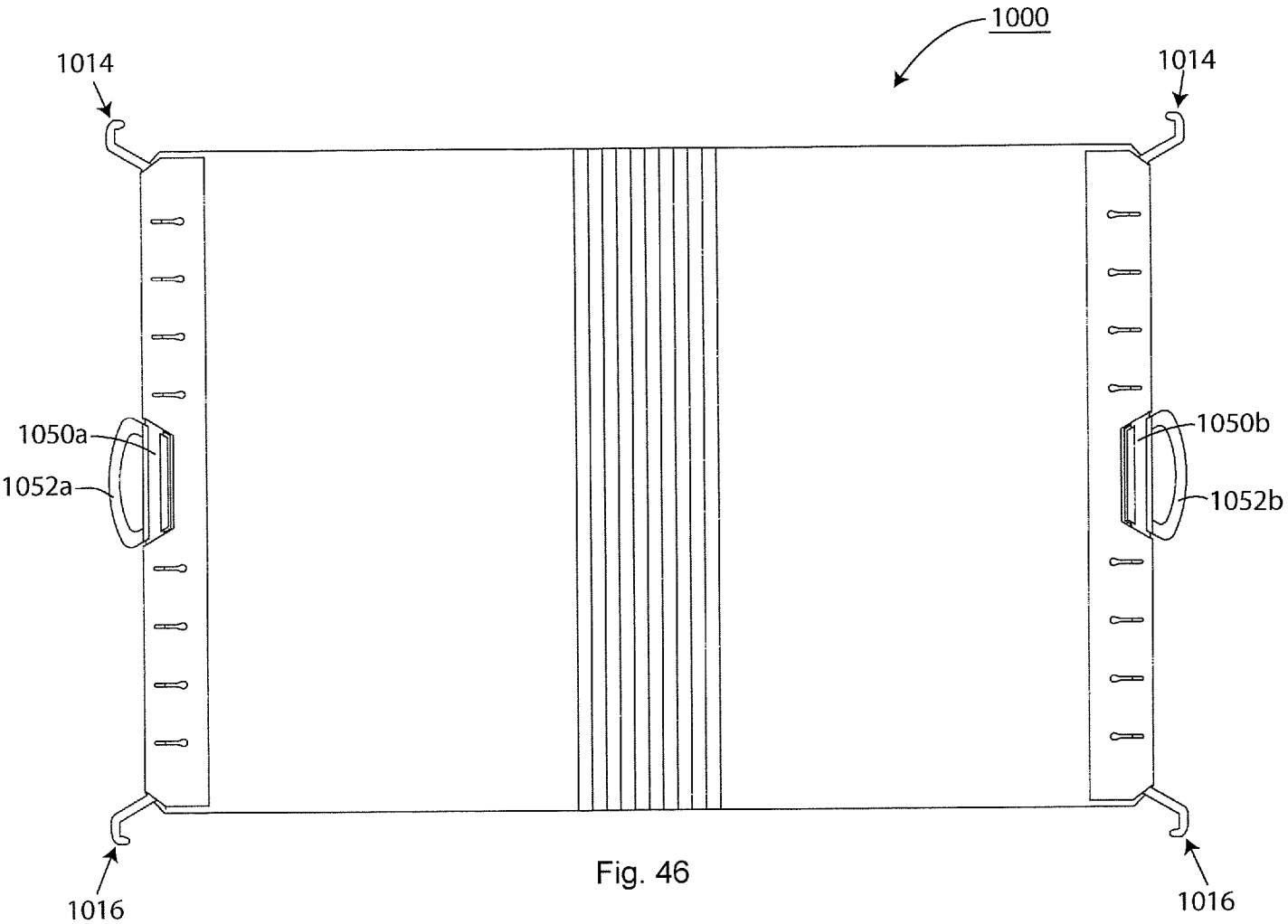
Figure 47:
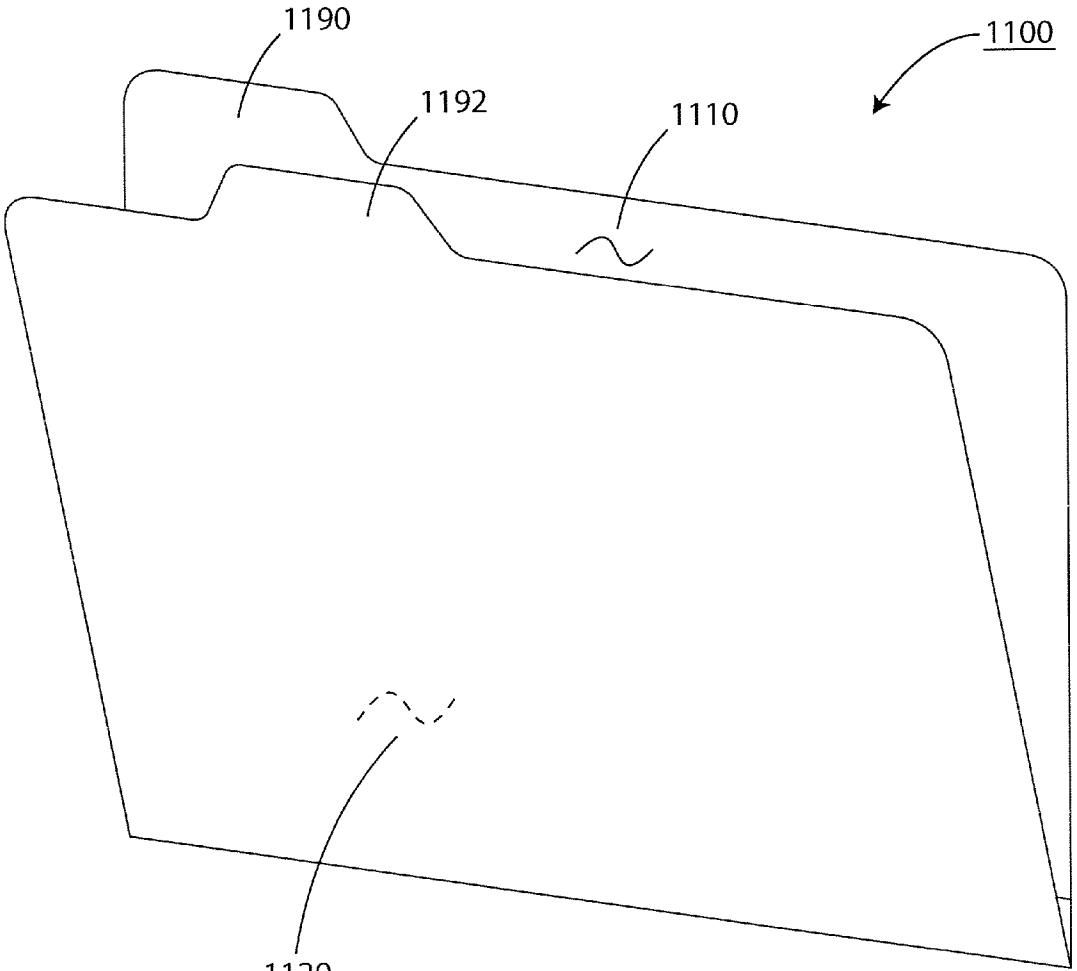
FIGS. 47-50 are various views of a file folder and method of using the file folder according to another exemplary embodiment of the invention.

The grip portion of the suspension bar may take various shapes. For example, FIGS. 41-43 show an exemplary hanging file folder 900 having a receptacle 912 suspended by a pair of bent hangers 914, 916 and a grips 952*a*, 952*b*, or handles, formed as part of the suspension bars 950*a*, 950*b*. The grip portions 952*a*, 952*b* of the suspension bars 950*a*, 950*b* are rounded and integrally formed as part of the suspension bars. A grip may also be separate and attached to the suspension bar or the top of the material forming the receptacle, by any suitable means known in the art, such as with a fastener or adhesive. For example, FIGS. 44-46 show an exemplary hanging file folder 1000 having a receptacle 1012 suspended by a pair of bent hangers 1014, 1016 and grips 1052*a*, 1052*b*, or handles, attached to the suspension bars 1050*a*, 1050*b*. As shown, the grips 1052*a*, 1052*b* snap on to an exposed portion of the suspension bars 1050*a*, 1050*b*. The separate grip may be made from any suitable material known in the art, such as metal or plastic. Further, the grip may be located at virtually any location along the suspension bar. A grip may also be formed from the material forming the receptacle, for example as a portion of the ends of the receptacle that are folded inwardly and over the hangers to form inward flaps. The bends in the hangers 914, 916 and the hangers 1014, 1016 may be shaped, sized, and configured as any of the various combinations and permutations of sizes discussed in the earlier embodiments, e.g., the embodiment of FIGS. 1-7.

The present application is also directed toward so-called "manila" file folders, which typically consist of a single sheet of material that may have a tab pre-stamped in a preselected location. The folders in the present application comprise a single sheet of material with a tab at each end; the sheet is configured to be capable of being folded so that a tab is located at a selected location from a number of possible locations across the top of the folder, e.g., one location of any of four locations, one of any of three locations, or one of any of two locations. The possible locations may be evenly spaced across the top of the file folder.

An exemplary sheet for a folder may comprise a sheet of material having a top surface, a bottom surface, first and second ends, two longitudinal edges, and first and second tabs. The sheet of material may be foldable along a central fold line into a file folder having one of the tabs extending at one of four locations opposite the central fold, with the tab extending from a top of the folder while the central fold is oriented at a bottom of the folder. The first tab is generally disposed along the first end of the sheet while the second tab is disposed along a second end of the sheet. While the central fold is at a first fold location, the first tab is located at one of first and fourth locations opposite the central fold, and capable of extending at either the first location or the fourth location, depending on which direction the sheet is folded. While the central fold is at a second fold location, the second tab is located at one of second and third locations opposite the central fold, and capable of extending at either the second location or the third location, depending on which direction the sheet is folded.

An exemplary method of folding a sheet of material into a folder may comprise the steps of providing a sheet of material having a top surface, a bottom surface, first and second ends, two longitudinal edges, a first tab extending from the first end, and a second tab extending from the second end. The sheet of material is foldable along a central fold line into a file folder having one of the tabs extending at one of four locations opposite the central fold, with the tab extending from a top of the folder while the central fold is oriented at a bottom of the folder. The user selects a desired location among the four locations to position an extending tab. The user also identifies a fold line for a central fold that results in one of the tabs extending from at least the desired location of the four locations. Further, the user identifies a fold direction that results in one of the tabs extending from at least the desired location of the four locations. The user folds the sheet at the identified fold line in the identified direction to position the tab to extend from the desired location.

Another exemplary sheet for a folder may comprise a sheet of material having a top surface, a bottom surface, first and second ends, two longitudinal edges, and first and second tabs. The sheet of material is foldable along a central fold line into a file folder having one of the tabs extending at one of three locations opposite the central fold, with the tab extending from a top of the folder while the central fold is oriented at a bottom of the folder. The first tab is generally disposed along the first end of the sheet while the second tab is disposed along a second end of the sheet. While the central fold is at a first fold location, the first tab is located at one of first and third locations opposite the central fold, and capable of extending at either the first location or the third location, depending on which direction the sheet is folded. While the central fold is at a second fold location, the second tab is located at the second location opposite the central fold.

Another exemplary method of folding a sheet of material into a folder may comprise the steps of providing a sheet of material having a top surface, a bottom surface, first and second ends, two longitudinal edges, a first tab extending from the first end, and a second tab extending from the second end. The sheet of material is foldable along a central fold line into a file folder having one of the tabs extending at one of three locations opposite the central fold, with the tab extending from a top of the folder while the central fold is oriented at a bottom of the folder. The user selects a desired location among the three locations to position an extending tab. The user then identifies a fold line for a central fold that results in one of the tabs extending from at least the desired location of the three locations. Further, the user identifies a fold direction that results in one of the tabs extending from at least the desired location of the three locations. The user folds the sheet at the identified fold line in the identified direction to position the tab to extend from the desired location.

FIGS. 47-50 depict an exemplary file folder 1100 of this type and methods of folding and using the file folder such that a tab of the folder may be located in any position of a plurality of positions across the top of the folder (i.e., extend at one of a plurality of locations opposite a central fold). The file folder 1100, which is made from a single piece of material and from a single die cut, may be folded in multiple directions and along a central fold to produce folders having tabs at four different positions or locations opposite the central fold. In certain embodiments, file folders with more or less tab positions may be created from a single file folder. Further, the file folder may be any type of file folder, for example a hanging file folder or a manila folder.

Figure 48:
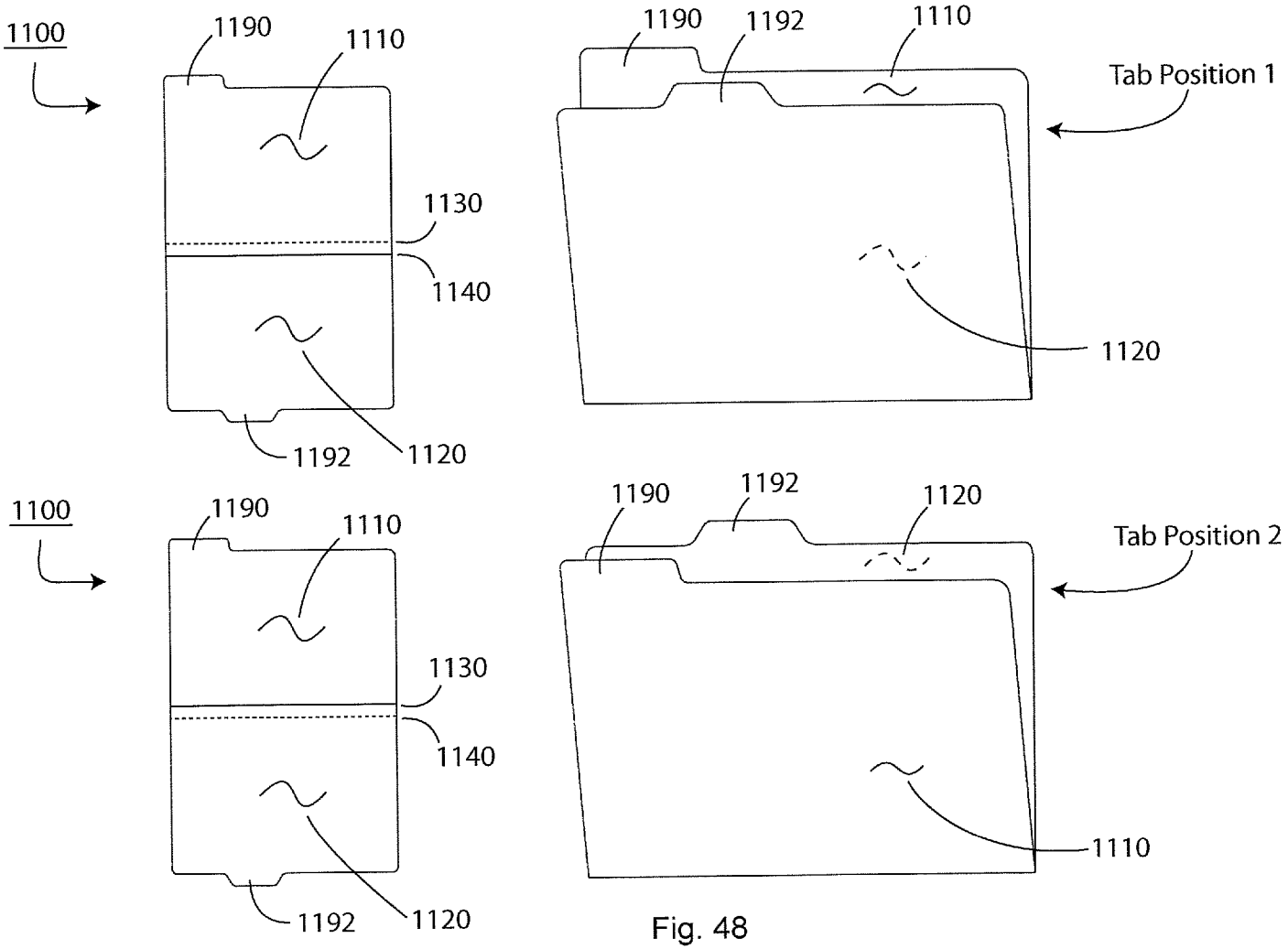
Figure 49:
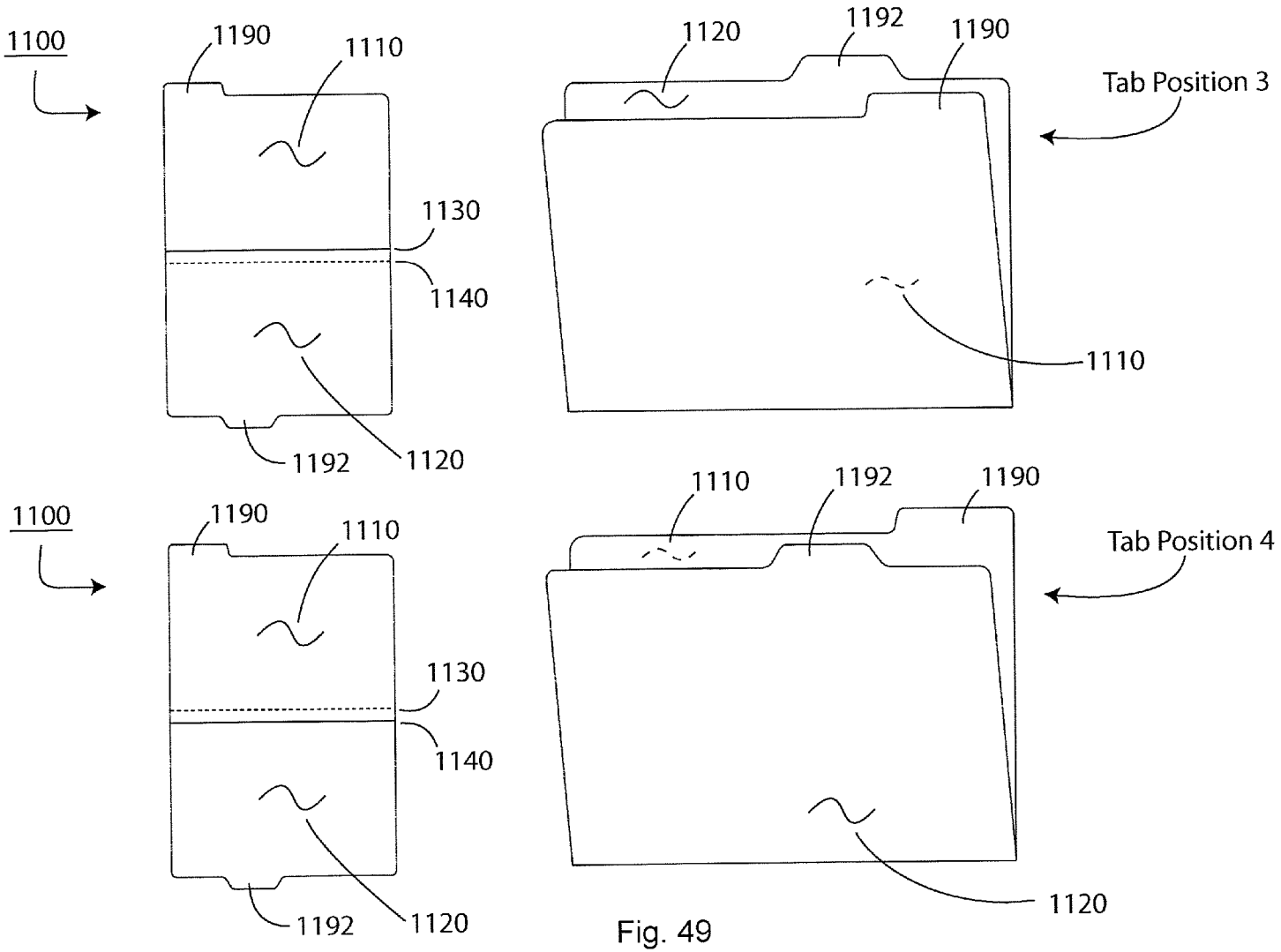
Figure 50:
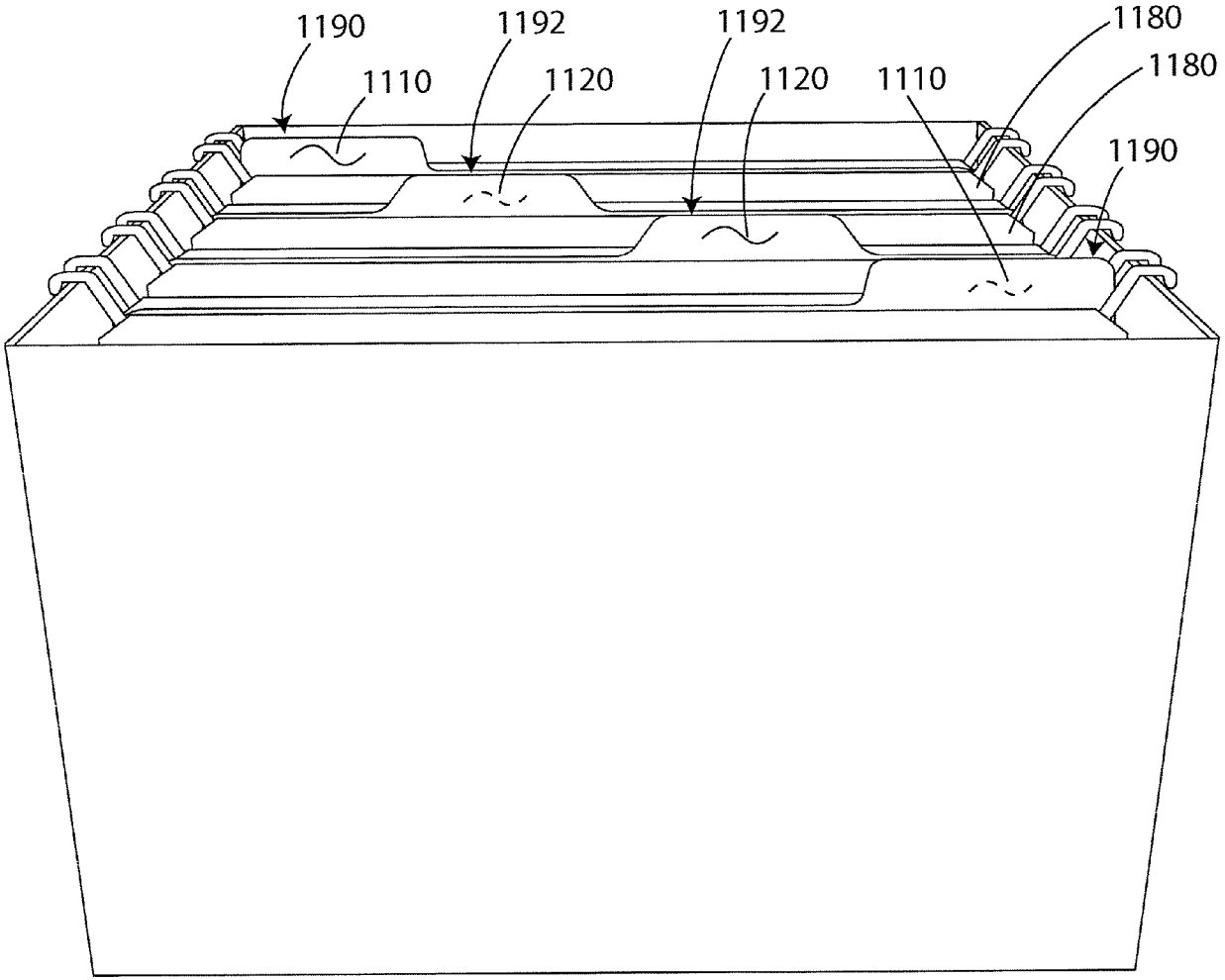

For example, as shown in FIGS. 48-50, unfolded file folder 1100 may be folded such that one of two tabs 1190, 1192 is located in any of four different positions along the top of the folder. As depicted, the tab position may be selected from a plurality of tab positions, i.e., from left to right, starting with tab position 1 and ending with tab position 4. A folder having any of tab positions 1-4 may be created from the unfolded file folder 1100. A file folder with tab position 1 may be created by folding surface 1120 towards surface 1110 and along fold 1140. A file folder with tab position 2 may be created by folding surface 1120 away from surface 1110 and along fold 1130. A file folder with tab position 3 may be created by folding surface 1120 towards surface 1110 and along fold 1130 and then flipping the file folder over. Finally, a file folder with tab position 4 may be created by folding surface 1120 away from surface 1110 and along fold 1140 and then flipping the file folder over. As best shown in FIG. 50, file folders with tab position 1-4 may be placed in a hanging file folder 1180. By alternating the tab position from one file folder to the next, the user is able to view the tab of the file folder without moving the folders in front of it. Thus, one may provide four of the exemplary folder 1100 (identical and cut from the same die), and create four different folders—one with a tab at position 1, one with a tab at position 2, one with a tab at position 3, and one with a tab at position 4.

Figure 51:
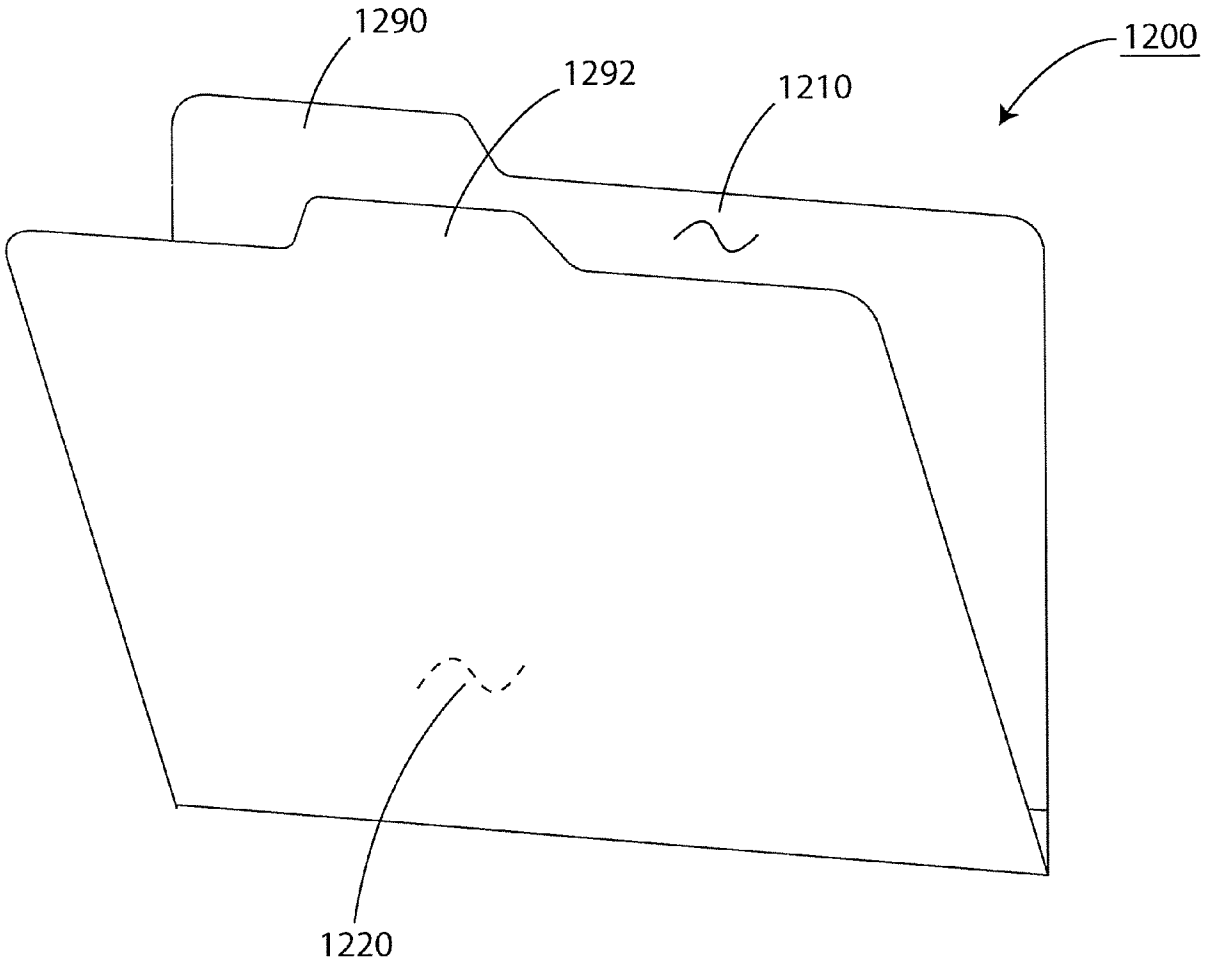
FIGS. 51 and 52 are various views of a file folder and method of using the file folder according to another exemplary embodiment of the invention.
Figure 52:
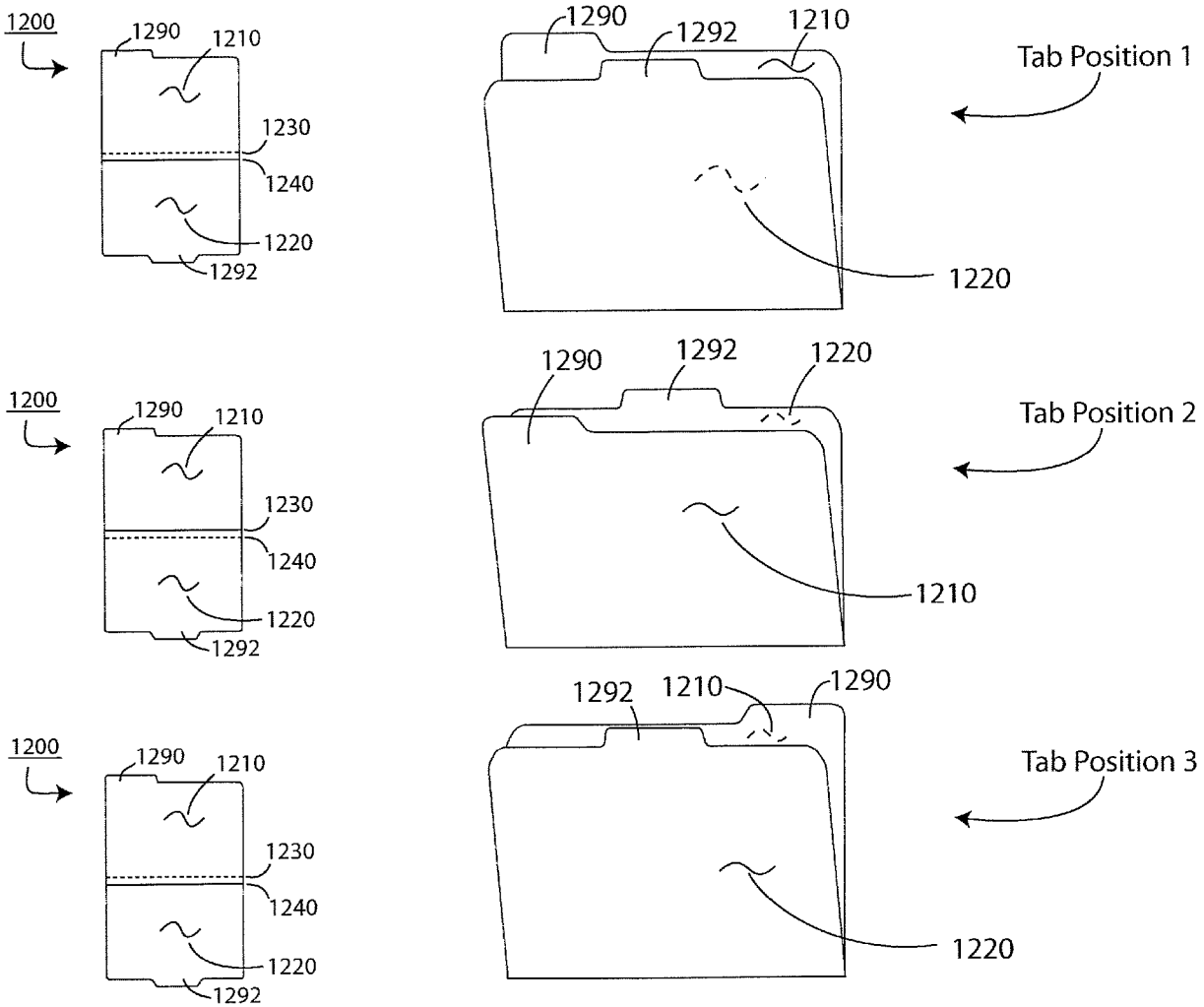

Similarly, as shown in FIGS. 51 and 52, unfolded file folder 1200 may be folded such that one of two tabs 1290, 1292 is located in three different positions along the top of the folder. A file folder with tab position 1 may be created by folding surface 1220 towards surface 1210 and along fold 1240. A file folder with tab position 2 may be created by folding surface 1220 away from surface 1210 and along fold 1230. A file folder with a tab position 3 may be created by folding surface 1220 away from surface 1210 and along fold 1240 and then flipping the file folder over.

Figure 53:
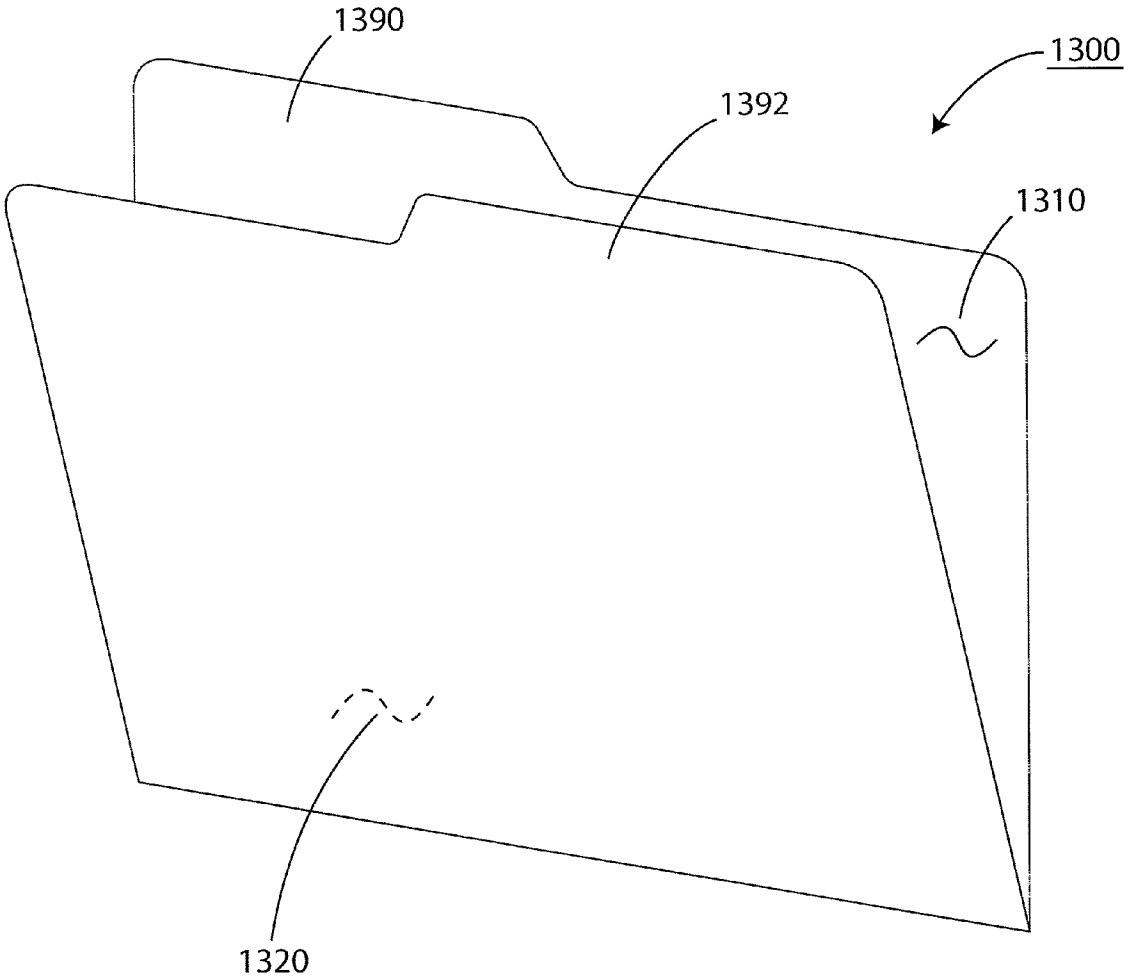
FIGS. 53 and 54 are various views of a file folder and method of using the file folder according to another exemplary embodiment of the invention.
Figure 54:
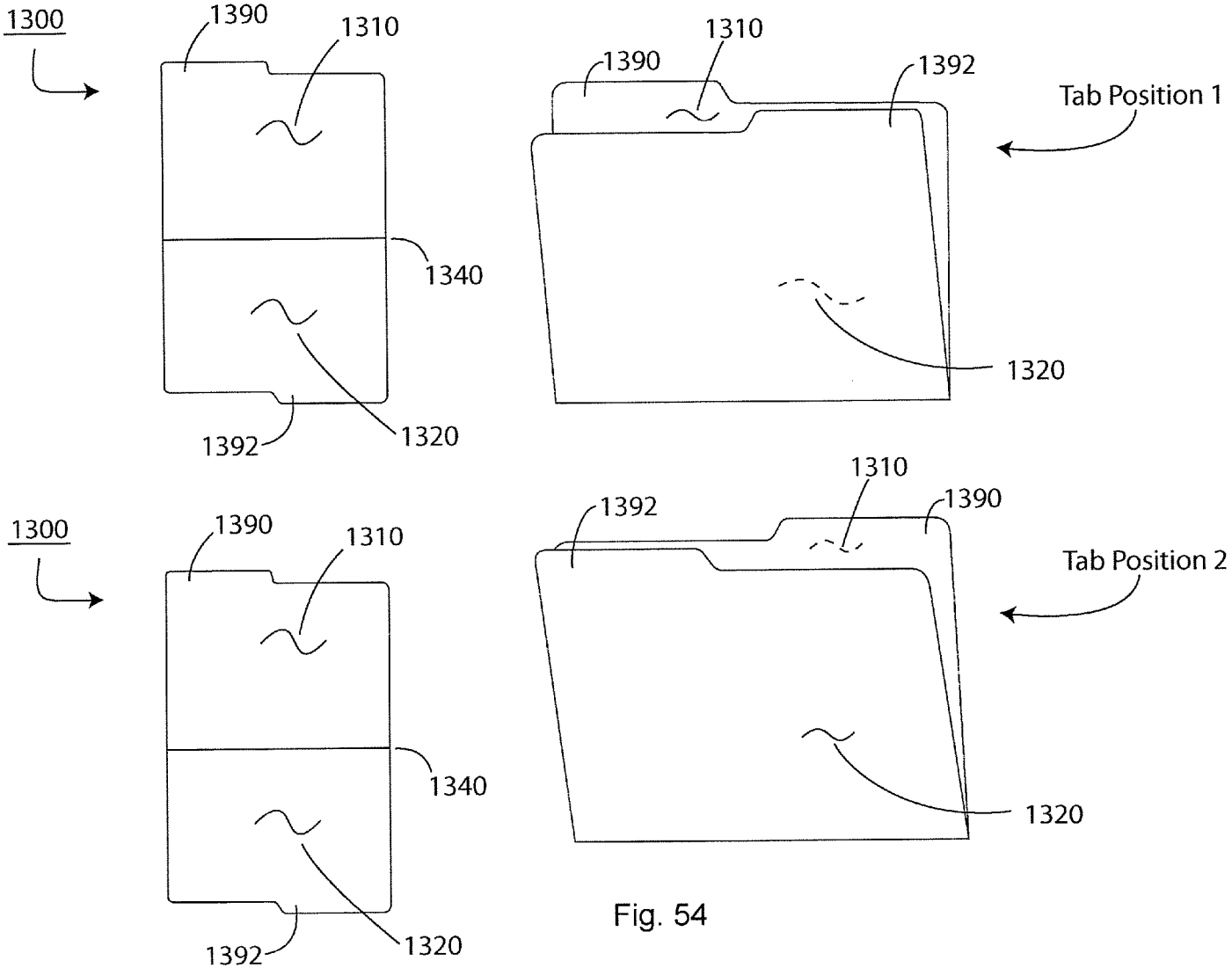

Further, as shown in FIGS. 53 and 54, unfolded file folder 1300 may be folded such that one of two tabs 1390, 1392 is located in two different positions along the top of the folder. A file folder with tab position 1 may be created by folding surface 1320 towards surface 1310 and along fold 1340. A file folder with tab position 2 may be created by folding surface 1320 away from surface 1310 and along fold 1340, then flipping the folder over.

Any or all of the file folders depicted in FIGS. 48-54 and/or described above may be included as a part of a kit. The kit may include a plurality of (e.g., at least 25, or at least 50, or at least 100) identical unfolded file folders, and instructions on how to produce folders with the tab in any position of a plurality of positions. Further, any or all of the file folders depicted in FIGS. 48-54 and/or described above may be produced using the method of folding the unfolded folder in multiple directions and along one or more folds to produce folders having tabs at any position of a plurality of positions. Additionally, any or all of the file folders depicted in FIGS. 48-54 and/or described above may be produced with instructions affixed thereto, e.g., printed thereon, for folding that particular sheet into its respective configurations, e.g., locating the tab at a selected one of four locations, or locating the tab at a selected one of three locations, or locating the tab at a selected one of two locations. Finally, any or all of the file folders depicted in FIGS. 48-54 and/or described above may be arranged in office storage equipment using the method of alternating the tab position from one file folder to the next.

In addition to the benefits described above, many of the particular embodiments herein have additional benefits as well. For example, the hanging file folders permitting the tabs to be viewed because of hangers or suspension bars with bends forming an angled portion (e.g., folders 10, 100, 200, 500, 600, 800, 900, and 1000) are easier to insert into office storage equipment than ordinary hanging file folders. It is believed that this is because the files have a lower center of gravity and because the angled portions taper toward the center, which allows the angled portions to act as a self-centering guide as the file folder is inserted into the office equipment. The angled portions guide the file folder onto the rails as it is inserted into the office equipment. It has also been found that some these embodiments are easier to open than ordinary hanging file folders. Also, in addition to permitting file folders to be carried, the handles also greatly facilitate sorting through files, because a user may use his or her fingers to "walk" from handle to handle to handle, quickly sorting through files and lifting desired files. Additionally, some of the handles in particular (e.g., the central handles that have a central opening, such as those with hollow, central handles, e.g., in folders 800, 900, and 1000) can be used as an additional support for hanging the files, e.g., a user can hang one or more files from their handles by placing their handle on a peg or hook or other protrusion (the folder is thus hanging from its center at the top). Thus, one may use the handles to quickly sort through the files, remove one, hang the folder via its hollow handle from a peg on a peg-board, continue sorting through the files walking from handle to handle, remove another file and hang it via its hollow handle with the first file on the peg, and so on. Of course, instead of, or in addition to, the single, central hangers, one may modify the folder to have a plurality of hangers, e.g., equally spaced from the center, to permit the folders to hang from a plurality of hangers.

While several embodiments of the invention have been illustrated and described in considerable detail, the present invention is not to be considered limited to the precise constructions disclosed. Various adaptations, modifications and uses of the invention may occur to those skilled in the arts to which the invention relates. For example, although the various embodiments shown are US letter sized file folders, the teachings hereof apply equally well to US legal, A4, foolscap, and other sizes. As another example, any one or more of the features of any of the exemplary embodiments herein may be used in connection with any of the other exemplary embodiments herein. It is the intention to cover all such adaptations, modifications and uses.

Exemplary embodiments of the invention include, but are not limited to:

1. A file folder for use in a piece of office storage equipment, comprising:

a sheet of material having a central fold, a first edge fold, and a second edge fold, wherein the central fold forms a bottom, a first side, and a second side of the file folder, the first edge fold forms a first pocket along a top edge of the first side of the file folder, and the second edge fold forms a second pocket along a top edge of the second side of the file folder;

a first suspension bar and a second suspension bar, each suspension bar having two ends, wherein the first suspension bar is at least partially disposed within the first pocket and the second suspension bar is at least partially disposed within the second pocket;

wherein each end of each suspension bar is exposed and has a rail supporting portion that enables the file folder to suspend from rails inside the piece of office storage equipment; and wherein the exposed ends of at least one suspension bar each have a bend such that at least one edge fold of the file folder is a substantial distance beneath the rail supporting portions of the exposed ends of the at least one suspension bar.

2. The file folder of embodiment 1, wherein the exposed ends of the at least one suspension bar have a bend such that a tab of a conventional manila folder having a fold resting on the bottom of the file folder when the file folder is suspended from rails inside the piece of office equipment is not bent when the piece of office equipment is closed.

3. A file folder according to any one embodiment of the preceding embodiments, wherein the exposed ends of at least one suspension bar are cut with a bend such that at least one edge fold of the file folder is a substantial distance beneath the rail supporting portions of the exposed ends of the at least one suspension bar.

4. A file folder according to any one embodiment of the preceding embodiments, wherein a tab of a conventional manila folder having a fold resting on the bottom of the file folder when the file folder is suspended from rails inside the piece of office equipment extends above at least one edge fold a distance sufficient to permit a user to read text on the tab without having to pull the manila folder from the file folder.

5. A file folder according to any one embodiment of the preceding embodiments, wherein the exposed ends of the at least one suspension bar have a bend such that a tab of a manila folder having a height between a fold and a top of the tab of about 9.5 inches (e.g., 9.5 inches+/−1/16 inch) with the fold resting on the bottom of the file folder when the file folder is suspended from rails inside the piece of office equipment is not bent when the piece of office equipment is closed.

6. A file folder according to any one embodiment of the preceding embodiments, wherein a tab of a manila folder having a height between a fold and the top of the tab of about 9.5 inches with the fold resting on the bottom of the file folder when the file folder is suspended from rails inside the piece of office equipment extends above at least one edge fold a distance sufficient to permit a user to read text on the tab without having to pull the manila folder from the file folder.

7. A file folder according to any one embodiment of the preceding embodiments, wherein there is a distance of about 0.7 inches between the at least one edge fold and a top of a tab of a manila folder having a height between a fold and the top of the tab of about 9.5 inches with the fold resting on the bottom of the file folder when the file folder is suspended from rails inside the piece of office equipment.

8. A file folder according to any one embodiment of the preceding embodiments, wherein there is a distance of at least 0.4 inches between the at least one edge fold and a top of a tab of a manila folder having a height between a fold and the top of the tab of about 9.5 inches with the fold resting on the bottom of the file folder when the file folder is suspended from rails inside the piece of office equipment.

9. A file folder according to any one embodiment of the preceding embodiments, wherein there is a distance of at least 0.5 inches between the at least one edge fold and a top of a tab of a manila folder having a height between a fold and the top of the tab of about 9.5 inches with the fold resting on the bottom of the file folder when the file folder is suspended from rails inside the piece of office equipment.

10. A file folder according to any one embodiment of the preceding embodiments, wherein there is a distance of at least 0.4 inches between the at least one edge fold and a top of a tab of a manila folder, along the entire length of the at least one edge fold beneath the tab, having a height between a fold and the top of the tab of about 9.5 inches with the fold resting on the bottom of the file folder when the file folder is suspended from rails inside the piece of office equipment.

11. A file folder according to any one embodiment of the preceding embodiments, wherein there is a distance of at least 0.5 inches between the at least one edge fold and a top of a tab of a manila folder, along the entire length of the at least one edge fold beneath the tab, having a height between a fold and the top of the tab of about 9.5 inches with the fold resting on the bottom of the file folder when the file folder is suspended from rails inside the piece of office equipment.

12. A file folder according to any one embodiment of the preceding embodiments, wherein the exposed ends of the at least one suspension bar have a bend such that the at least one edge fold of the file folder is beneath the rail supporting portion of the exposed ends of the at least one suspension bar by at least 0.25 inches.

13. A file folder according to any one embodiment of the preceding embodiments, wherein the exposed ends of the at least one suspension bar have a bend such that the at least one edge fold of the file folder is beneath the rail supporting portion of the exposed ends of the at least one suspension bar by at least 0.4 inches.

14. A file folder according to any one embodiment of the preceding embodiments, wherein the exposed ends of the at least one suspension bar have a bend such that the at least one edge fold of the file folder is beneath the rail supporting portion of the exposed ends of the at least one suspension bar by at least 0.47 inches.

15. A file folder according to any one embodiment of the preceding embodiments, wherein the exposed ends of the at least one suspension bar have a bend such that the at least one edge fold of the file folder is beneath the rail supporting portion of the exposed ends of the at least one suspension bar by about 0.3 to 0.7 inches.

16. A file folder according to any one embodiment of the preceding embodiments, wherein the exposed ends of the at least one suspension bar have a bend such that the at least one edge fold of the file folder is beneath the rail supporting portion of the exposed ends of the at least one suspension bar by about 0.47 to 0.52 inches.

17. A file folder according to any one embodiment of the preceding embodiments, wherein the exposed ends of the at least one suspension bar have a bend such that the at least one edge fold of the file folder is beneath a top portion of the exposed ends of the at least one suspension bar by at least 0.25 inches.

18. A file folder according to any one embodiment of the preceding embodiments, wherein the exposed ends of the at least one suspension bar have a bend such that the at least one edge fold of the file folder is beneath a top portion of the exposed ends of the at least one suspension bar by at least 0.5 inches.

19. A file folder according to any one embodiment of the preceding embodiments, wherein the exposed ends of the at least one suspension bar have a bend such that the at least one edge fold of the file folder is beneath a top portion of the exposed ends of the at least one suspension bar by at least 0.6 inches.

20. A file folder according to any one embodiment of the preceding embodiments, wherein the exposed ends of the at least one suspension bar have a bend such that the at least one edge fold of the file folder is beneath a top portion of the exposed ends of the at least one suspension bar by about 0.4 to 0.8 inches.

21. A file folder according to any one embodiment of the preceding embodiments, wherein the exposed ends of the at least one suspension bar have a bend such that the at least one edge fold of the file folder is beneath a top portion of the exposed ends of the at least one suspension bar by about 0.61 to 0.63 inches.

22. A file folder according to any one embodiment of the preceding embodiments, wherein the exposed ends of the at least one suspension bar have a bend such that a top of a tab of a conventional manila folder having a fold resting on the bottom of the file folder when the file folder is suspended from rails inside the piece of office equipment is above a top portion of the exposed ends of the at least one suspension bar by about 0.05 to 0.1 inches.

23. A file folder according to any one embodiment of the preceding embodiments, wherein the exposed ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is above a top portion of the exposed ends of the at least one suspension bar by about 0.05 to 0.1 inches.

24. A file folder according to any one embodiment of the preceding embodiments, wherein the exposed ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is above a top portion of the exposed ends of the at least one suspension bar by no more than 0.1 inches.

25. A file folder according to any one embodiment of the preceding embodiments, wherein the exposed ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is above a top portion of the exposed ends of the at least one suspension bar by no more than 0.09 inches.

26. A file folder according to any one embodiment of the preceding embodiments, wherein the exposed ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is above a top portion of the exposed ends of the at least one suspension bar by about 0.085 inches.

27. A file folder according to any one embodiment of the preceding embodiments, wherein the exposed ends of the at least one suspension bar have a bend such that a top of a tab of a conventional manila folder having a fold resting on the bottom of the file folder when the file folder is suspended from rails inside the piece of office equipment is beneath a top portion of the exposed ends of the at least one suspension bar by about 0.05 to 0.1 inches.

28. A file folder according to any one embodiment of the preceding embodiments, wherein the exposed ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is beneath a top portion of the exposed ends of the at least one suspension bar by about 0.05 to 0.1 inches.

29. A file folder according to any one embodiment of the preceding embodiments, wherein the exposed ends of the at least one suspension bar have a bend such that a top of a tab of a conventional manila folder having a fold resting on the bottom of the file folder when the file folder is suspended from rails inside the piece of office equipment is substantially aligned with a top portion of the exposed ends of the at least one suspension bar.

30. A file folder according to any one embodiment of the preceding embodiments, wherein the exposed ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is substantially aligned with a top portion of the exposed ends of the at least one suspension bar.

31. A file folder according to any one embodiment of the preceding embodiments, wherein the exposed ends of the at least one suspension bar have a bend such that an angle between the rail supporting portions of the exposed ends and the at least one edge fold is about 90 to 135 degrees.

32. A file folder according to any one embodiment of the preceding embodiments, wherein the exposed ends of the at least one suspension bar have a bend such that an angle between the rail supporting portions of the exposed ends and the at least one edge fold is about 115 to 125 degrees.

33. A file folder according to any one embodiment of the preceding embodiments, wherein the exposed ends of the at least one suspension bar have a bend such that an angle between the rail supporting portions of the exposed ends and the at least one edge fold is about 120 degrees.

34. A file folder according to any one embodiment of the preceding embodiments further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder.

35. A file folder according to any one embodiment of the preceding embodiments further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder and the user may read text on the removable tab above the tab of the manila folder.

36. A file folder according to any one embodiment of the preceding embodiments, wherein the first pocket runs along the entire top edge of the first side of the file folder and the second pocket runs along the entire top edge of the second side of the file folder.

37. A file folder according to any one embodiment of the preceding embodiments, wherein at least one pocket runs along at least one entire top edge of at least one side of the file folder.

38. A file folder according to any one embodiment of the preceding embodiments further comprising at least one handle operatively connected to the file folder and configured such that a user may carry the file folder upright.

39. A file folder according to any one embodiment of the preceding embodiments further comprising at least one handle operatively connected to at least one suspension bar and configured such that a user may carry the file folder upright.

40. A file folder according to any one embodiment of the preceding embodiments further comprising at least one handle configured such that a user may carry the file folder upright, wherein the at least one handle is integrally foamed as part of at least one suspension bar.

41. A file folder according to any one embodiment of the preceding embodiments further comprising at least one handle configured such that a user may carry the file folder upright, wherein the at least one handle is formed from a set of bends in the at least one suspension bar.

42. A file folder according to any one embodiment of the preceding embodiments further comprising at least one handle configured such that a user may carry the file folder upright, wherein the at least one handle is rounded and formed as part of at least one suspension bar.

43. A file folder according to any one embodiment of the preceding embodiments further comprising at least one handle configured such that a user may carry the file folder upright, wherein the at least one handle protrudes through an opening in at least one of an edge fold, a side, and a pocket.

44. A file folder according to any one embodiment of the preceding embodiments further comprising at least one handle configured such that a user may carry the file folder upright, wherein the at least one handle is formed from the sheet of material.

45. A file folder according to any one embodiment of the preceding embodiments further comprising at least one handle configured such that a user may carry the file folder upright, wherein the at least one handle attaches to at least one suspension bar.

46. A file folder according to any one embodiment of the preceding embodiments further comprising at least one handle configured such that a user may carry the file folder upright, wherein the at least one handle attaches to the sheet of material.

47. A file folder according to any one embodiment of the preceding embodiments further comprising two handles configured such that a user may carry the file folder upright, wherein each handle is operatively connected to one of the suspension bars and configured such that a user may carry the file folder upright.

48. A file folder according to any one embodiment of the preceding embodiments further comprising two handles configured such that a user may carry the file folder upright, wherein each handle is operatively connected to one of the sides and configured such that a user may carry the file folder upright.

49. A file folder according to any one embodiment of the preceding embodiments further comprising at least one handle configured such that a user may carry the file folder upright, wherein the at least one handle is located at about the center of at least one suspension bar and configured such that a user may carry the file folder upright.

50. A file folder according to any one embodiment of the preceding embodiments further comprising two handles configured such that a user may carry the file folder upright, wherein each handle is located at about the center of one of the suspension bars and configured such that a user may carry the file folder upright.

51. A file folder according to any one embodiment of the preceding embodiments, wherein each suspension bar is stamped from a single piece of metal with the bends cut into the stamping.

52. A file folder according to any one embodiment of the preceding embodiments, wherein each suspension bar is formed from a single piece of metal and the bends are formed by physically bending the metal piece.

53. A file folder according to any one embodiment of the preceding embodiments, wherein each side of the file folder is trapezoidal and the sheet of material is formed from a paper die cut.

54. A file folder for use in a piece of office storage equipment, comprising:

a sheet of material having a central fold, a first edge fold, and a second edge fold, wherein the central fold forms a bottom, a first side, and a second side of the file folder, the first edge fold forms a first pocket along a top edge of the first side of the file folder, and the second edge fold forms a second pocket along a top edge of the second side of the file folder;

a first suspension bar and a second suspension bar, each suspension bar having two ends, wherein the first suspension bar is at least partially disposed within the first pocket and the second suspension bar is at least partially disposed within the second pocket;

wherein a hanger is attached to each end of each suspension bar, each hanger having a rail supporting portion that enables the file folder to suspend from rails inside the piece of office storage equipment; and wherein the hangers attached to the ends of at least one suspension bar are configured such that at least one edge fold of the file folder is substantially beneath the rail supporting portions of the hangers attached to the ends of the at least one suspension bar.

55. A file folder according to any one embodiment of embodiment 54 through the immediately preceding embodiment, wherein the angle between the hangers attached to the ends of the at least one suspension bar and the at least one edge fold is about 90 degrees.

56. A file folder according to any one embodiment of embodiment 54 through the immediately preceding embodiment, wherein each hanger is removable and made from plastic.

57. A file folder according to any one embodiment of embodiment 54 through the immediately preceding embodiment, wherein each hanger is made from a plastic material that is over-molded onto a respective end of a suspension bar.

58. A file folder according to any one embodiment of embodiment 54 through the immediately preceding embodiment, wherein the hangers attached to the ends of the at least one suspension bar have a bend such that a tab of a conventional manila folder having a fold resting on the bottom of the file folder when the file folder is suspended from rails inside the piece of office equipment is not bent when the piece of office equipment is closed.

59. A file folder according to any one embodiment of embodiment 54 through the immediately preceding embodiment, wherein the hangers attached to the ends of at least one suspension bar are cut with a bend such that at least one edge fold of the file folder is a substantial distance beneath the rail supporting portions of the hangers attached to the ends of the at least one suspension bar.

60. A file folder according to any one embodiment of embodiment 54 through the immediately preceding embodiment, wherein a tab of a conventional manila folder having a fold resting on the bottom of the file folder when the file folder is suspended from rails inside the piece of office equipment extends above at least one edge fold a distance sufficient to permit a user to read text on the tab without having to pull the manila folder from the file folder.

61. A file folder according to any one embodiment of embodiment 54 through the immediately preceding embodiment, wherein the hangers attached to the ends of the at least one suspension bar have a bend such that a tab of a manila folder having a height between a fold and a top of the tab of about 9.5 inches with the fold resting on the bottom of the file folder when the file folder is suspended from rails inside the piece of office equipment is not bent when the piece of office equipment is closed.

62. A file folder according to any one embodiment of embodiment 54 through the immediately preceding embodiment, wherein a tab of a manila folder having a height between a fold and the top of the tab of about 9.5 inches with the fold resting on the bottom of the file folder when the file folder is suspended from rails inside the piece of office equipment extends above at least one edge fold a distance sufficient to permit a user to read text on the tab without having to pull the manila folder from the file folder.

63. A file folder according to any one embodiment of embodiment 54 through the immediately preceding embodiment, wherein there is a distance of about 0.7 inches between the at least one edge fold and a top of a tab of a manila folder having a height between a fold and the top of the tab of about 9.5 inches with the fold resting on the bottom of the file folder when the file folder is suspended from rails inside the piece of office equipment.

64. A file folder according to any one embodiment of embodiment 54 through the immediately preceding embodiment, wherein there is a distance of at least 0.4 inches between the at least one edge fold and a top of a tab of a manila folder having a height between a fold and the top of the tab of about 9.5 inches with the fold resting on the bottom of the file folder when the file folder is suspended from rails inside the piece of office equipment.

65. A file folder according to any one embodiment of embodiment 54 through the immediately preceding embodiment, wherein there is a distance of at least 0.5 inches between the at least one edge fold and a top of a tab of a manila folder having a height between a fold and the top of the tab of about 9.5 inches with the fold resting on the bottom of the file folder when the file folder is suspended from rails inside the piece of office equipment.

66. A file folder according to any one embodiment of embodiment 54 through the immediately preceding embodiment, wherein there is a distance of at least 0.4 inches between the at least one edge fold and a top of a tab of a manila folder, along the entire length of the at least one edge fold beneath the tab, having a height between a fold and the top of the tab of about 9.5 inches with the fold resting on the bottom of the file folder when the file folder is suspended from rails inside the piece of office equipment.

67. A file folder according to any one embodiment of embodiment 54 through the immediately preceding embodiment, wherein there is a distance of at least 0.5 inches between the at least one edge fold and a top of a tab of a manila folder, along the entire length of the at least one edge fold beneath the tab, having a height between a fold and the top of the tab of about 9.5 inches with the fold resting on the bottom of the file folder when the file folder is suspended from rails inside the piece of office equipment.

68. A file folder according to any one embodiment of embodiment 54 through the immediately preceding embodiment, wherein the hangers attached to the ends of the at least one suspension bar have a bend such that the at least one edge fold of the file folder is beneath the rail supporting portion of the hangers attached to the ends of the at least one suspension bar by at least 0.25 inches.

69. A file folder according to any one embodiment of embodiment 54 through the immediately preceding embodiment, wherein the hangers attached to the ends of the at least one suspension bar have a bend such that the at least one edge fold of the file folder is beneath the rail supporting portion of the hangers attached to the ends of the at least one suspension bar by at least 0.4 inches.

70. A file folder according to any one embodiment of embodiment 54 through the immediately preceding embodiment, wherein the hangers attached to the ends of the at least one suspension bar have a bend such that the at least one edge fold of the file folder is beneath the rail supporting portion of the hangers attached to the ends of the at least one suspension bar by at least 0.47 inches.

71. A file folder according to any one embodiment of embodiment 54 through the immediately preceding embodiment, wherein the hangers attached to the ends of the at least one suspension bar have a bend such that the at least one edge fold of the file folder is beneath the rail supporting portion of the hangers attached to the ends of the at least one suspension bar by about 0.3 to 0.7 inches.

72. A file folder according to any one embodiment of embodiment 54 through the immediately preceding embodiment, wherein the hangers attached to the ends of the at least one suspension bar have a bend such that the at least one edge fold of the file folder is beneath the rail supporting portion of the hangers attached to the ends of the at least one suspension bar by about 0.47 to 0.52 inches.

73. A file folder according to any one embodiment of embodiment 54 through the immediately preceding embodiment, wherein the hangers attached to the ends of the at least one suspension bar have a bend such that the at least one edge fold of the file folder is beneath a top portion of the hangers attached to the ends of the at least one suspension bar by at least 0.25 inches.

74. A file folder according to any one embodiment of embodiment 54 through the immediately preceding embodiment, wherein the hangers attached to the ends of the at least one suspension bar have a bend such that the at least one edge fold of the file folder is beneath a top portion of the hangers attached to the ends of the at least one suspension bar by at least 0.5 inches.

75. A file folder according to any one embodiment of embodiment 54 through the immediately preceding embodiment, wherein the hangers attached to the ends of the at least one suspension bar have a bend such that the at least one edge fold of the file folder is beneath a top portion of the hangers attached to the ends of the at least one suspension bar by at least 0.6 inches.

76. A file folder according to any one embodiment of embodiment 54 through the immediately preceding embodiment, wherein the hangers attached to the ends of the at least one suspension bar have a bend such that the at least one edge fold of the file folder is beneath a top portion of the hangers attached to the ends of the at least one suspension bar by about 0.4 to 0.8 inches.

77. A file folder according to any one embodiment of embodiment 54 through the immediately preceding embodiment, wherein the hangers attached to the ends of the at least one suspension bar have a bend such that the at least one edge fold of the file folder is beneath a top portion of the hangers attached to the ends of the at least one suspension bar by about 0.61 to 0.63 inches.

78. A file folder according to any one embodiment of embodiment 54 through the immediately preceding embodiment, wherein the hangers attached to the ends of the at least one suspension bar have a bend such that a top of a tab of a conventional manila folder having a fold resting on the bottom of the file folder when the file folder is suspended from rails inside the piece of office equipment is above a top portion of the hangers attached to the ends of the at least one suspension bar by about 0.05 to 0.1 inches.

79. A file folder according to any one embodiment of embodiment 54 through the immediately preceding embodiment, wherein the hangers attached to the ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is above a top portion of the hangers attached to the ends of the at least one suspension bar by about 0.05 to 0.1 inches.

80. A file folder according to any one embodiment of embodiment 54 through the immediately preceding embodiment, wherein the hangers attached to the ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is above a top portion of the hangers attached to the ends of the at least one suspension bar by no more than 0.1 inches.

81. A file folder according to any one embodiment of embodiment 54 through the immediately preceding embodiment, wherein the hangers attached to the ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is above a top portion of the hangers attached to the ends of the at least one suspension bar by no more than 0.09 inches.

82. A file folder according to any one embodiment of embodiment 54 through the immediately preceding embodiment, wherein the hangers attached to the ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is above a top portion of the hangers attached to the ends of the at least one suspension bar by about 0.085 inches.

83. A file folder according to any one embodiment of embodiment 54 through the immediately preceding embodiment, wherein the hangers attached to the ends of the at least one suspension bar have a bend such that a top of a tab of a conventional manila folder having a fold resting on the bottom of the file folder when the file folder is suspended from rails inside the piece of office equipment is beneath a top portion of the hangers attached to the ends of the at least one suspension bar by about 0.05 to 0.1 inches.

84. A file folder according to any one embodiment of embodiment 54 through the immediately preceding embodiment, wherein the hangers attached to the ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is beneath a top portion of the hangers attached to the ends of the at least one suspension bar by about 0.05 to 0.1 inches.

85. A file folder according to any one embodiment of embodiment 54 through the immediately preceding embodiment, wherein the hangers attached to the ends of the at least one suspension bar have a bend such that a top of a tab of a conventional manila folder having a fold resting on the bottom of the file folder when the file folder is suspended from rails inside the piece of office equipment is substantially aligned with a top portion of the hangers attached to the ends of the at least one suspension bar.

86. A file folder according to any one embodiment of embodiment 54 through the immediately preceding embodiment, wherein the hangers attached to the ends of the at least one suspension bar have a bend such that a top of a tab of a manila folder having a height between a fold and the top of the tab of about 9.5 inches with the fold resting on the bottom of the file folder when the file folder is suspended from rails inside the piece of office equipment is substantially aligned with a top portion of the hangers attached to the ends of the at least one suspension bar.

87. A file folder according to any one embodiment of embodiment 54 through the immediately preceding embodiment, wherein the hangers attached to the ends of the at least one suspension bar have a bend such that an angle between the rail supporting portions of the hangers attached to the ends and the at least one edge fold is about 90 to 135 degrees.

88. A file folder according to any one embodiment of embodiment 54 through the immediately preceding embodiment, wherein the hangers attached to the ends of the at least one suspension bar have a bend such that an angle between the rail supporting portions of the hangers attached to the ends and the at least one edge fold is about 115 to 125 degrees.

89. A file folder according to any one embodiment of embodiment 54 through the immediately preceding embodiment, wherein the hangers attached to the ends of the at least one suspension bar have a bend such that an angle between the rail supporting portions of the hangers attached to the ends and the at least one edge fold is about 120 degrees.

90. A file folder according to any one embodiment of embodiment 54 through the immediately preceding embodiment further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder.

91. A file folder according to any one embodiment of embodiment 54 through the immediately preceding embodiment further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder and the user may read text on the removable tab above the tab of the manila folder.

92. A file folder according to any one embodiment of embodiment 54 through the immediately preceding embodiment, wherein the first pocket runs along the entire top edge of the first side of the file folder and the second pocket runs along the entire top edge of the second side of the file folder.

93. A file folder according to any one embodiment of embodiment 54 through the immediately preceding embodiment, wherein at least one pocket runs along at least one entire top edge of at least one side of the file folder.

94. A file folder according to any one embodiment of embodiment 54 through the immediately preceding embodiment further comprising at least one handle operatively connected to the file folder and configured such that a user may carry the file folder upright.

95. A file folder according to any one embodiment of embodiment 54 through the immediately preceding embodiment further comprising at least one handle operatively connected to at least one suspension bar and configured such that a user may carry the file folder upright.

96. A file folder according to any one embodiment of embodiment 54 through the immediately preceding embodiment further comprising at least one handle configured such that a user may carry the file folder upright, wherein the at least one handle is integrally formed as part of at least one suspension bar.

97. A file folder according to any one embodiment of embodiment 54 through the immediately preceding embodiment further comprising at least one handle configured such that a user may carry the file folder upright, wherein the at least one handle is formed from a set of bends in the at least one suspension bar.

98. A file folder according to any one embodiment of embodiment 54 through the immediately preceding embodiment further comprising at least one handle configured such that a user may carry the file folder upright, wherein the at least one handle is rounded and formed as part of at least one suspension bar.

99. A file folder according to any one embodiment of embodiment 54 through the immediately preceding embodiment further comprising at least one handle configured such that a user may carry the file folder upright, wherein the at least one handle protrudes through an opening in at least one of an edge fold, a side, and a pocket.

100. A file folder according to any one embodiment of embodiment 54 through the immediately preceding embodiment further comprising at least one handle configured such that a user may carry the file folder upright, wherein the at least one handle is formed from the sheet of material.

101. A file folder according to any one embodiment of embodiment 54 through the immediately preceding embodiment further comprising at least one handle configured such that a user may carry the file folder upright, wherein the at least one handle attaches to at least one suspension bar.

102. A file folder according to any one embodiment of embodiment 54 through the immediately preceding embodiment further comprising at least one handle configured such that a user may carry the file folder upright, wherein the at least one handle attaches to the sheet of material.

103. A file folder according to any one embodiment of embodiment 54 through the immediately preceding embodiment further comprising two handles configured such that a user may carry the file folder upright, wherein each handle is operatively connected to one of the suspension bars and configured such that a user may carry the file folder upright.

104. A file folder according to any one embodiment of embodiment 54 through the immediately preceding embodiment further comprising two handles configured such that a user may carry the file folder upright, wherein each handle is operatively connected to one of the sides and configured such that a user may carry the file folder upright.

105. A file folder according to any one embodiment of embodiment 54 through the immediately preceding embodiment further comprising at least one handle configured such that a user may carry the file folder upright, wherein the at least one handle is located at about the center of at least one suspension bar and configured such that a user may carry the file folder upright.

106. A file folder according to any one embodiment of embodiment 54 through the immediately preceding embodiment further comprising two handles configured such that a user may carry the file folder upright, wherein each handle is located at about the center of one of the suspension bars and configured such that a user may carry the file folder upright.

107. A file folder according to any one embodiment of embodiment 54 through the immediately preceding embodiment, wherein each suspension bar is stamped from a single piece of metal with any bends cut into the stamping.

108. A file folder according to any one embodiment of embodiment 54 through the immediately preceding embodiment, wherein each suspension bar is formed from a single piece of metal and any bends are formed by physically bending the metal piece.

109. A file folder according to any one embodiment of embodiment 54 through the immediately preceding embodiment, wherein each side of the file folder is trapezoidal and the sheet of material is formed from a paper die cut.

110. A file folder for use in a piece of office storage equipment, comprising:

a receptacle having a front wall, a rear wall, two sides, and a bottom, wherein the rear wall has a top edge;

a suspension bar having two ends, wherein the suspension bar is affixed to the top edge of the rear wall;

wherein each end of the suspension bar is exposed and has a rail supporting portion that enables the receptacle to suspend from rails inside the piece of office storage equipment; and wherein the exposed ends of the suspension bar are configured such that the edge fold of the rear wall is substantially beneath the rail supporting portions of the exposed ends of the suspension bar.

111. A file folder according to any one embodiment of embodiment 110 through the immediately preceding embodiment, wherein the rear wall has an edge fold forming a pocket along the top edge and the suspension bar is at least partially disposed within the pocket.

112. A file folder according to any one embodiment of embodiment 110 through the immediately preceding embodiment, wherein the exposed ends of the suspension bar have a bend such that a tab of a conventional manila folder having a fold resting on the bottom of the receptacle when the receptacle is suspended from rails inside the piece of office equipment is not bent when the piece of office equipment is closed.

113. A file folder according to any one embodiment of embodiment 110 through the immediately preceding embodiment, wherein the exposed ends of at least one suspension bar are cut with a bend such that the top edge of the rear wall is a substantial distance beneath the rail supporting portions of the exposed ends of the suspension bar.

114. A file folder according to any one embodiment of embodiment 110 through the immediately preceding embodiment, wherein a tab of a conventional manila folder having a fold resting on the bottom of the receptacle when the receptacle is suspended from rails inside the piece of office equipment extends above the top edge of the rear wall a distance sufficient to permit a user to read text on the tab without having to pull the manila folder from the receptacle.

115. A file folder according to any one embodiment of embodiment 110 through the immediately preceding embodiment, wherein the exposed ends of the suspension bar have a bend such that a tab of a manila folder having a height between a fold and a top of the tab of about 9.5 inches with the fold resting on the bottom of the receptacle when the receptacle is suspended from rails inside the piece of office equipment is not bent when the piece of office equipment is closed.

116. A file folder according to any one embodiment of embodiment 110 through the immediately preceding embodiment, wherein a tab of a manila folder having a height between a fold and the top of the tab of about 9.5 inches with the fold resting on the bottom of the receptacle when the receptacle is suspended from rails inside the piece of office equipment extends above the top edge of the rear wall a distance sufficient to permit a user to read text on the tab without having to pull the manila folder from the receptacle.

117. A file folder according to any one embodiment of embodiment 110 through the immediately preceding embodiment, wherein there is a distance of about 0.7 inches between the top edge of the rear wall and a top of a tab of a manila folder having a height between a fold and the top of the tab of about 9.5 inches with the fold resting on the bottom of the receptacle when the receptacle is suspended from rails inside the piece of office equipment.

118. A file folder according to any one embodiment of embodiment 110 through the immediately preceding embodiment, wherein there is a distance of at least 0.4 inches between the top edge of the rear wall and a top of a tab of a manila folder having a height between a fold and the top of the tab of about 9.5 inches with the fold resting on the bottom of the receptacle when the receptacle is suspended from rails inside the piece of office equipment.

119. A file folder according to any one embodiment of embodiment 110 through the immediately preceding embodiment, wherein there is a distance of at least 0.5 inches between the top edge of the rear wall and a top of a tab of a manila folder having a height between a fold and the top of the tab of about 9.5 inches with the fold resting on the bottom of the receptacle when the receptacle is suspended from rails inside the piece of office equipment.

120. A file folder according to any one embodiment of embodiment 110 through the immediately preceding embodiment, wherein there is a distance of at least 0.4 inches between the top edge of the rear wall and a top of a tab of a manila folder, along the entire length of the top edge of the rear wall beneath the tab, having a height between a fold and the top of the tab of about 9.5 inches with the fold resting on the bottom of the receptacle when the receptacle is suspended from rails inside the piece of office equipment.

121. A file folder according to any one embodiment of embodiment 110 through the immediately preceding embodiment, wherein there is a distance of at least 0.5 inches between the top edge of the rear wall and a top of a tab of a manila folder, along the entire length of the top edge of the rear wall beneath the tab, having a height between a fold and the top of the tab of about 9.5 inches with the fold resting on the bottom of the receptacle when the receptacle is suspended from rails inside the piece of office equipment.

122. A file folder according to any one embodiment of embodiment 110 through the immediately preceding embodiment, wherein the exposed ends of the suspension bar have a bend such that the top edge of the rear wall of the file folder is beneath the rail supporting portion of the exposed ends of the suspension bar by at least 0.25 inches.

123. A file folder according to any one embodiment of embodiment 110 through the immediately preceding embodiment, wherein the exposed ends of the suspension bar have a bend such that the top edge of the rear wall of the file folder is beneath the rail supporting portion of the exposed ends of the suspension bar by at least 0.4 inches.

124. A file folder according to any one embodiment of embodiment 110 through the immediately preceding embodiment, wherein the exposed ends of the suspension bar have a bend such that the top edge of the rear wall of the file folder is beneath the rail supporting portion of the exposed ends of the suspension bar by at least 0.47 inches.

125. A file folder according to any one embodiment of embodiment 110 through the immediately preceding embodiment, wherein the exposed ends of the suspension bar have a bend such that the top edge of the rear wall of the file folder is beneath the rail supporting portion of the exposed ends of the suspension bar by about 0.3 to 0.7 inches.

126. A file folder according to any one embodiment of embodiment 110 through the immediately preceding embodiment, wherein the exposed ends of the suspension bar have a bend such that the top edge of the rear wall of the file folder is beneath the rail supporting portion of the exposed ends of the suspension bar by about 0.47 to 0.52 inches.

127. A file folder according to any one embodiment of embodiment 110 through the immediately preceding embodiment, wherein the exposed ends of the suspension bar have a bend such that the top edge of the rear wall of the file folder is beneath a top portion of the exposed ends of the suspension bar by at least 0.25 inches.

128. A file folder according to any one embodiment of embodiment 110 through the immediately preceding embodiment, wherein the exposed ends of the suspension bar have a bend such that the top edge of the rear wall of the file folder is beneath a top portion of the exposed ends of the suspension bar by at least 0.5 inches.

129. A file folder according to any one embodiment of embodiment 110 through the immediately preceding embodiment, wherein the exposed ends of the suspension bar have a bend such that the top edge of the rear wall of the file folder is beneath a top portion of the exposed ends of the suspension bar by at least 0.6 inches.

130. A file folder according to any one embodiment of embodiment 110 through the immediately preceding embodiment, wherein the exposed ends of the suspension bar have a bend such that the top edge of the rear wall of the file folder is beneath a top portion of the exposed ends of the suspension bar by about 0.4 to 0.8 inches.

131. A file folder according to any one embodiment of embodiment 110 through the immediately preceding embodiment, wherein the exposed ends of the suspension bar have a bend such that the top edge of the rear wall of the file folder is beneath a top portion of the exposed ends of the suspension bar by about 0.61 to 0.63 inches.

132. A file folder according to any one embodiment of embodiment 110 through the immediately preceding embodiment, wherein the exposed ends of the suspension bar have a bend such that a top of a tab of a conventional manila folder having a fold resting on the bottom of the receptacle when the receptacle is suspended from rails inside the piece of office equipment is above a top portion of the exposed ends of the suspension bar by about 0.05 to 0.1 inches.

133. A file folder according to any one embodiment of embodiment 110 through the immediately preceding embodiment, wherein the exposed ends of the suspension bar have a bend such that a top of a tab of a manila folder having a height between a fold and the top of the tab of about 9.5 inches with the fold resting on the bottom of the receptacle when the receptacle is suspended from rails inside the piece of office equipment is above a top portion of the exposed ends of the suspension bar by about 0.05 to 0.1 inches.

134. A file folder according to any one embodiment of embodiment 110 through the immediately preceding embodiment, wherein the exposed ends of the suspension bar have a bend such that a top of a tab of a manila folder having a height between a fold and the top of the tab of about 9.5 inches with the fold resting on the bottom of the receptacle when the receptacle is suspended from rails inside the piece of office equipment is above a top portion of the exposed ends of the suspension bar by no more than 0.1 inches.

135. A file folder according to any one embodiment of embodiment 110 through the immediately preceding embodiment, wherein the exposed ends of the suspension bar have a bend such that a top of a tab of a manila folder having a height between a fold and the top of the tab of about 9.5 inches with the fold resting on the bottom of the receptacle when the receptacle is suspended from rails inside the piece of office equipment is above a top portion of the exposed ends of the suspension bar by no more than 0.09 inches.

136. A file folder according to any one embodiment of embodiment 110 through the immediately preceding embodiment, wherein the exposed ends of the suspension bar have a bend such that a top of a tab of a manila folder having a height between a fold and the top of the tab of about 9.5 inches with the fold resting on the bottom of the receptacle when the receptacle is suspended from rails inside the piece of office equipment is above a top portion of the exposed ends of the suspension bar by about 0.085 inches.

137. A file folder according to any one embodiment of embodiment 110 through the immediately preceding embodiment, wherein the exposed ends of the suspension bar have a bend such that a top of a tab of a conventional manila folder having a fold resting on the bottom of the receptacle when the receptacle is suspended from rails inside the piece of office equipment is beneath a top portion of the exposed ends of the suspension bar by about 0.05 to 0.1 inches.

138. A file folder according to any one embodiment of embodiment 110 through the immediately preceding embodiment, wherein the exposed ends of the suspension bar have a bend such that a top of a tab of a manila folder having a height between a fold and the top of the tab of about 9.5 inches with the fold resting on the bottom of the receptacle when the receptacle is suspended from rails inside the piece of office equipment is beneath a top portion of the exposed ends of the suspension bar by about 0.05 to 0.1 inches.

139. A file folder according to any one embodiment of embodiment 110 through the immediately preceding embodiment, wherein the exposed ends of the suspension bar have a bend such that a top of a tab of a conventional manila folder having a fold resting on the bottom of the receptacle when the receptacle is suspended from rails inside the piece of office equipment is substantially aligned with a top portion of the exposed ends of the suspension bar.

140. A file folder according to any one embodiment of embodiment 110 through the immediately preceding embodiment, wherein the exposed ends of the suspension bar have a bend such that a top of a tab of a manila folder having a height between a fold and the top of the tab of about 9.5 inches with the fold resting on the bottom of the receptacle when the receptacle is suspended from rails inside the piece of office equipment is substantially aligned with a top portion of the exposed ends of the suspension bar.

141. A file folder according to any one embodiment of embodiment 110 through the immediately preceding embodiment, wherein the exposed ends of the suspension bar have a bend such that an angle between the rail supporting portions of the exposed ends and the top edge of the rear wall is about 90 to 135 degrees.

142. A file folder according to any one embodiment of embodiment 110 through the immediately preceding embodiment, wherein the exposed ends of the suspension bar have a bend such that an angle between the rail supporting portions of the exposed ends and the top edge of the rear wall is about 115 to 125 degrees.

143. A file folder according to any one embodiment of embodiment 110 through the immediately preceding embodiment, wherein the exposed ends of the suspension bar have a bend such that an angle between the rail supporting portions of the exposed ends and the top edge of the rear wall is about 120 degrees.

144. A file folder according to any one embodiment of embodiment 110 through the immediately preceding embodiment further comprising a removable tab attached to at least one wall such that a label within the removable tab may be read by a user when the receptacle is suspended from rails inside the piece of office equipment with a conventional manila folder resting on the bottom of the receptacle and the tab of the manila folder extends above the top edge of the rear wall a distance sufficient to permit a user to read text on the tab without having to pull the manila folder from the receptacle.

145. A file folder according to any one embodiment of embodiment 110 through the immediately preceding embodiment further comprising a removable tab attached to at least one wall such that a label within the removable tab may be read by a user when the receptacle is suspended from rails inside the piece of office equipment with a conventional manila folder resting on the bottom of the receptacle and the tab of the manila folder extends above the top edge of the rear wall a distance sufficient to permit a user to read text on the tab without having to pull the manila folder from the receptacle and the user may read text on the removable tab above the tab of the manila folder.

146. A file folder according to any one embodiment of embodiment 110 through the immediately preceding embodiment, wherein at least one pocket runs along the entire top 147. A file folder according to any one embodiment of embodiment 110 through the immediately preceding embodiment further comprising at least one handle operatively connected to the file folder and configured such that a user may carry the file folder upright.

148. A file folder according to any one embodiment of embodiment 110 through the immediately preceding embodiment further comprising at least one handle operatively connected to the suspension bar and configured such that a user may carry the file folder upright.

149. A file folder according to any one embodiment of embodiment 110 through the immediately preceding embodiment further comprising at least one handle configured such that a user may carry the file folder upright, wherein the at least one handle is integrally fanned as part of the suspension bar.

150. A file folder according to any one embodiment of embodiment 110 through the immediately preceding embodiment further comprising at least one handle configured such that a user may carry the file folder upright, wherein the at least one handle is formed from a set of bends in the suspension bar.

151. A file folder according to any one embodiment of embodiment 110 through the immediately preceding embodiment further comprising at least one handle configured such that a user may carry the file folder upright, wherein the at least one handle is rounded and formed as part of the suspension bar.

152. A file folder according to any one embodiment of embodiment 110 through the immediately preceding embodiment further comprising at least one handle configured such that a user may carry the file folder upright, wherein the at least one handle protrudes through an opening in at least one of an edge fold, the rear wall, and a pocket.

153. A file folder according to any one embodiment of embodiment 110 through the immediately preceding embodiment further comprising at least one handle configured such that a user may carry the file folder upright, wherein the at least one handle is formed from the receptacle.

154. A file folder according to any one embodiment of embodiment 110 through the immediately preceding embodiment further comprising at least one handle configured such that a user may carry the file folder upright, wherein the at least one handle attaches to the suspension bar.

155. A file folder according to any one embodiment of embodiment 110 through the immediately preceding embodiment further comprising at least one handle configured such that a user may carry the file folder upright, wherein the at least one handle attaches to the receptacle.

156. A file folder according to any one embodiment of embodiment 110 through the immediately preceding embodiment further comprising two handles configured such that a user may carry the file folder upright, wherein at least one handle is operatively connected to the suspension bar and configured such that a user may carry the file folder upright.

157. A file folder according to any one embodiment of embodiment 110 through the immediately preceding embodiment further comprising two handles configured such that a user may carry the file folder upright, wherein at least one handle is operatively connected to the receptacle and configured such that a user may carry the file folder upright.

158. A file folder according to any one embodiment of embodiment 110 through the immediately preceding embodiment further comprising at least one handle configured such that a user may carry the file folder upright, wherein the at least one handle is located at about the center of the suspension bar and configured such that a user may carry the file folder upright.

159. A file folder according to any one embodiment of embodiment 110 through the immediately preceding embodiment further comprising at least one handle configured such that a user may carry the file folder upright, wherein the at least one handle is located at about the center of one of the top edge of the rear wall and configured such that a user may carry the file folder upright.

160. A file folder according to any one embodiment of embodiment 110 through the immediately preceding embodiment, wherein the suspension bar is stamped from a single piece of metal with the bends cut into the stamping.

161. A file folder according to any one embodiment of embodiment 110 through the immediately preceding embodiment, wherein the suspension bar is formed from a single piece of metal and the bends are formed by physically bending the metal piece.

162. A file folder according to any one embodiment of embodiment 110 through the immediately preceding embodiment, wherein each wall of the receptacle is trapezoidal.

163. A file folder for use in a piece of office storage equipment, comprising:

a sheet of material having a central fold, a first edge fold, and a second edge fold, wherein the central fold forms a bottom, a first side, and a second side of the file folder, the first edge fold forms a first pocket along a top edge of the first side of the file folder, and the second edge fold forms a second pocket along a top edge of the second side of the file folder;

four hangers, wherein two hangers are operatively connected to the first side and at least partially disposed within the first pocket and two hangers are operatively connected to the second side and at least partially disposed within the second pocket;

wherein a hanging end of each hanger is movable from a collapsed position to a hanging position;

wherein the hanging end of each hanger is exposed when in the hanging position and has a rail supporting portion that enables the file folder to suspend from rails inside the piece of office storage equipment;

wherein the hanging end of each hanger has a bend such that at least one edge fold of the file folder is a substantial distance beneath the rail supporting portion of the hanging end of each hanger.

164. A file folder according to any one embodiment of embodiment 163 through the immediately preceding embodiment, wherein an actuating end of at least one hanger is exposed when the at least one hanger is in the collapsed position such that the user may use the actuating end to pivot the at least one hanger towards the hanging position.

165. A file folder according to any one embodiment of embodiment 163 through the immediately preceding embodiment, wherein an actuating end protrudes through an opening in at least one edge fold.

166. A file folder according to any one embodiment of embodiment 163 through the immediately preceding embodiment, wherein at least one hanger is pinched within at least one pocket such that a user must apply a force on the at least one hanger to pivot the at least one hanger relative to the sheet of material.

167. A file folder according to any one embodiment of embodiment 163 through the immediately preceding embodiment, wherein the hanging end of each hanger has a bend such that a tab of a conventional manila folder having a fold resting on the bottom of the file folder when the file folder is suspended from rails inside the piece of office equipment is not bent when the piece of office equipment is closed.

168. A file folder according to any one embodiment of embodiment 163 through the immediately preceding embodiment, wherein the hanging end of each hanger is cut with a bend such that at least one edge fold of the file folder is a substantial distance beneath the rail supporting portions of the hanging end of each hanger.

169. A file folder according to any one embodiment of embodiment 163 through the immediately preceding embodiment, wherein a tab of a conventional manila folder having a fold resting on the bottom of the file folder when the file folder is suspended from rails inside the piece of office equipment extends above at least one edge fold a distance sufficient to permit a user to read text on the tab without having to pull the manila folder from the file folder.

170. A file folder according to any one embodiment of embodiment 163 through the immediately preceding embodiment, wherein the hanging end of each hanger has a bend such that a tab of a manila folder having a height between a fold and a top of the tab of about 9.5 inches with the fold resting on the bottom of the file folder when the file folder is suspended from rails inside the piece of office equipment is not bent when the piece of office equipment is closed.

171. A file folder according to any one embodiment of embodiment 163 through the immediately preceding embodiment, wherein a tab of a manila folder having a height between a fold and the top of the tab of about 9.5 inches with the fold resting on the bottom of the file folder when the file folder is suspended from rails inside the piece of office equipment extends above at least one edge fold a distance sufficient to permit a user to read text on the tab without having to pull the manila folder from the file folder.

172. A file folder according to any one embodiment of embodiment 163 through the immediately preceding embodiment, wherein there is a distance of about 0.7 inches between the at least one edge fold and a top of a tab of a manila folder having a height between a fold and the top of the tab of about 9.5 inches with the fold resting on the bottom of the file folder when the file folder is suspended from rails inside the piece of office equipment.

173. A file folder according to any one embodiment of embodiment 163 through the immediately preceding embodiment, wherein there is a distance of at least 0.4 inches between the at least one edge fold and a top of a tab of a manila folder having a height between a fold and the top of the tab of about 9.5 inches with the fold resting on the bottom of the file folder when the file folder is suspended from rails inside the piece of office equipment.

174. A file folder according to any one embodiment of embodiment 163 through the immediately preceding embodiment, wherein there is a distance of at least 0.5 inches between the at least one edge fold and a top of a tab of a manila folder having a height between a fold and the top of the tab of about 9.5 inches with the fold resting on the bottom of the file folder when the file folder is suspended from rails inside the piece of office equipment.

175. A file folder according to any one embodiment of embodiment 163 through the immediately preceding embodiment, wherein there is a distance of at least 0.4 inches between the at least one edge fold and a top of a tab of a manila folder, along the entire length of the at least one edge fold beneath the tab, having a height between a fold and the top of the tab of about 9.5 inches with the fold resting on the bottom of the file folder when the file folder is suspended from rails inside the piece of office equipment.

176. A file folder according to any one embodiment of embodiment 163 through the immediately preceding embodiment, wherein there is a distance of at least 0.5 inches between the at least one edge fold and a top of a tab of a manila folder, along the entire length of the at least one edge fold beneath the tab, having a height between a fold and the top of the tab of about 9.5 inches with the fold resting on the bottom of the file folder when the file folder is suspended from rails inside the piece of office equipment.

177. A file folder according to any one embodiment of embodiment 163 through the immediately preceding embodiment, wherein the hanging end of each hanger has a bend such that the at least one edge fold of the file folder is beneath the rail supporting portion of the hanging end of each hanger by at least 0.25 inches.

178. A file folder according to any one embodiment of embodiment 163 through the immediately preceding embodiment, wherein the hanging end of each hanger has a bend such that the at least one edge fold of the file folder is beneath the rail supporting portion of the hanging end of each hanger by at least 0.4 inches.

179. A file folder according to any one embodiment of embodiment 163 through the immediately preceding embodiment, wherein the hanging end of each hanger has a bend such that the at least one edge fold of the file folder is beneath the rail supporting portion of the hanging end of each hanger by at least 0.47 inches.

180. A file folder according to any one embodiment of embodiment 163 through the immediately preceding embodiment, wherein the hanging end of each hanger has a bend such that the at least one edge fold of the file folder is beneath the rail supporting portion of the hanging end of each hanger by about 0.3 to 0.7 inches.

181. A file folder according to any one embodiment of embodiment 163 through the immediately preceding embodiment, wherein the hanging end of each hanger has a bend such that the at least one edge fold of the file folder is beneath the rail supporting portion of the hanging end of each hanger by about 0.47 to 0.52 inches.

182. A file folder according to any one embodiment of embodiment 163 through the immediately preceding embodiment, wherein the hanging end of each hanger has a bend such that the at least one edge fold of the file folder is beneath a top portion of the hanging end of each hanger by at least 0.25 inches.

183. A file folder according to any one embodiment of embodiment 163 through the immediately preceding embodiment, wherein the hanging end of each hanger has a bend such that the at least one edge fold of the file folder is beneath a top portion of the hanging end of each hanger by at least 0.5 inches.

184. A file folder according to any one embodiment of embodiment 163 through the immediately preceding embodiment, wherein the hanging end of each hanger has a bend such that the at least one edge fold of the file folder is beneath a top portion of the hanging end of each hanger by at least 0.6 inches.

185. A file folder according to any one embodiment of embodiment 163 through the immediately preceding embodiment, wherein the hanging end of each hanger has a bend such that the at least one edge fold of the file folder is beneath a top portion of the hanging end of each hanger by about 0.4 to 0.8 inches.

186. A file folder according to any one embodiment of embodiment 163 through the immediately preceding embodiment, wherein the hanging end of each hanger has a bend such that the at least one edge fold of the file folder is beneath a top portion of the hanging end of each hanger by about 0.61 to 0.63 inches.

187. A file folder according to any one embodiment of embodiment 163 through the immediately preceding embodiment, wherein the hanging end of each hanger has a bend such that a top of a tab of a conventional manila folder having a fold resting on the bottom of the file folder when the file folder is suspended from rails inside the piece of office equipment is above a top portion of the hanging end of each hanger by about 0.05 to 0.1 inches.

188. A file folder according to any one embodiment of embodiment 163 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is above a top portion of the hanging end of each hanger by about 0.05 to 0.1 inches.

189. A file folder according to any one embodiment of embodiment 163 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is above a top portion of the hanging end of each hanger by no more than 0.1 inches.

190. A file folder according to any one embodiment of embodiment 163 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is above a top portion of the hanging end of each hanger by no more than 0.09 inches.

191. A file folder according to any one embodiment of embodiment 163 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is above a top portion of the hanging end of each hanger by about 0.085 inches.

192. A file folder according to any one embodiment of embodiment 163 through the immediately preceding embodiment, wherein the hanging end of each hanger has a bend such that a top of a tab of a conventional manila folder having a fold resting on the bottom of the file folder when the file folder is suspended from rails inside the piece of office equipment is beneath a top portion of the hanging end of each hanger by about 0.05 to 0.1 inches.

193. A file folder according to any one embodiment of embodiment 163 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is beneath a top portion of the hanging end of each hanger by about 0.05 to 0.1 inches.

194. A file folder according to any one embodiment of embodiment 163 through the immediately preceding embodiment, wherein the hanging end of each hanger has a bend such that a top of a tab of a conventional manila folder having a fold resting on the bottom of the file folder when the file folder is suspended from rails inside the piece of office equipment is substantially aligned with a top portion of the hanging end of each hanger.

195. A file folder according to any one embodiment of embodiment 163 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is substantially aligned with a top portion of the hanging end of each hanger.

196. A file folder according to any one embodiment of embodiment 163 through the immediately preceding embodiment, wherein the hanging end of each hanger has a bend such that an angle between the rail supporting portions of the hanging end of each hanger and the at least one edge fold is about 90 to 135 degrees.

197. A file folder according to any one embodiment of embodiment 163 through the immediately preceding embodiment, wherein the hanging end of each hanger has a bend such that an angle between the rail supporting portions of the hanging end of each hanger and the at least one edge fold is about 115 to 125 degrees.

198. A file folder according to any one embodiment of embodiment 163 through the immediately preceding embodiment, wherein the hanging end of each hanger has a bend such that an angle between the rail supporting portions of the hanging end of each hanger and the at least one edge fold is about 120 degrees.

199. A file folder according to any one embodiment of embodiment 163 through the immediately preceding embodiment further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder.

200. A file folder according to any one embodiment of embodiment 163 through the immediately preceding embodiment further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder and the user may read text on the removable tab above the tab of the manila folder.

201. A file folder according to any one embodiment of embodiment 163 through the immediately preceding embodiment, wherein the first pocket runs along the entire top edge of the first side of the file folder and the second pocket runs along the entire top edge of the second side of the file folder.

202. A file folder according to any one embodiment of embodiment 163 through the immediately preceding embodiment, wherein at least one pocket runs along at least one entire top edge of at least one side of the file folder.

203. A file folder according to any one embodiment of embodiment 163 through the immediately preceding embodiment further comprising at least one handle operatively connected to the file folder and configured such that a user may carry the file folder upright.

204. A file folder according to any one embodiment of embodiment 163 through the immediately preceding embodiment further comprising at least one handle operatively connected to at least one suspension bar and configured such that a user may carry the file folder upright.

205. A file folder according to any one embodiment of embodiment 163 through the immediately preceding embodiment further comprising at least one handle configured such that a user may carry the file folder upright, wherein the at least one handle is integrally formed as part of at least one suspension bar.

206. A file folder according to any one embodiment of embodiment 163 through the immediately preceding embodiment further comprising at least one handle configured such that a user may carry the file folder upright, wherein the at least one handle is formed from a set of bends in at least one suspension bar.

207. A file folder according to any one embodiment of embodiment 163 through the immediately preceding embodiment further comprising at least one handle configured such that a user may carry the file folder upright, wherein the at least one handle is rounded and formed as part of at least one suspension bar.

208. A file folder according to any one embodiment of embodiment 163 through the immediately preceding embodiment further comprising at least one handle configured such that a user may carry the file folder upright, wherein the at least one handle protrudes through an opening in at least one of an edge fold, a side, and a pocket.

209. A file folder according to any one embodiment of embodiment 163 through the immediately preceding embodiment further comprising at least one handle configured such that a user may carry the file folder upright, wherein the at least one handle is formed from the sheet of material.

210. A file folder according to any one embodiment of embodiment 163 through the immediately preceding embodiment further comprising at least one handle configured such that a user may carry the file folder upright, wherein the at least one handle attaches to at least one suspension bar.

211. A file folder according to any one embodiment of embodiment 163 through the immediately preceding embodiment further comprising at least one handle configured such that a user may carry the file folder upright, wherein the at least one handle attaches to the sheet of material.

212. A file folder according to any one embodiment of embodiment 163 through the immediately preceding embodiment further comprising two handles configured such that a user may carry the file folder upright, wherein each handle is operatively connected to a suspension bar and configured such that a user may carry the file folder upright.

213. A file folder according to any one embodiment of embodiment 163 through the immediately preceding embodiment further comprising two handles configured such that a user may carry the file folder upright, wherein each handle is operatively connected to one of the sides and configured such that a user may carry the file folder upright.

214. A file folder according to any one embodiment of embodiment 163 through the immediately preceding embodiment further comprising at least one handle configured such that a user may carry the file folder upright, wherein the at least one handle is located at about the center of at least one suspension bar and configured such that a user may carry the file folder upright.

215. A file folder according to any one embodiment of embodiment 163 through the immediately preceding embodiment further comprising two handles configured such that a user may carry the file folder upright, wherein each handle is located at about the center of a suspension bar and configured such that a user may carry the file folder upright.

216. A file folder according to any one embodiment of embodiment 163 through the immediately preceding embodiment, wherein each hanger is stamped from a single piece of metal with the bends cut into the stamping.

217. A file folder according to any one embodiment of embodiment 163 through the immediately preceding embodiment, wherein each hanger is formed from a single piece of metal and the bends are formed by physically bending the metal piece.

218. A file folder according to any one embodiment of embodiment 163 through the immediately preceding embodiment, wherein each side of the file folder is trapezoidal and the sheet of material is formed from a paper die cut.

219. A file folder for use in a piece of office storage equipment, comprising:

a sheet of material having a central fold, a first edge fold, and a second edge fold, wherein the central fold forms a bottom, a first side, and a second side of the file folder, the first edge fold forms a first pocket along a top edge of the first side of the file folder, and the second edge fold forms a second pocket along a top edge of the second side of the file folder;

four hangers, wherein two hangers are operatively connected to the first side and at least partially disposed within the first pocket and two hangers are operatively connected to the second side and at least partially disposed within the second pocket;

wherein a hanging end of each hanger is movable from a collapsed position to an extended position; and wherein the hanging end of each hanger is exposed when in the extended position and has a rail supporting portion that enables the file folder to suspend from rails inside the piece of office storage equipment.

220. A file folder according to any one embodiment of embodiment 219 through the immediately preceding embodiment, wherein an actuating end of at least one hanger is exposed when the at least one hanger is in the collapsed position such that the user may use the actuating end to pivot the at least one hanger towards the hanging position.

221. A file folder according to any one embodiment of embodiment 219 through the immediately preceding embodiment, wherein an actuating end protrudes through an opening in at least one edge fold.

222. A file folder according to any one embodiment of embodiment 219 through the immediately preceding embodiment, wherein at least one hanger is pinched within at least one pocket such that a user must apply a force on the at least one hanger to pivot the at least one hanger relative to the sheet of material.

223. A file folder according to any one embodiment of embodiment 219 through the immediately preceding embodiment further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder.

224. A file folder according to any one embodiment of embodiment 219 through the immediately preceding embodiment further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder and the user may read text on the removable tab above the tab of the manila folder.

225. A file folder according to any one embodiment of embodiment 219 through the immediately preceding embodiment, wherein the first pocket runs along the entire top edge of the first side of the file folder and the second pocket runs along the entire top edge of the second side of the file folder.

226. A file folder according to any one embodiment of embodiment 219 through the immediately preceding embodiment, wherein at least one pocket runs along at least one entire top edge of at least one side of the file folder.

227. A file folder according to any one embodiment of embodiment 219 through the immediately preceding embodiment further comprising at least one handle operatively connected to the file folder and configured such that a user may carry the file folder upright.

228. A file folder according to any one embodiment of embodiment 219 through the immediately preceding embodiment further comprising at least one handle operatively connected to at least one suspension bar and configured such that a user may carry the file folder upright.

229. A file folder according to any one embodiment of embodiment 219 through the immediately preceding embodiment further comprising at least one handle configured such that a user may carry the file folder upright, wherein the at least one handle is integrally formed as part of at least one suspension bar.

230. A file folder according to any one embodiment of embodiment 219 through the immediately preceding embodiment further comprising at least one handle configured such that a user may carry the file folder upright, wherein the at least one handle is formed from a set of bends in at least one suspension bar.

231. A file folder according to any one embodiment of embodiment 219 through the immediately preceding embodiment further comprising at least one handle configured such that a user may carry the file folder upright, wherein the at least one handle is rounded and formed as part of at least one suspension bar.

232. A file folder according to any one embodiment of embodiment 219 through the immediately preceding embodiment further comprising at least one handle configured such that a user may carry the file folder upright, wherein the at least one handle protrudes through an opening in at least one of an edge fold, a side, and a pocket.

233. A file folder according to any one embodiment of embodiment 219 through the immediately preceding embodiment further comprising at least one handle configured such that a user may carry the file folder upright, wherein the at least one handle is formed from the sheet of material.

234. A file folder according to any one embodiment of embodiment 219 through the immediately preceding embodiment further comprising at least one handle configured such that a user may carry the file folder upright, wherein the at least one handle attaches to at least one suspension bar.

235. A file folder according to any one embodiment of embodiment 219 through the immediately preceding embodiment further comprising at least one handle configured such that a user may carry the file folder upright, wherein the at least one handle attaches to the sheet of material.

236. A file folder according to any one embodiment of embodiment 219 through the immediately preceding embodiment further comprising two handles configured such that a user may carry the file folder upright, wherein each handle is operatively connected to a suspension bar and configured such that a user may carry the file folder upright.

237. A file folder according to any one embodiment of embodiment 219 through the immediately preceding embodiment further comprising two handles configured such that a user may carry the file folder upright, wherein each handle is operatively connected to one of the sides and configured such that a user may carry the file folder upright.

238. A file folder according to any one embodiment of embodiment 219 through the immediately preceding embodiment further comprising at least one handle configured such that a user may carry the file folder upright, wherein the at least one handle is located at about the center of at least one suspension bar and configured such that a user may carry the file folder upright.

239. A file folder according to any one embodiment of embodiment 219 through the immediately preceding embodiment further comprising two handles configured such that a user may carry the file folder upright, wherein each handle is located at about the center of a suspension bar and configured such that a user may carry the file folder upright.

240. A file folder according to any one embodiment of embodiment 219 through the immediately preceding embodiment, wherein each hanger is stamped from a single piece of metal and any bends are cut into the stamping.

241. A file folder according to any one embodiment of embodiment 219 through the immediately preceding embodiment, wherein each hanger is formed from a single piece of metal and any bends are formed by physically bending the metal piece.

242. A file folder according to any one embodiment of embodiment 219 through the immediately preceding embodiment, wherein each side of the file folder is trapezoidal and the sheet of material is formed from a paper die cut.

243. A file folder for use in a piece of office storage equipment, comprising:

a sheet of material having a central fold, a first edge fold, and a second edge fold, wherein the central fold forms a bottom, a first side, and a second side of the file folder, the first edge fold forms a first pocket along a top edge of the first side of the file folder, and the second edge fold forms a second pocket along a top edge of the second side of the file folder;

four hangers, wherein two hangers are operatively connected to the first side and at least partially disposed within the first pocket and two hangers are operatively connected to the second side and at least partially disposed within the second pocket; and wherein the hanging end of each hanger is exposed and has a rail supporting portion that enables the file folder to suspend from rails inside the piece of office storage equipment.

244. A file folder according to any one embodiment of embodiment 243 through the immediately preceding embodiment further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder.

245. A file folder according to any one embodiment of embodiment 243 through the immediately preceding embodiment further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder and the user may read text on the removable tab above the tab of the manila folder.

246. A file folder according to any one embodiment of embodiment 243 through the immediately preceding embodiment, wherein the first pocket runs along the entire top edge of the first side of the file folder and the second pocket runs along the entire top edge of the second side of the file folder.

247. A file folder according to any one embodiment of embodiment 243 through the immediately preceding embodiment, wherein at least one pocket runs along at least one entire top edge of at least one side of the file folder.

248. A file folder according to any one embodiment of embodiment 243 through the immediately preceding embodiment further comprising at least one handle operatively connected to the file folder and configured such that a user may carry the file folder upright.

249. A file folder according to any one embodiment of embodiment 243 through the immediately preceding embodiment further comprising at least one handle operatively connected to at least one suspension bar and configured such that a user may carry the file folder upright.

250. A file folder according to any one embodiment of embodiment 243 through the immediately preceding embodiment further comprising at least one handle configured such that a user may carry the file folder upright, wherein the at least one handle is integrally formed as part of at least one suspension bar.

251. A file folder according to any one embodiment of embodiment 243 through the immediately preceding embodiment further comprising at least one handle configured such that a user may carry the file folder upright, wherein the at least one handle is formed from a set of bends in at least one suspension bar.

252. A file folder according to any one embodiment of embodiment 243 through the immediately preceding embodiment further comprising at least one handle configured such that a user may carry the file folder upright, wherein the at least one handle is rounded and formed as part of at least one suspension bar.

253. A file folder according to any one embodiment of embodiment 243 through the immediately preceding embodiment further comprising at least one handle configured such that a user may carry the file folder upright, wherein the at least one handle protrudes through an opening in at least one of an edge fold, a side, and a pocket.

254. A file folder according to any one embodiment of embodiment 243 through the immediately preceding embodiment further comprising at least one handle configured such that a user may carry the file folder upright, wherein the at least one handle is formed from the sheet of material.

255. A file folder according to any one embodiment of embodiment 243 through the immediately preceding embodiment further comprising at least one handle configured such that a user may carry the file folder upright, wherein the at least one handle attaches to at least one suspension bar.

256. A file folder according to any one embodiment of embodiment 243 through the immediately preceding embodiment further comprising at least one handle configured such that a user may carry the file folder upright, wherein the at least one handle attaches to the sheet of material.

257. A file folder according to any one embodiment of embodiment 243 through the immediately preceding embodiment further comprising two handles configured such that a user may carry the file folder upright, wherein each handle is operatively connected to a suspension bar and configured such that a user may carry the file folder upright.

258. A file folder according to any one embodiment of embodiment 243 through the immediately preceding embodiment further comprising two handles configured such that a user may carry the file folder upright, wherein each handle is operatively connected to one of the sides and configured such that a user may carry the file folder upright.

259. A file folder according to any one embodiment of embodiment 243 through the immediately preceding embodiment further comprising at least one handle configured such that a user may carry the file folder upright, wherein the at least one handle is located at about the center of at least one suspension bar and configured such that a user may carry the file folder upright.

260. A file folder according to any one embodiment of embodiment 243 through the immediately preceding embodiment further comprising two handles configured such that a user may carry the file folder upright, wherein each handle is located at about the center of a suspension bar and configured such that a user may carry the file folder upright.

261. A file folder according to any one embodiment of embodiment 243 through the immediately preceding embodiment, wherein each hanger is stamped from a single piece of metal and any bends are cut into the stamping.

262. A file folder according to any one embodiment of embodiment 243 through the immediately preceding embodiment, wherein each hanger is formed from a single piece of metal and any bends are formed by physically bending the metal piece.

263. A file folder according to any one embodiment of embodiment 243 through the immediately preceding embodiment, wherein each side of the file folder is trapezoidal and the sheet of material is formed from a paper die cut.

264. A file folder for use in a piece of office storage equipment, comprising:

a sheet of material having a central fold, a first edge fold, and a second edge fold, wherein the central fold forms a bottom, a first side, and a second side of the file folder, the first edge fold forms a first pocket along a top edge of the first side of the file folder, and the second edge fold forms a second pocket along a top edge of the second side of the file folder;

four hangers, wherein two hangers are operatively connected to the first side and at least partially disposed within the first pocket and two hangers are operatively connected to the second side and at least partially disposed within the second pocket;

wherein the hanging end of each hanger is exposed and has a rail supporting portion that enables the file folder to suspend from rails inside the piece of office storage equipment; and wherein the hanging end of each hanger has a bend such that at least one edge fold of the file folder is a substantial distance beneath the rail supporting portion of the hanging end of each hanger.

265. A file folder according to any one embodiment of embodiment 264 through the immediately preceding embodiment, wherein the hanging end of each hanger has a bend such that a tab of a conventional manila folder having a fold resting on the bottom of the file folder when the file folder is suspended from rails inside the piece of office equipment is not bent when the piece of office equipment is closed.

266. A file folder according to any one embodiment of embodiment 264 through the immediately preceding embodiment, wherein the hanging end of each hanger is cut with a bend such that at least one edge fold of the file folder is a substantial distance beneath the rail supporting portions of the hanging end of each hanger.

267. A file folder according to any one embodiment of embodiment 264 through the immediately preceding embodiment, wherein a tab of a conventional manila folder having a fold resting on the bottom of the file folder when the file folder is suspended from rails inside the piece of office equipment extends above at least one edge fold a distance sufficient to permit a user to read text on the tab without having to pull the manila folder from the file folder.

268. A file folder according to any one embodiment of embodiment 264 through the immediately preceding embodiment, wherein the hanging end of each hanger has a bend such that a tab of a manila folder having a height between a fold and a top of the tab of about 9.5 inches with the fold resting on the bottom of the file folder when the file folder is suspended from rails inside the piece of office equipment is not bent when the piece of office equipment is closed.

269. A file folder according to any one embodiment of embodiment 264 through the immediately preceding embodiment, wherein a tab of a manila folder having a height between a fold and the top of the tab of about 9.5 inches with the fold resting on the bottom of the file folder when the file folder is suspended from rails inside the piece of office equipment extends above at least one edge fold a distance sufficient to permit a user to read text on the tab without having to pull the manila folder from the file folder.

270. A file folder according to any one embodiment of embodiment 264 through the immediately preceding embodiment, wherein there is a distance of about 0.7 inches between the at least one edge fold and a top of a tab of a manila folder having a height between a fold and the top of the tab of about 9.5 inches with the fold resting on the bottom of the file folder when the file folder is suspended from rails inside the piece of office equipment.

271. A file folder according to any one embodiment of embodiment 264 through the immediately preceding embodiment, wherein there is a distance of at least 0.4 inches between the at least one edge fold and a top of a tab of a manila folder having a height between a fold and the top of the tab of about 9.5 inches with the fold resting on the bottom of the file folder when the file folder is suspended from rails inside the piece of office equipment.

272. A file folder according to any one embodiment of embodiment 264 through the immediately preceding embodiment, wherein there is a distance of at least 0.5 inches between the at least one edge fold and a top of a tab of a manila folder having a height between a fold and the top of the tab of about 9.5 inches with the fold resting on the bottom of the file folder when the file folder is suspended from rails inside the piece of office equipment.

273. A file folder according to any one embodiment of embodiment 264 through the immediately preceding embodiment, wherein there is a distance of at least 0.4 inches between the at least one edge fold and a top of a tab of a manila folder, along the entire length of the at least one edge fold beneath the tab, having a height between a fold and the top of the tab of about 9.5 inches with the fold resting on the bottom of the file folder when the file folder is suspended from rails inside the piece of office equipment.

274. A file folder according to any one embodiment of embodiment 264 through the immediately preceding embodiment, wherein there is a distance of at least 0.5 inches between the at least one edge fold and a top of a tab of a manila folder, along the entire length of the at least one edge fold beneath the tab, having a height between a fold and the top of the tab of about 9.5 inches with the fold resting on the bottom of the file folder when the file folder is suspended from rails inside the piece of office equipment.

275. A file folder according to any one embodiment of embodiment 264 through the immediately preceding embodiment, wherein the hanging end of each hanger has a bend such that the at least one edge fold of the file folder is beneath the rail supporting portion of the hanging end of each hanger by at least 0.25 inches.

276. A file folder according to any one embodiment of embodiment 264 through the immediately preceding embodiment, wherein the hanging end of each hanger has a bend such that the at least one edge fold of the file folder is beneath the rail supporting portion of the hanging end of each hanger by at least 0.4 inches.

277. A file folder according to any one embodiment of embodiment 264 through the immediately preceding embodiment, wherein the hanging end of each hanger has a bend such that the at least one edge fold of the file folder is beneath the rail supporting portion of the hanging end of each hanger by at least 0.47 inches.

278. A file folder according to any one embodiment of embodiment 264 through the immediately preceding embodiment, wherein the hanging end of each hanger has a bend such that the at least one edge fold of the file folder is beneath the rail supporting portion of the hanging end of each hanger by about 0.3 to 0.7 inches.

279. A file folder according to any one embodiment of embodiment 264 through the immediately preceding embodiment, wherein the hanging end of each hanger has a bend such that the at least one edge fold of the file folder is beneath the rail supporting portion of the hanging end of each hanger by about 0.47 to 0.52 inches.

280. A file folder according to any one embodiment of embodiment 264 through the immediately preceding embodiment, wherein the hanging end of each hanger has a bend such that the at least one edge fold of the file folder is beneath a top portion of the hanging end of each hanger by at least 0.25 inches.

281. A file folder according to any one embodiment of embodiment 264 through the immediately preceding embodiment, wherein the hanging end of each hanger has a bend such that the at least one edge fold of the file folder is beneath a top portion of the hanging end of each hanger by at least 0.5 inches.

282. A file folder according to any one embodiment of embodiment 264 through the immediately preceding embodiment, wherein the hanging end of each hanger has a bend such that the at least one edge fold of the file folder is beneath a top portion of the hanging end of each hanger by at least 0.6 inches.

283. A file folder according to any one embodiment of embodiment 264 through the immediately preceding embodiment, wherein the hanging end of each hanger has a bend such that the at least one edge fold of the file folder is beneath a top portion of the hanging end of each hanger by about 0.4 to 0.8 inches.

284. A file folder according to any one embodiment of embodiment 264 through the immediately preceding embodiment, wherein the hanging end of each hanger has a bend such that the at least one edge fold of the file folder is beneath a top portion of the hanging end of each hanger by about 0.61 to 0.63 inches.

285. A file folder according to any one embodiment of embodiment 264 through the immediately preceding embodiment, wherein the hanging end of each hanger has a bend such that a top of a tab of a conventional manila folder having a fold resting on the bottom of the file folder when the file folder is suspended from rails inside the piece of office equipment is above a top portion of the hanging end of each hanger by about 0.05 to 0.1 inches.

286. A file folder according to any one embodiment of embodiment 264 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is above a top portion of the hanging end of each hanger by about 0.05 to 0.1 inches.

287. A file folder according to any one embodiment of embodiment 264 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is above a top portion of the hanging end of each hanger by no more than 0.1 inches.

288. A file folder according to any one embodiment of embodiment 264 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is above a top portion of the hanging end of each hanger by no more than 0.09 inches.

289. A file folder according to any one embodiment of embodiment 264 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is above a top portion of the hanging end of each hanger by about 0.085 inches.

290. A file folder according to any one embodiment of embodiment 264 through the immediately preceding embodiment, wherein the hanging end of each hanger has a bend such that a top of a tab of a conventional manila folder having a fold resting on the bottom of the file folder when the file folder is suspended from rails inside the piece of office equipment is beneath a top portion of the hanging end of each hanger by about 0.05 to 0.1 inches.

291. A file folder according to any one embodiment of embodiment 264 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is beneath a top portion of the hanging end of each hanger by about 0.05 to 0.1 inches.

292. A file folder according to any one embodiment of embodiment 264 through the immediately preceding embodiment, wherein the hanging end of each hanger has a bend such that a top of a tab of a conventional manila folder having a fold resting on the bottom of the file folder when the file folder is suspended from rails inside the piece of office equipment is substantially aligned with a top portion of the hanging end of each hanger.

293. A file folder according to any one embodiment of embodiment 264 through the immediately preceding embodiment, wherein the hanging end of each hanger has a bend such that a top of a tab of a manila folder having a height between a fold and the top of the tab of about 9.5 inches with the fold resting on the bottom of the file folder when the file folder is suspended from rails inside the piece of office equipment is substantially aligned with a top portion of the hanging end of each hanger.

294. A file folder according to any one embodiment of embodiment 264 through the immediately preceding embodiment, wherein the hanging end of each hanger has a bend such that an angle between the rail supporting portions of the hanging end of each hanger and the at least one edge fold is about 90 to 135 degrees.

295. A file folder according to any one embodiment of embodiment 264 through the immediately preceding embodiment, wherein the hanging end of each hanger has a bend such that an angle between the rail supporting portions of the hanging end of each hanger and the at least one edge fold is about 115 to 125 degrees.

296. A file folder according to any one embodiment of embodiment 264 through the immediately preceding embodiment, wherein the hanging end of each hanger has a bend such that an angle between the rail supporting portions of the hanging end of each hanger and the at least one edge fold is about 120 degrees.

297. A file folder according to any one embodiment of embodiment 264 through the immediately preceding embodiment further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder.

298. A file folder according to any one embodiment of embodiment 264 through the immediately preceding embodiment further comprising a removable tab attached to at least one side such that a label within the removable tab may be read by a user when the file folder is suspended from rails inside the piece of office equipment with a conventional manila folder resting on the bottom of the file folder and the tab of the manila folder extends above the at least one edge fold a distance sufficient to permit a user to read text on the tab without having to pull the manila folder from the file folder and the user may read text on the removable tab above the tab of the manila folder.

299. A file folder according to any one embodiment of embodiment 264 through the immediately preceding embodiment, wherein the first pocket runs along the entire top edge of the first side of the file folder and the second pocket runs along the entire top edge of the second side of the file folder.

300. A file folder according to any one embodiment of embodiment 264 through the immediately preceding embodiment, wherein at least one pocket runs along at least one entire top edge of at least one side of the file folder.

301. A file folder according to any one embodiment of embodiment 264 through the immediately preceding embodiment further comprising at least one handle operatively connected to the file folder and configured such that a user may carry the file folder upright.

302. A file folder according to any one embodiment of embodiment 264 through the immediately preceding embodiment further comprising at least one handle operatively connected to at least one suspension bar and configured such that a user may carry the file folder upright.

303. A file folder according to any one embodiment of embodiment 264 through the immediately preceding embodiment further comprising at least one handle configured such that a user may carry the file folder upright, wherein the at least one handle is integrally formed as part of at least one suspension bar.

304. A file folder according to any one embodiment of embodiment 264 through the immediately preceding embodiment further comprising at least one handle configured such that a user may carry the file folder upright, wherein the at least one handle is formed from a set of bends in at least one suspension bar.

305. A file folder according to any one embodiment of embodiment 264 through the immediately preceding embodiment further comprising at least one handle configured such that a user may carry the file folder upright, wherein the at least one handle is rounded and formed as part of at least one suspension bar.

306. A file folder according to any one embodiment of embodiment 264 through the immediately preceding embodiment further comprising at least one handle configured such that a user may carry the file folder upright, wherein the at least one handle protrudes through an opening in at least one of an edge fold, a side, and a pocket.

307. A file folder according to any one embodiment of embodiment 264 through the immediately preceding embodiment further comprising at least one handle configured such that a user may carry the file folder upright, wherein the at least one handle is formed from the sheet of material.

308. A file folder according to any one embodiment of embodiment 264 through the immediately preceding embodiment further comprising at least one handle configured such that a user may carry the file folder upright, wherein the at least one handle attaches to at least one suspension bar.

309. A file folder according to any one embodiment of embodiment 264 through the immediately preceding embodiment further comprising at least one handle configured such that a user may carry the file folder upright, wherein the at least one handle attaches to the sheet of material.

310. A file folder according to any one embodiment of embodiment 264 through the immediately preceding embodiment further comprising two handles configured such that a user may carry the file folder upright, wherein each handle is operatively connected to a suspension bar and configured such that a user may carry the file folder upright.

311. A file folder according to any one embodiment of embodiment 264 through the immediately preceding embodiment further comprising two handles configured such that a user may carry the file folder upright, wherein each handle is operatively connected to one of the sides and configured such that a user may carry the file folder upright.

312. A file folder according to any one embodiment of embodiment 264 through the immediately preceding embodiment further comprising at least one handle configured such that a user may carry the file folder upright, wherein the at least one handle is located at about the center of at least one suspension bar and configured such that a user may carry the file folder upright.

313. A file folder according to any one embodiment of embodiment 264 through the immediately preceding embodiment further comprising two handles configured such that a user may carry the file folder upright, wherein each handle is located at about the center of a suspension bar and configured such that a user may carry the file folder upright.

314. A file folder according to any one embodiment of embodiment 264 through the immediately preceding embodiment, wherein each hanger is stamped from a single piece of metal with the bends cut into the stamping.

315. A file folder according to any one embodiment of embodiment 264 through the immediately preceding embodiment, wherein each hanger is formed from a single piece of metal and the bends are formed by physically bending the metal piece.

316. A file folder according to any one embodiment of embodiment 264 through the immediately preceding embodiment, wherein each side of the file folder is trapezoidal and the sheet of material is formed from a paper die cut.

317. A file folder for use in a piece of office storage equipment, comprising:

a sheet of material having two ends and two edges; and four hangers, wherein two hangers are operatively coupled to each end of the sheet of material.

318. A folder for use in a piece of office storage equipment, comprising:

a sheet of material having a top surface, a bottom surface, two ends, two longitudinal edges, two fold lines, and two tabs;

wherein a first tab is disposed along a first end and a second tab is disposed along a second end;

wherein the first tab is located within 3.5 inches from a first longitudinal edge and the second tab is located between about 2 and 6 inches from the first longitudinal edge;

wherein the distance from a top of the first tab to a top of the second tab defines a longitudinal length of the sheet;

wherein a first fold line is located between the first end and a midpoint of the longitudinal length of the sheet and a second fold line is located between the midpoint of the longitudinal length of the sheet and the second end; and wherein a first portion of the top surface is located between the first end and the first fold line and a second portion of the top surface is located between the second fold line and the second end.

319. A folder according to any one embodiment of embodiment 318 through the immediately preceding embodiment, wherein the first tab is located within 3.1 inches from a first longitudinal edge and the second tab is located between 2.5 and 5.7 inches from the first longitudinal edge.

320. A method of folding the sheet of material to produce four configurations of the folder, each configuration having a different location of at least one tab and allowing a user to read text on the at least one tab without having to pull the folder from a piece of office equipment, comprising the steps of:

folding the second portion of the top surface toward the first portion of the top surface along the second fold line to produce a first configuration of the folder, wherein the user may read text on a top surface of the first tab without having to pull the folder from the piece of office equipment;

folding the second portion of the top surface away from the first portion of the top surface along the first fold line to produce a second configuration of the folder, wherein the user may read text on a bottom surface of the second tab without having to pull the folder from the piece of office equipment;

folding the second portion of the top surface toward the first portion of the top surface along the first fold line to produce a third configuration of the folder, wherein the user may read text on a top surface of the second tab without having to pull the folder from the piece of office equipment; and folding the second portion of the top surface away from the first portion of the top surface along the second fold line to produce a fourth configuration of the folder, wherein the user may read text on a bottom surface of the first tab without having to pull the folder from the piece of office equipment.

321. A folder for use in a piece of office storage equipment, comprising:

a sheet of material having a top surface, a bottom surface, two ends, two longitudinal edges, two fold lines, and two tabs;

wherein a first tab is disposed along a first end and a second tab is disposed along a second end;

wherein the first tab is located within 4.5 inches from a first longitudinal edge and the second tab is located between about 3 and 8 inches from the first longitudinal edge;

wherein the distance from a top of the first tab to a top of the second tab defines a longitudinal length of the sheet;

wherein a first fold line is located between the first end and a midpoint of the longitudinal length of the sheet and a second fold line is located between the midpoint of the longitudinal length of the sheet and the second end; and wherein a first portion of the top surface is located between the first end and the first fold line and a second portion of the top surface is located between the second fold line and the second end.

322. A folder according to any one embodiment of embodiment 321 through the immediately preceding embodiment, wherein the first tab is located within 4.4 inches from a first longitudinal edge and the second tab is located between 3.8 and 7.8 inches from the first longitudinal edge.

323. A method of folding the sheet of material to produce three configurations of the folder, each configuration having a different location of at least one tab and allowing a user to read text on the at least one tab without having to pull the folder from a piece of office equipment, comprising the steps of:

folding the second portion of the top surface toward the first portion of the top surface along the second fold line to produce a first configuration of the folder, wherein the user may read text on a top surface of the first tab without having to pull the folder from the piece of office equipment;

folding the second portion of the top surface away from the first portion of the top surface along the first fold line to produce a second configuration of the folder, wherein the user may read text on a bottom surface of the second tab without having to pull the folder from the piece of office equipment; and folding the second portion of the top surface away from the first portion of the top surface along the second fold line to produce a third configuration of the folder, wherein the user may read text on a bottom surface of the first tab without having to pull the folder from the piece of office equipment.

324. A method according to any one embodiment of embodiment 323 through the immediately preceding embodiment further comprising the step of folding the second portion of the top surface toward the first portion of the top surface along the first fold line to produce a second configuration of the folder, wherein the user may read text on a top surface of the second tab without having to pull the folder from the piece of office equipment.

325. A folder for use in a piece of office storage equipment, comprising:

a sheet of material having a top surface, a bottom surface, two ends, two longitudinal edges, one fold line, and two tabs;

wherein a first tab is disposed along a first end and a second tab is disposed along a second end;

wherein the first tab is located within 5.8 inches from a first longitudinal edge and the second tab is located at least 5.6 inches from the first longitudinal edge;

wherein the distance from a top of the first tab to a top of the second tab defines a longitudinal length of the sheet;

wherein the fold line is located between a midpoint of the longitudinal length of the sheet and the second end; and wherein a first portion of the top surface is located between the first end and the fold line and a second portion of the top surface is located between the fold line and the second end.

326. A method of folding the sheet of material to produce two configurations of the folder, each configuration having a different location of at least one tab and allowing a user to read text on the at least one tab without having to pull the folder from a piece of office equipment, comprising the steps of:

folding the second portion of the top surface toward the first portion of the top surface along the fold line to produce a first configuration of the folder, wherein the user may read text on a top surface of the first tab without having to pull the folder from the piece of office equipment; and folding the second portion of the top surface away from the first portion of the top surface along the fold line to produce a second configuration of the folder, wherein the user may read text on a bottom surface of the first tab without having to pull the folder from the piece of office equipment.

327. A kit of folders, comprising:

at least two folders according to any one or more of the preceding embodiments; and folding instructions.

328. A sheet for a folder, comprising:

a sheet of material having a top surface, a bottom surface, first and second ends, two longitudinal edges, and first and second tabs, the sheet of material foldable along a central fold line into a file folder having one of the tabs extending at one of four locations opposite the central fold, with the tab extending from a top of the folder while the central fold is oriented at a bottom of the folder;

wherein the first tab is disposed along the first end of the sheet and the second tab is disposed along a second end of the sheet;

wherein, while the central fold is at a first fold location, the first tab is located at one of first and fourth locations opposite the central fold, and capable of extending at either the first location or the fourth location, depending on which direction the sheet is folded; and wherein, while the central fold is at a second fold location, the second tab is located at one of second and third locations opposite the central fold, and capable of extending at either the second location or the third location, depending on which direction the sheet is folded.

329. The sheet for a folder according to claim 328, wherein, while the central fold is at the first fold location, the first tab is located at the first location opposite the central fold, and extends at the first location, when the sheet is folded in a direction that results in the top surface being folded against itself.

330. The sheet for a folder according to any one embodiment of embodiment 328 through the immediately preceding embodiment, wherein, while the central fold is at the first fold location, the first tab is located at the fourth location opposite the central fold, and extends at the fourth location, when the sheet is folded in a direction that results in the bottom surface being folded against itself.

331. The sheet for a folder according to any one embodiment of embodiment 328 through the immediately preceding embodiment, wherein, while the central fold is at the second fold location, the second tab is located at the second location opposite the central fold, and extends at the second location, when the sheet is folded in a direction that results in the top surface being folded against itself.

332. The sheet for a folder according to any one embodiment of embodiment 328 through the immediately preceding embodiment, wherein, while the central fold is at the second fold location, the second tab is located at the third location opposite the central fold, and extends at the third location, when the sheet is folded in a direction that results in the bottom surface being folded against itself.

333. A sheet for a folder, comprising:

a sheet of material having a top surface, a bottom surface, first and second ends, two longitudinal edges, and first and second tabs, the sheet of material foldable along a central fold line into a file folder having one of the tabs extending at one of three locations opposite the central fold, with the tab extending from a top of the folder while the central fold is oriented at a bottom of the folder;

wherein the first tab is disposed along the first end of the sheet and the second tab is disposed along a second end of the sheet;

wherein, while the central fold is at a first fold location, the first tab is located at one of first and third locations opposite the central fold, and capable of extending at either the first location or the third location, depending on which direction the sheet is folded; and wherein, while the central fold is at a second fold location, the second tab is located at the second location opposite the central fold.

334. The sheet for a folder according to claim 333, wherein, while the central fold is at the first fold location, the first tab is located at the first location opposite the central fold, and extends at the first location, when the sheet is folded in a direction that results in the top surface being folded against itself.

335. The sheet for a folder according to any one embodiment of embodiment 333 through the immediately preceding embodiment, wherein, while the central fold is at the first fold location, the first tab is located at the third location opposite the central fold, and extends at the third location, when the sheet is folded in a direction that results in the bottom surface being folded against itself.

336. The sheet for a folder according to any one embodiment of embodiment 333 through the immediately preceding embodiment, wherein, while the central fold is at the second fold location, the second tab is located at the second location opposite the central fold, and extends at the second location, when the sheet is folded in a direction that results in the bottom surface being folded against itself.

337. The sheet for a folder according to any one embodiment of embodiment 333 through the immediately preceding embodiment, wherein, while the central fold is at the second fold location, the second tab is located at the second location opposite the central fold, and extends at the second location, when the sheet is folded in a direction that results in the top surface being folded against itself.

338. A method of folding a sheet of material into a folder, comprising:

providing a sheet of material having a top surface, a bottom surface, first and second ends, two longitudinal edges, a first tab extending from the first end, and a second tab extending from the second end, the sheet of material foldable along a central fold line into a file folder having one of the tabs extending at one of four locations opposite the central fold, with the tab extending from a top of the folder while the central fold is oriented at a bottom of the folder;

selecting a desired location among the four locations to position an extending tab;

identifying a fold line for a central fold that results in one of the tabs extending from at least the desired location of the four locations;

identifying a fold direction that results in one of the tabs extending from at least the desired location of the four locations;

folding the sheet at the identified fold line in the identified direction to position the tab to extend from the desired location.

339. A method of folding a sheet of material into a folder, comprising:

providing a sheet of material having a top surface, a bottom surface, first and second ends, two longitudinal edges, a first tab extending from the first end, and a second tab extending from the second end, the sheet of material foldable along a central fold line into a file folder having one of the tabs extending at one of three locations opposite the central fold, with the tab extending from a top of the folder while the central fold is oriented at a bottom of the folder;

selecting a desired location among the three locations to position an extending tab;

identifying a fold line for a central fold that results in one of the tabs extending from at least the desired location of the three locations;

identifying a fold direction that results in one of the tabs extending from at least the desired location of the three locations;

folding the sheet at the identified fold line in the identified direction to position the tab to extend from the desired location.

340. The sheet for a folder according to any one embodiment of embodiment 318 through the immediately preceding embodiment, wherein longitudinal edges are parallel and the central fold is perpendicular to the longitudinal edges.

341. The sheet for a folder according to any one embodiment of embodiment 318 through the immediately preceding embodiment, wherein an overall length of the sheet is a length measured parallel to the longitudinal edges from tab to tab; first and second fold locations are displaced from a virtual fold line precisely in the middle of the overall length.

342. A folder according to any one embodiment of the preceding embodiments, wherein the sheet of material is formed from a plurality of layers of different materials.

343. A file folder according to any one of the preceding embodiments having at least one edge fold forming at least one pocket and further having at least one suspension bar/hanger at least partially disposed in the pocket, wherein instead of one or more of the pockets formed by one or more of the edge folds, the sheet has at least one edge, and wherein one or more of the suspension bars/hangers are affixed to or otherwise operatively connected to the at least one edge, and the relative distances are with respect to the at least one edge the edge fold (e.g., claim 1 as originally filed).

I claim:

1. A sheet for a folder, comprising:

a sheet of material having a top surface, a bottom surface, first and second ends, two longitudinal edges, and first and second tabs, the sheet of material foldable along a central fold line into a file folder having one of the tabs extending at one of four different, distinct locations opposite the central fold, with the tab extending from a top of the folder while the central fold is oriented at a bottom of the folder;

wherein the first tab is disposed along the first end of the sheet and the second tab is disposed along a second end of the sheet, and wherein the second tab is spaced from both longitudinal edges;

wherein, while the central fold is at a first fold location, the first tab is located at one of first and fourth different, distinct locations opposite the central fold, and capable of extending at either the first location or the fourth location, depending on which direction the sheet is folded;

wherein, while the central fold is at a second fold location, the second tab is located at one of second and third different, distinct locations opposite the central fold, and capable of extending at either the second location or the third location, depending on which direction the sheet is folded; and wherein the first tab is positioned on the first end and the second tab is positioned along the second end and are sized so that the tab positions are located to permit a user to view the tab of the file folder in any of the four different, distinct tab locations opposite the central fold without moving the folders in front of it when a plurality of the file folders are positioned with alternating tab positions from one file folder to the next.

2. The sheet for a folder according to claim 1, wherein the four different, distinct tab locations opposite the central fold are evenly spaced across the top of the file folder.

3. The sheet for a folder according to claim 2, wherein the first tab is positioned on the first end and the second tab is positioned along the second end and are sized so that the tab positions are located to permit a user to view the tab of the file folder in any of the four different, distinct tab locations opposite the central fold without moving the folders in front of it when a plurality of the file folders are positioned with alternating tab positions from one file folder to the next.

4. A kit, comprising:

one or more sheets of material for a folder having two ends and two longitudinal edges and further having at least one tab at one end and at least one other tab at an opposite end, and wherein the other tab is spaced from both longitudinal edges; and instructions for folding the sheet of material along a central fold to form a folder having a tab in any position of at least three different, distinct tab positions opposite the fold;

wherein a plurality of the sheets of material are in accordance with claim 2.

5. The sheet for a folder according to claim 1, wherein the sheet is made from a single piece of material and from a single die cut.

6. A kit, comprising:

one or more sheets of material for a folder having two ends and two longitudinal edges and further having at least one tab at one end and at least one other tab at an opposite end, and wherein the other tab is spaced from both longitudinal edges; and instructions for folding the sheet of material along a central fold to form a folder having a tab in any position of at least three different, distinct tab positions opposite the fold;

wherein a plurality of the sheets of material are in accordance with claim 1.

7. The kit according to claim 6 wherein the instructions indicate how to fold a folder having a tab in any position of four different, distinct tab positions opposite the fold.

8. The kit according to claim 6 wherein a plurality of the sheets of material have the four different, distinct tab locations opposite the central fold evenly spaced across the top of the file folder.

9. A sheet for a folder, comprising:

a sheet of material having a top surface, a bottom surface, first and second ends, two longitudinal edges, and first and second tabs, the sheet of material foldable along a central fold line into a file folder having one of the tabs extending at one of three different, distinct locations opposite the central fold, with the tab extending from a top of the folder while the central fold is oriented at a bottom of the folder;

wherein the first tab is disposed along the first end of the sheet and the second tab is disposed along a second end of the sheet, and wherein the second tab is spaced from both longitudinal edges;

wherein, while the central fold is at a first fold location, the first tab is located at one of first and third different, distinct locations opposite the central fold, and capable of extending at either the first location or the third location, depending on which direction the sheet is folded;

wherein, while the central fold is at a second fold location, the second tab is located at the second different, distinct location opposite the central fold; and wherein the first tab is positioned on the first end and the second tab is positioned along the second end and are sized so that the tab positions are located to permit a user to view the tab of the file folder in any of the three different, distinct tab locations opposite the central fold without moving the folders in front of it when a plurality of the file folders are positioned with alternating tab positions from one file folder to the next.

10. The sheet for a folder according to claim 9, wherein the three different, distinct tab locations opposite the central fold are evenly spaced across the top of the file folder.

11. The sheet for a folder according to claim 10, wherein the first tab is positioned on the first end and the second tab is positioned along the second end and are sized so that the tab positions are located to permit a user to view the tab of the file folder in any of the three different, distinct tab locations opposite the central fold without moving the folders in front of it when a plurality of the file folders are positioned with alternating tab positions from one file folder to the next.

12. The sheet for a folder according to claim 9, wherein the sheet is made from a single piece of material and from a single die cut.

13. A kit, comprising:

one or more sheets of material for a folder having two ends and two longitudinal edges and further having at least one tab at one end and at least one other tab at an opposite end, and wherein the other tab is spaced from both longitudinal edges; and instructions for folding the sheet of material along a central fold to form a folder having a tab in any position of at least three different, distinct tab positions opposite the fold;

wherein a plurality of the sheets of material are in accordance with claim 9.

14. The kit according to claim 13 wherein a plurality of the sheets of material have the three different, distinct tab locations opposite the central fold evenly spaced across the top of the file folder.

15. A sheet for a folder, comprising:

a sheet of material having a top surface, a bottom surface, first and second ends, two longitudinal edges, and first and second tabs, the sheet of material foldable along a central fold line into a file folder having one of the tabs extending at one of four different, distinct locations opposite the central fold, with the tab extending from a top of the folder while the central fold is oriented at a bottom of the folder;

wherein the first tab is disposed along the first end of the sheet and the second tab is disposed along a second end of the sheet, and wherein the second tab is spaced from both longitudinal edges;

wherein, while the central fold is at a first fold location, the first tab is located at one of first and fourth different, distinct locations opposite the central fold, and capable of extending at either the first location or the fourth location, depending on which direction the sheet is folded;

wherein, while the central fold is at a second fold location, the second tab is located at one of second and third different, distinct locations opposite the central fold, and capable of extending at either the second location or the third location, depending on which direction the sheet is folded; and wherein the four different, distinct tab locations opposite the central fold are evenly spaced across the top of the file folder.

* * * * *